US006826526B1

(12) United States Patent
Norimatsu et al.

(10) Patent No.: US 6,826,526 B1
(45) Date of Patent: Nov. 30, 2004

(54) AUDIO SIGNAL CODING METHOD, DECODING METHOD, AUDIO SIGNAL CODING APPARATUS, AND DECODING APPARATUS WHERE FIRST VECTOR QUANTIZATION IS PERFORMED ON A SIGNAL AND SECOND VECTOR QUANTIZATION IS PERFORMED ON AN ERROR COMPONENT RESULTING FROM THE FIRST VECTOR QUANTIZATION

(75) Inventors: Takeshi Norimatsu, Kobe (JP); Shuji Miyasaka, Neyagawa (JP); Yoshihisa Nakato, Katano (JP); Mineo Tsushima, Katano (JP); Tomokazu Ishikawa, Toyonaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/171,266

(22) PCT Filed: Jul. 1, 1997

(86) PCT No.: PCT/JP97/02271

§ 371 (c)(1),
(2), (4) Date: Jul. 23, 1999

(87) PCT Pub. No.: WO98/00837

PCT Pub. Date: Jan. 8, 1998

(30) Foreign Application Priority Data

Jul. 1, 1996 (JP) ..... 8-171296
Apr. 10, 1997 (JP) ..... 9-92406
May 15, 1997 (JP) ..... 9-125844

(51) Int. Cl.[7] ..... G10L 19/00
(52) U.S. Cl. ..... 704/222
(58) Field of Search ..... 704/222, 223, 704/227–9, 231–233

(56) References Cited

U.S. PATENT DOCUMENTS 5,398,069 A 3/1995 Huang et al.
5,666,465 A * 9/1997 Ozawa ..... 704/222
5,717,821 A * 2/1998 Tsutsui et al. ..... 704/205
5,809,459 A * 9/1998 Bergstrom et al. ..... 704/223

FOREIGN PATENT DOCUMENTS

EP 0673014 9/1995

(List continued on next page.)

OTHER PUBLICATIONS

Gersho and Gray, Vector Quantization and Signal Compression, Kluwer Academic Publishers, 1992, pp. 451–455.*
G. Davidson et al., "Multiple–Stage Vector Excitation Coding of Speech Waveforms", International Conference on Acoustics, Speech & Signal Processing, ICASSP, US, New York, IEEE, vol. CONF. 13, 1988, pp. 163–166.

(List continued on next page.)

*Primary Examiner*—David D. Knepper
(74) *Attorney, Agent, or Firm*—Wenderoth, Lind & Ponack, L.L.P.

(57) ABSTRACT

A coding unit codes an audio signal by using a vector quantization method to reduce the quantity of data. An audio code having a minimum distance among auditive distances between sub-vectors produced by dividing an input vector and audio codes in a transmission-side code book is selected. A portion corresponding to an element of a sub-vector having a high auditive importance is handled in an audio code selecting unit while neglecting the codes indicating phase information and subjected to comparative retrieval with respect to audio codes in a transmission-side code book. Extracted phase information corresponding to an element portion of the sub-vector is added to the result obtained and output as a code index. Thereby, the calculation amount in the code retrieval of vector quantization and the number of codes in the code book are decreased without lowering the quality of an audio signal.

28 Claims, 37 Drawing Sheets

FOREIGN PATENT DOCUMENTS

| | | |
|---|---|---|
| EP | 0709827 | 5/1996 |
| JP | 03-228433 | 10/1991 |
| JP | 04-171500 | 6/1992 |
| JP | 05-165499 | 7/1993 |
| JP | 5-257498 | 10/1993 |
| JP | 06-077840 | 3/1994 |
| JP | 6-118998 | 4/1994 |
| JP | 06-169449 | 6/1994 |
| JP | 6-291674 | 10/1994 |
| JP | 7-64599 | 3/1995 |
| JP | 8-137498 | 5/1996 |
| JP | 8-194497 | 7/1996 |
| JP | 09-034499 | 2/1997 |
| JP | 09-127987 | 5/1997 |
| JP | 09-130260 | 5/1997 |
| JP | 09-281995 | 10/1997 |
| JP | 10-020898 | 1/1998 |

OTHER PUBLICATIONS

M. Iwadare et al., "A 128 kb/s Hi–Fi Audio CODEC Based on Adaptive Transform Coding with Adaptive Block Size MDCT", IEEE Journal on Selected Areas in Communications, US, IEEE Inc., New York, vol. 10, No. 1, Jan. 1, 1992, pp. 138–144.

D.H. Lee et al., "Cell–Conditioned Multistage Vector Quantization", International Conference on Acoustics, Speech & Signal Processing, ICASSP, US, New York, IEEE, vol. CONF. 16, 1991, pp. 653–656.

A. Moreno et al., "Envelope and Instantaneous Phase in Residual Representation", Proceedings of the European Signal Processing Conference (EUSIPCO), NL, Amsterdam, North Holland, vol. CONF. 4, 1988, pp. 167–170.

O. Gautherot et al., "LPC Residual Phase Investigation", Proceedings of the European Conference on Speech Communication and Technology (EUROSPEECH), GB, Edinburgh, CEP Consultants, vol. CONF. 1, 1989, pp. 35–38.

* cited by examiner

A selection scale of each window section, and a window section showing a maximum selection scale are selected.

| element A | element B |
|---|---|
| positive | positive |
| positive | negative |
| negative | positive |
| negative | negative |

AUDIO SIGNAL CODING METHOD, DECODING METHOD, AUDIO SIGNAL CODING APPARATUS, AND DECODING APPARATUS WHERE FIRST VECTOR QUANTIZATION IS PERFORMED ON A SIGNAL AND SECOND VECTOR QUANTIZATION IS PERFORMED ON AN ERROR COMPONENT RESULTING FROM THE FIRST VECTOR QUANTIZATION

TECHNICAL FIELD

The present invention relates to coding apparatuses and methods in which a feature quantity obtained from an audio signal such as a voice signal or a music signal, especially a signal obtained by transforming an audio signal from time-domain to frequency-domain using a method like orthogonal transformation, is efficiently coded so that it is expressed with fewer coded streams as compared with the original audio signal, and to decoding apparatuses and methods having a structure capable of decoding a high-quality and broad-band audio signal using all or only a portion of the coded streams which are coded signals.

Various methods for efficiently coding and decoding audio signals have been proposed. Especially for an audio signal having a frequency band exceeding 20 kHz such as a music signal, an MPEG audio method has been proposed in recent years. In the coding method represented by the MPEG method, a digital audio signal on the time axis is transformed to data on the frequency axis using orthogonal transform such as cosine transform, and data on the frequency axis are coded from auditively important data by using the auditive sensitivity characteristic of human beings, whereas auditively unimportant data and redundant data are not coded. In order to express an audio signal with a data quantity considerably smaller than the data quantity of the original digital signal, there is a coding method using a vector quantization method, such as TC-WVQ. The MPEG audio and the TC-WVQ are described in "ISO/IEC standard IS-11172-3" and "T. Moriya, H. Suga: An 8 Kbits transform coder for noisy channels, Proc. ICASSP 89, pp. 196–199", respectively. Hereinafter, the structure of a conventional audio coding apparatus will be explained using FIG. 37. In FIG. 37, reference numeral 1601 denotes an FFT unit which frequency-transforms an input signal, 1602 denotes an adaptive bit allocation calculating unit which codes a specific band of the frequency-transformed input signal, 1603 denotes a sub-band division unit which divides the input signal into plural bands, 1604 denotes a scale factor normalization unit which normalizes the plural band components, and 1605 denotes a scalar quantization unit.

A description is given of the operation. An input signal is input to the FFT unit 1601 and the sub-band division unit 1603. In the FFT unit 1601, the input signal is subjected to frequency transformation, and input to the adaptive bit allocation unit 1602; In the adaptive bit allocation unit 1602, how much data quantity is to be given to a specific band component is calculated on the basis of the minimum audible limit, which is defined according to the auditive characteristic of human beings and the masking characteristic, and the data quantity allocation for each band is coded as an index.

On the other hand, in the sub-band division unit 1603, the input signal is divided into, for example, 32 bands, to be output. In the scale factor normalization unit 1604, for each band component obtained in the sub-band division unit

1603, normalization is carried out with a representative value. The normalized value is quantized as an index. In the scalar quantization unit 1605, on the basis of the bit allocation calculated by the adaptive bit allocation calculating unit 1602, the output from the scale factor normalization unit 1604 is scalar-quantized, and the quantized value is coded as an index.

Meanwhile, various methods of efficiently coding an acoustic signal have been proposed. Especially in recent years, a signal having a frequency band of about 20 kHz, such as a music signal, is coded using the MPEG audio method or the like. In the methods represented by the MPEG method, a digital audio signal on the time axis is transformed to the frequency axis using orthogonal transform, and data on the frequency axis are given data quantities, with a priority to auditively important one, while considering the auditive sensitivity characteristic of human beings. In order to express a signal having a data quantity considerably smaller than the data quantity of the original digital signal, employed is a coding method using a vector quantization method, such as TCWVQ (Transform Coding for Weighted Vector Quantization). The MPEG audio and the TCWVQ are described in "ISO/IEC standard IS-11172-3" and "T. Moriya, H. Suga: An 8 Kbits transform coder for noisy channels, Proc. ICASSP 89, pp. 196–199", respectively.

In the conventional audio signal coding apparatus constructed as described above, it is general that the MPEG audio method is used so that coding is carried out with a data quantity of 64000 bits/sec for each channel. With a data quantity smaller than this, the reproducible frequency band width and the subjective quality of decoded audio signal are sometimes degraded considerably. The reason is as follows. As in the example shown in FIG. 37, the coded data are roughly divided into three main parts, i.e., the bit allocation, the band representative value, and the quantized value. So, when the compression ratio is high, a sufficient data quantity is not allocated to the quantized value. Further, in the conventional audio signal coding apparatus, it is general that a coder and a decoder are constructed with the data quantity to be coded and the data quantity to be decoded being equal to each other. For example, in a method where a data quantity of 128000 bits/sec is coded, a data quantity of 128000 bits is decoded in the decoder.

However, in the conventional audio signal coding and decoding apparatuses, coding and decoding must be carried out with a fixed data quantity to obtain a good sound quality and, therefore, it is impossible to obtain a high-quality sound at a high compression ratio.

The present invention is made to solve the above-mentioned problems and has for its object to provide audio signal coding and decoding apparatuses, and audio signal coding and decoding methods, in which a high quality and a broad reproduction frequency band are obtained even when coding and decoding are carried out with a small data quantity and, further, the data quantity in the coding and decoding can be variable, not fixed.

Furthermore, in the conventional audio signal coding apparatus, quantization is carried out by outputting a code index corresponding to a code that provides a minimum auditive distance between each code possessed by a code block and an audio feature vector. However, when the number of codes possessed by the code book is large, the calculation amount significantly increases when retrieving an optimum code. Further, when the data quantity possessed by the code book is large, a large quantity of memory is required when the coding apparatus is constructed by hardware, and this is uneconomical. Further, on the receiving end, retrieval and memory quantity corresponding to the code indices are required.

The present invention is made to solve the above-mentioned problems and has for its object to provide an audio signal coding apparatus that reduces the number of times of code retrieval, and efficiently quantizes an audio signal with a code book having a lower number of codes, and an audio signal decoding apparatus that can decode the audio signal.

DISCLOSURE OF THE INVENTION

An audio signal coding method according to the present invention is a method for coding a data quantity by vector quantization using a multiple-stage quantization method comprising a first-stage vector quantization process for vector-quantizing a frequency characteristic signal sequence which is obtained by frequency transformation of an input audio signal, and second-and-onward-stages of vector quantization processes for vector-quantizing a quantization error component in the previous-stage vector quantization process: wherein, among the multiple stages of quantization processes according to the multiple-stage quantization method, at least one vector quantization process performs vector quantization using, as weighting coefficients for quantization, weighting coefficients on frequency, calculated on the basis of the spectrum of the input audio signal and the auditive sensitivity characteristic showing the auditive nature of human beings.

Another audio signal method according to the present invention is a method for coding a data quantity by vector quantization using a multiple-stage quantization method comprising a first vector quantization process for vector-quantizing a frequency characteristic signal sequence which is obtained by frequency transformation of an input audio signal, and a second vector quantization process for vector-quantizing a quantization error component in the first vector quantization process: wherein, on the basis of the spectrum of the input audio signal and the auditive sensitivity characteristic showing the auditive nature of human beings, a frequency block having a high importance for quantization is selected from frequency blocks of the quantization error component in the first vector quantization process and, in the second vector quantization process, the quantization error component of the first quantization process is quantized with respect to the selected frequency block.

Another audio signal coding method according to the present invention is a method for coding a data quantity by vector quantization using a multiple-stage quantization method comprising a first-stage vector quantization process for vector-quantizing a frequency characteristic signal sequence which is obtained by frequency transformation of an input audio signal, and second-and-onward-stages of vector quantization processes for vector-quantizing a quantization error component in the previous-stage vector quantization process: wherein, among the multiple stages of quantization processes according to the multiple-stage quantization method, at least one vector quantization process performs vector quantization using, as weighting coefficients for quantization, weighting coefficients on frequency, calculated on the basis of the spectrum of the input audio signal and the auditive sensitivity characteristic showing the auditive nature of human beings; and, on the basis of the spectrum of the input audio signal and the auditive sensitivity characteristic showing the auditive nature of human beings, a frequency block having a high importance for quantization is selected from frequency blocks of the quantization error component in the first-stage vector quantization process and, in the second-stage vector quantization process, the quantization error component of the first-stage quantization process is quantized with respect to the selected frequency block.

Another audio signal coding apparatus according to the present invention comprises: a time-to-frequency transformation unit for transforming an input audio signal to a frequency-domain signal, a spectrum envelope calculation unit for calculating a spectrum envelope of the input audio signal; a normalization unit for normalizing the frequency-domain signal obtained in the time-to-frequency transformation unit, with the spectrum envelope obtained in the spectrum envelope calculation unit, thereby to obtain a residual signal; an auditive weighting calculation unit for calculating weighting coefficients on frequency, on the basis of the spectrum of the input audio signal and the auditive sensitivity characteristic showing the auditive nature of human beings; and a multiple-stage quantization unit having multiple stages of vector quantization units connected in columns, to which the normalized residual signal is input, at least one of the vector quantization units performing quantization using weighting coefficients obtained in the weighting unit.

Another audio signal coding apparatus according to the present invention includes plural quantization units among the multiple stages of the multiple-stage quantization unit that perform quantization using the weighting coefficients obtained in the weighting unit, and the auditive weighting calculation unit calculates individual weighting coefficients to be used by the multiple stages of quantization units, respectively.

Another audio signal coding apparatus according to the present invention is an audio signal coding apparatus wherein the multiple-stage quantization unit comprises: a first-stage quantization unit for quantizing the residual signal normalized by the normalization unit, using the spectrum envelope obtained in the spectrum envelope calculation unit as weighting coefficients in the respective frequency domains; a second-stage quantization unit for quantizing a quantization error signal from the first-stage quantization unit, using weighting coefficients calculated on the basis of the correlation between the spectrum envelope and the quantization error signal of the first-stage quantization unit, as weighting coefficients in the respective frequency domains, and a third-stage quantization unit for quantizing a quantization error signal from the second-stage quantization unit using, as weighting coefficients in the respective frequency domains, weighting coefficients which are obtained by adjusting the weighting coefficients calculated by the auditive weighting calculating unit according to the input signal transformed to the frequency-domain signal by the time-to-frequency transformation unit and the auditive characteristic, on the basis of the spectrum envelope, the quantization error signal of the second-stage quantization unit, and the residual signal normalized by the normalization unit.

Another audio signal coding apparatus according to the present invention comprises: a time-to-frequency transformation unit for transforming an input audio signal to a frequency-domain signal, a spectrum envelope calculation unit for calculating a spectrum envelope of the input audio signal; a normalization unit for normalizing the frequency-domain signal obtained in the time-to-frequency transformation unit, with the spectrum envelope obtained in the spectrum envelope calculation unit, thereby to obtain a residual signal; a first vector quantizer for quantizing the residual signal normalized by the normalization unit; an auditive selection means for selecting a frequency block having a high importance for quantization among frequency blocks of the quantization error component of the first vector quantizer, on the basis of the spectrum of the input audio signal and the auditive sensitivity characteristic showing the auditive nature of human beings; and a second quantizer for quantizing the quantization error component of the first vector quantizer with respect to the frequency block selected by the auditive selection means.

Another audio signal coding apparatus according to the present invention is an audio signal coding apparatus wherein the auditive selection means selects a frequency block using, as a scale of importance to be quantized, a value obtained by multiplying the quantization error component of the first vector quantizer, the spectrum envelope signal obtained in the spectrum envelope calculation unit, and an inverse characteristic of the minimum audible limit characteristic.

Another audio signal coding apparatus according to the present invention is an audio signal coding apparatus wherein the auditive selection means selects a frequency block using, as a scale of importance to be quantized, a value obtained by multiplying the spectrum envelope signal obtained in the spectrum envelope calculation unit and an inverse characteristic of the minimum audible limit characteristic.

Another audio signal coding apparatus according to the present invention is an audio signal coding apparatus wherein the auditive selection means selects a frequency block using, as a scale of importance to be quantized, a value obtained by multiplying the quantization error component of the first vector quantizer, the spectrum envelope signal obtained in the spectrum envelope calculation unit, and an inverse characteristic of a characteristic obtained by adding the minimum audible limit characteristic and a masking characteristic calculated from the input signal.

Another audio signal coding apparatus according to the present invention is an audio signal coding apparatus wherein the auditive selection means selects a frequency block using, as a scale of importance to be quantized, a value obtained by multiplying the quantization error component of the first vector quantizer, the spectrum envelope signal obtained in the spectrum envelope calculation unit, and an inverse characteristic of a characteristic obtained by adding the minimum audible limit characteristic and a masking characteristic that is calculated from the input signal and corrected according to the residual signal normalized by the normalization unit, the spectrum envelope signal obtained in the spectrum envelope calculation unit, and the quantization error signal of the first-stage quantization unit.

An audio signal coding apparatus according to the present invention is an apparatus for coding a data quantity by vector quantization using a multiple-stage quantization means comprising a first vector quantizer for vector-quantizing a frequency characteristic signal sequence obtained by frequency transformation of an input audio signal, and a second vector quantizer for vector-quantizing a quantization error component of the first vector quantizer: wherein the multiple-stage quantization means divides the frequency characteristic signal sequence into coefficient streams corresponding to at least two frequency bands, and each of the vector quantizers performs quantization, independently, using a plurality of divided vector quantizers which are prepared corresponding to the respective coefficient streams.

Another audio signal coding apparatus according to the present invention is an audio signal coding apparatus further comprising a normalization means for normalizing the frequency characteristic signal sequence.

Another audio signal coding apparatus according to the present invention is an audio signal coding apparatus wherein the quantization means appropriately selects a frequency band having a large energy-addition-sum of the quantization error, from the frequency bands of the frequency characteristic signal sequence to be quantized, and then quantizes the selected band.

Another audio signal coding apparatus according to the present invention is an audio signal coding apparatus wherein the quantization means appropriately selects a frequency band from the frequency bands of the frequency characteristic signal sequence to be quantized, on the basis of the auditive sensitivity characteristic showing the auditive nature of human beings, which frequency band selected has a large energy-addition-sum of the quantization error weighted by giving a large value to a band having a high importance of the auditive sensitivity characteristic, and then the quantization means quantizes the selected band.

Another audio signal coding apparatus according to the present invention is an audio signal coding apparatus wherein the quantization means has a vector quantizer serving as an entire band quantization unit which quantizes, once at least, all of the frequency bands of the frequency characteristic signal sequence to be quantized.

Another audio signal coding apparatus according to the present invention is an audio signal coding apparatus wherein the quantization means is constructed so that the first-stage vector quantizer calculates a quantization error in vector quantization using a vector quantization method with a code book and, further, the second-stage quantizer vector-quantizes the calculated quantization error.

Another audio signal coding apparatus according to the present invention is an audio signal coding apparatus wherein, as the vector quantization method, code vectors, all or a portion of which codes are inverted, are used for code retrieval.

Another audio signal coding apparatus according to the present invention is an audio signal coding apparatus further comprising a normalization means for normalizing the frequency characteristic signal sequence, wherein calculation of distances used for retrieval of an optimum code in vector quantization is performed by calculating distances using, as weights, normalized components of the input signal processed by the normalization unit, and extracting a code having a minimum distance.

Another audio signal coding apparatus according to the present invention is an audio signal coding apparatus wherein the distances are calculated using, as weights, both of the normalized components of the frequency characteristic signal sequence processed by the normalization means and a value in view of the auditive sensitivity characteristic showing the auditive nature of human beings, and a code having a minimum distance is extracted.

Another audio signal coding apparatus according to the present invention is an audio signal coding apparatus wherein the normalization means has a frequency outline normalization unit that roughly normalizes the outline of the frequency characteristic signal sequence.

Another audio signal coding apparatus according to the present invention is an audio signal coding apparatus wherein the normalization means has a band amplitude normalization unit that divides the frequency characteristic signal sequence into a plurality of components of continuous unit bands, and normalizes the signal sequence by dividing each unit band with a single value.

Another audio signal coding apparatus according to the present invention is an audio signal coding apparatus wherein the quantization means includes a vector quantizer for quantizing the respective coefficient streams of the frequency characteristic signal sequence independently by divided vector quantizers, and includes a vector quantizer serving as an entire band quantization unit that quantizes, once at least, all of the frequency bands of the input signal to be quantized.

Another audio signal coding apparatus according to the present invention is an audio signal coding apparatus wherein the quantization means comprises a first vector quantizer comprising a low-band divided vector quantizer, an intermediate-band divided vector quantizer, and a high-band divided vector quantizer, and a second vector quantizer connected after the first quantizer, and a third vector quantizer connected after the second quantizer. The frequency characteristic signal sequence input to the quantization means is divided into three bands, and the frequency characteristic signal sequence of low-band component among the three bands is quantized, by the low-band divided vector quantizer. The frequency characteristic signal sequence of intermediate-band component among the three bands is quantized by the intermediate-band divided vector quantizer, and the frequency characteristic signal sequence of high-band component among the three bands is quantized by the high-band divided vector quantizer, independently. A quantization error with respect to the frequency characteristic signal sequence is calculated in each of the divided vector quantizers constituting the first vector quantizer, and the quantization error is input to the subsequent second vector quantizer. The second vector quantizer performs quantization for a band width to be quantized by the second vector quantizer, calculates a quantization error with respect to the input of the second vector quantizer, and inputs this to the third vector quantizer. The third vector quantizer performs quantization for a band width to be quantized by the third vector quantizer.

Another audio signal coding apparatus according to the present invention is an audio signal coding apparatus further comprising a first quantization band selection unit between the first vector quantizer and the second vector quantizer, and a second quantization band selection unit between the second vector quantizer and the third vector quantizer: wherein the output from the first vector quantizer is input to the first quantization band selection unit, and a band to be quantized by the second vector quantizer is selected in the first quantization band selection unit. The second vector quantizer performs quantization for a band width to be quantized by the second vector quantizer, with respect to the quantization errors of the first three vector quantizers decided by the first quantization band selection unit, calculates a quantization error with respect to the input to the second vector quantizer, and inputs this to the second quantization band selection unit. The second quantization band selection unit selects a band to be quantized by the third vector quantizer. The third vector quantizer performs quantization for a band decided by the second quantization band selection unit.

Another audio signal coding apparatus according to the present invention is an audio signal coding apparatus wherein, in place of the first vector quantizer, the second vector quantizer or the third vector quantizer is constructed using the low-band divided vector quantizer, the intermediate-band divided vector quantizer, and the high-band divided vector quantizer.

Another audio signal decoding apparatus according to the present invention is an apparatus receiving, as an input, codes output from the audio signal coding apparatus and decoding these codes to output a signal corresponding to the original input audio signal, and this apparatus comprises: an inverse quantization unit for performing inverse quantization using at least a portion of the codes output from the quantization means of the audio signal coding apparatus and an inverse frequency transformation unit for transforming a frequency characteristic signal sequence output from the inverse quantization unit to a signal corresponding to the original audio input signal.

Another audio signal decoding apparatus according to the present invention is an apparatus receiving, as an input, codes output from the audio signal coding apparatus and decoding these codes to output a signal corresponding to the original input audio signal, and this apparatus comprises: an inverse quantization unit for reproducing a frequency characteristic signal sequence; an inverse normalization unit for reproducing normalized components on the basis of the codes output from the audio signal coding apparatus, using the frequency characteristic signal sequence output from the inverse quantization unit, and multiplying the frequency characteristic signal sequence and the normalized components; and an inverse frequency transformation unit for receiving the output from the inverse normalization unit and transforming the frequency characteristic signal sequence to a signal corresponding to the original audio signal.

Another audio signal decoding apparatus according to the present invention is an apparatus receiving, as an input, codes output from the audio signal coding apparatus and decoding these codes to output a signal corresponding to the original audio signal, and this apparatus comprises an inverse quantization unit which performs inverse quantization using the output codes whether the codes are output from all of the vector quantizers constituting the quantization means in the audio signal coding apparatus or from some of them.

Another audio signal decoding apparatus according to the present invention is an audio signal decoding apparatus wherein the inverse quantization unit performs inverse quantization of quantized codes in a prescribed band by executing, alternately, inverse quantization of quantized codes in a next stage, and inverse quantization of quantized codes in a band different from the prescribed band. When there are no quantized codes in the next stage during the inverse quantization, the inverse quantization unit continuously executes the inverse quantization of quantized codes in the different band and, when there are no quantized codes in the different band, the inverse quantization unit continuously executes the inverse quantization of quantized codes in the next stage.

Another audio signal decoding apparatus according to the present invention is an apparatus receiving, as an input, codes output from the audio signal coding apparatus and decoding these codes to output a signal corresponding to the original input audio signal, and this apparatus comprises an inverse quantization unit which performs inverse quantization using only codes output from the low-band divided vector quantizer as a constituent of the first vector quantizer even though all or some of the three divided vector quantizers constituting the first vector quantizer in the audio signal coding apparatus output codes.

Another audio signal decoding apparatus according to the present invent ion is an audio signal decoding apparatus wherein the inverse quantization unit performs inverse quantization using codes output from the second vector quantizer, in addition to the codes output from the low-band divided vector quantizer as a constituent of the first vector quantizer.

Another audio signal decoding apparatus according to the present invention is an audio signal decoding apparatus wherein the inverse quantization unit performs inverse quantization using codes output from the intermediate-band divided vector quantizer as a constituent of the first vector quantizer, in addition to the codes output from the low-band divided vector quantizer as a constituent of the first vector quantizer and the codes output from the second vector quantizer.

Another audio signal decoding apparatus according to the present invention is an audio signal decoding apparatus wherein the inverse quantization unit performs inverse quantization using codes output from the third vector quantizer, in addition to the codes output from the low-band divided vector quantizer as a constituent of the first vector quantizer, the codes output from the second vector quantizer, and the codes output from the intermediate-band divided vector quantizer as a constituent of the first vector quantizer.

Another audio signal decoding apparatus according to the present invention is an audio signal decoding apparatus wherein the inverse quantization unit performs inverse quantization using codes output from the high-band divided vector quantizer as a constituent of the first vector quantizer, in addition to the codes output from the low-band divided vector quantizer as a constituent of the first vector quantizer, the codes output from the second vector quantizer, the codes output from the intermediate-band divided vector quantizer as a constituent of the first vector quantizer, and the codes output from the third vector quantizer.

Another audio signal coding apparatus according to the present invention comprises: a phase information extraction unit for receiving, as an input signal, a frequency characteristic signal sequence by obtained by frequency transformation of an input audio signal, and extracting phase information of a portion of the frequency characteristic signal sequence corresponding to a prescribed frequency band, a code book for containing a plurality of audio codes being representative values of the frequency characteristic signal sequence, wherein an element portion of each audio code corresponding to the extracted phase information is shown by an absolute value; and an audio code selection unit for calculating the auditive distances between the frequency characteristic signal sequence and the respective audio codes in the code book, selecting an audio code having a minimum distance, adding phase information to the audio code having the minimum distance using the output from the phase information extraction unit as auxiliary information, and outputting a code index corresponding to the audio code having the minimum distance as an output signal.

Another audio signal coding apparatus according to the present invention is an audio signal coding apparatus wherein the phase information extraction unit extracts phase information of a prescribed number of elements on the low-frequency band side of the input frequency characteristic signal sequence.

Another audio signal coding apparatus according to the present invention is an audio signal coding apparatus further comprising an auditive psychological weight vector table which is a table of auditive psychological quantities relative to the respective frequencies in view of the auditive psychological characteristic of human beings: wherein the phase information extraction unit extracts phase information of an element which matches with a vector stored in the auditive psychological weight vector table, from the input frequency characteristic signal sequence.

Another audio signal coding apparatus according to the present invention is an audio signal coding apparatus further comprising a smoothing unit for smoothing the frequency characteristic signal sequence using a smoothing vector by division between vector elements: wherein, before selecting the audio code having the minimum distance and adding the phase information to the selected audio code, the audio code selecting unit converts the selected audio code to an audio code which has not been subjected to smoothing using smoothing information output from the smoothing unit, and outputs a code index corresponding to the audio code as an output signal.

An audio signal coding apparatus according to the present invention is an audio signal coding apparatus further comprising: an auditive psychological weight vector table which is a table of auditive psychological quantities relative to the respective frequencies, in view of the auditive psychological characteristic of human beings; a smoothing unit for smoothing the frequency characteristic signal sequence using a smoothing vector by division between vector elements; and a sorting unit for selecting a plurality of values obtained by multiplying the values of the auditive psychological weight vector table and the values of the smoothing vector table, in order of auditive importance, and outputting these values toward the audio code selection unit.

Another audio signal coding apparatus according to the present invention is an audio signal-coding apparatus wherein employed as the frequency characteristic signal sequence is a vector of which elements are coefficients obtained by subjecting the audio signal to frequency transformation.

Another audio signal coding apparatus according to the present invention is an audio signal coding apparatus wherein employed as the frequency characteristic signal sequence is a vector of which elements are coefficients obtained by subjecting the audio signal to frequency transformation.

Another audio signal coding apparatus according to the present invention is an audio signal coding apparatus wherein employed as the frequency characteristic signal sequence is a vector of which elements are coefficients obtained by subjecting the audio signal to frequency transformation.

Another audio signal coding apparatus according to the present invention is an audio signal coding apparatus wherein employed as the frequency characteristic signal sequence is a vector of which elements are coefficients obtained by subjecting the audio signal to MDCT (Modified Discrete Cosine Transformation).

Another audio signal coding apparatus according to the present invention is an audio signal coding apparatus wherein employed as the frequency characteristic signal sequence is a vector of which elements are coefficients obtained by subjecting the audio signal to MDCT (Modified Discrete Cosine Transformation).

Another audio signal coding, apparatus according to the present invention is an audio signal coding apparatus wherein employed as the frequency characteristic signal sequence is a vector of which elements are coefficients obtained by subjecting the audio signal to MDCT (Modified Discrete Cosine Transformation).

Another audio signal coding apparatus according to the present invention is an audio signal coding apparatus wherein employed as the smoothing vector is a vector of which elements are relative frequency responses in the respective frequencies, which are calculated from linear prediction coefficients obtained by subjecting the audio signal to linear prediction.

Another audio signal coding apparatus according to the present invention is an audio signal coding apparatus wherein employed as the smoothing vector is a vector of which elements are relative frequency responses in the respective frequencies, which are calculated from linear prediction coefficients obtained by subjecting the audio signal to linear prediction.

Another audio signal decoding apparatus according to the present invention comprises: a phase information extraction unit for receiving, as an input signal, one of code indices obtained by quantizing frequency characteristic signal sequences which are feature quantities of an audio signal, and extracting phase information of elements of the input code index corresponding to a prescribed frequency band; a code book for containing a plurality of frequency characteristic signal sequences corresponding to the code indices, wherein an element portion corresponding to the extracted phase information is shown by an absolute value, and an audio code selection unit for calculating the auditive distances between the input code index and the respective frequency characteristic signal sequences in the code book, selecting a frequency characteristic signal sequence having a minimum distance, adding phase information to the frequency characteristic signal sequence having the minimum distance using the output from the phase information extraction unit as auxiliary information, and outputting the frequency characteristic signal sequence corresponding to the input code index as an output signal.

BEST MODES TO EXECUTE THE INVENTION

Embodiment 1

Figure 1:
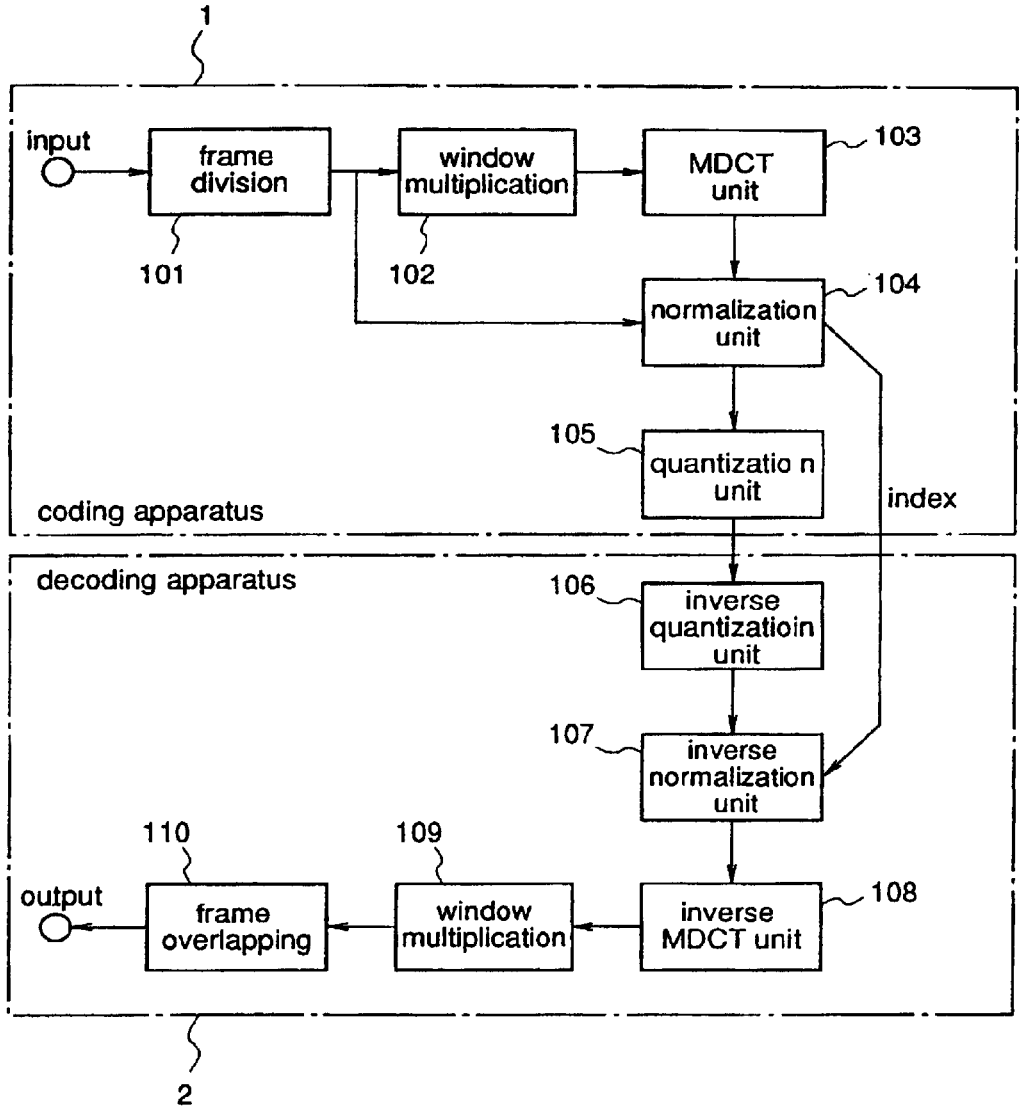
FIG. 1 is a diagram illustrating an overview of the structure of audio signal coding and decoding apparatuses according to a first embodiment of the present invention.

FIG. 1 is a diagram illustrating an overview of the structure of audio signal coding and decoding apparatuses according to a first embodiment of the invention. In FIG. 1, reference numeral 1 denotes a coding apparatus, and 2 denotes a decoding apparatus. In the coding apparatus 1, reference numeral 101 denotes a frame division unit that divides an input signal into a prescribed number of frames; 102 denotes a window multiplication unit that multiplies the input signal and a window function on the time axis; 103 denotes an MDCT unit that performs modified discrete cosine transform for time-to-frequency conversion of a signal on the time axis to a signal on the frequency axis; 104 denotes a normalization unit that receives both of the time axis signal output from the frame division unit 101 and the MDCT coefficients output from the MDCT unit 103 and normalizes the MDCT coefficients; and 105 denotes a quantization unit that receives the normalized MDCT coefficients and quantizes them. Although MDCT is employed for time-to-frequency transform in this embodiment, discrete Fourier transform (DFT) may be employed.

In the decoding apparatus 2, reference numeral 106 denotes an inverse quantization unit that receives a signal output from the coding apparatus 1 and inversely quantizes this signal; 107 denotes an inverse normalization unit that inversely normalizes the output from the inverse quantization unit 106; 108 denotes an inverse MDCT unit that performs modified discrete cosine transform of the output from the inverse normalization unit 107; 109 denotes a window multiplication unit; and 110 denotes a frame overlapping unit.

A description is given of the operation of the audio signal coding and decoding apparatuses constructed as described above.

It is assumed that the signal input to the coding apparatus 1 is a digital signal sequence that is temporally continuous. For example, it is a digital signal obtained by 16-bit quantization at a sampling frequency of 48 kHz. This input signal is accumulated in the frame division unit 101 until reaching a prescribed same number, and it is output when the accumulated sample number reaches a defined frame length. Here, the frame length of the frame division unit 101 is, for example, any of 128, 256, 512, 1024, 2048, and 4096 samples. In the frame division unit 101, it is also possible to output the signal with the frame length being variable according to the feature of the input signal. Further, the frame division unit 101 is constructed to perform an output for each shift length specified. For example, in the case where the frame length is 4096 samples, when a shift length half as long as the frame length is set, the frame division unit 101 outputs latest 4096 samples every time the frame length reaches 2048 samples. Of course, even when the frame length or the sampling frequency varies, it is possible to have the structure in which the shift length is set at half of the frame length.

The output from the frame division unit 101 is input to the window multiplication unit 102 and to the normalization unit 104. In the window multiplication unit 102, the output signal from the frame division unit 101 is multiplied by a window function on the time axis, and the result is output from the window multiplication unit 102. This manner is shown by, for example, formula (1).

$$hxi=hi\cdot xi \quad i=1, 2, \ldots, N$$

$$hi = \sin\left(\frac{\pi}{N}(i+0.5)\right) \tag{1}$$

where xi is the output from the frame division unit 101, hi is the window function, and hxi is the output from the window multiplication unit 102. Further, i is the suffix of time. The window function hi shown in formula (1) is an example, and the window function is not restricted to that shown in formula (1). Selection of the window function depends on the feature of the input signal, the frame length of the frame division unit 101, and the shapes of window functions in frames which are located temporally before and after the frame being processed. For example, assuming that the frame length of the frame division unit 101 is N, as the feature of the signal input to the window multiplication unit 102, the average power of signals input at every N/4 is calculated and, when the average power varies significantly, the calculation shown in formula (1) is executed with a frame length shorter than N. Further, it is desirable to appropriately select the window function, according to the shape of the window function of the previous frame and the shape of the window function of the subsequent frame, so that the shape of the window function of the present frame is not distorted.

Next, the output from the window multiplication unit 102 is input to the MDCT unit 103, wherein modified discrete cosine transform is executed, and MDCT coefficients are output. A general formula of modified discrete cosine transform is represented by formula (2).

$$yk = \sum_{n=0}^{N-1} hx_n \cdot \cos\left(\frac{2\pi(k+1/2)(n+n_0)}{N}\right)$$

$$n_0=N/4+½ \ (k=0, 1, \ldots, N/2-1) \tag{2}$$

Assuming that the MDCT coefficients output from the MDCT unit 103 are expressed by yk in formula (2), the output from the MDCT unit 103 shows the frequency characteristics, and it linearly corresponds to a lower frequency component as the variable k of yk approaches closer 0, while it corresponds to a higher frequency component as the variable k approaches closer N/2−1 from 0. The normalization unit 104 receives both of the time axis signal output from the frame division unit 101 and the MDCT coefficients output from the MDCT unit 103, and normalizes the MDCT coefficients using several parameters. To normalize the MDCT coefficients is to suppress variations in values of the MDCT coefficients, which values are considerably different between the low-band component and the high-band component. For example, when the low-band component is considerably larger than the high-band component, a parameter having a large value in the low-band component and a small value in the high-band component is selected, and the MDCT coefficients are divided by this parameter to suppress the variations of the MDCT coefficients. In the normalization unit 104, the indices expressing the parameters used for the normalization are coded.

The quantization unit 105 receives the MDCT coefficients normalized by the normalization unit 104, and quantizes the MDCT coefficients. The quantization unit 105 codes indices expressing parameters used for the quantization.

On the other hand, in the decoding apparatus 2, decoding is carried out using the indices from the normalization unit 104 in the coding apparatus 1, and the indices from the quantization unit 105. In the inverse quantization unit 106, the normalized MDCT coefficients are reproduced using the indices from the quantization unit 105. In the inverse quantization unit 106, the reproduction of the MDCT coefficients may be carried out using all or some of the indices. Of course, the output from the normalization unit 104 and the output from the inverse quantization unit 106 are not always identical to those before the quantization because the quantization by the quantization unit 105 is attended with quantization errors.

In the inverse normalization unit 107, the parameters used for the normalization in the coding apparatus 1 are restored from the indices output from the normalization unit 104 of the coding apparatus 1, and the output from the inverse quantization unit 106 is multiplied by those parameters to restore the MDCT coefficients. In the inverse MDCT unit 108, the MDCT coefficients output from the inverse normalization unit 107 are subjected to inverse MDCT, whereby the frequency-domain signal is restored to the time-domain signal. The inverse MDCT calculation is represented by, for example, formula (3).

$$xx(n) = \frac{2}{N}\sum_{k=0}^{N-1} yy_k \cos\left(\frac{2\pi(k+1/2)(n+n_0)}{N}\right)$$

$$n_0 = N/4 + 1/2 \tag{3}$$

where yyk is the MDCT coefficients restored in the inverse normalization unit 107, and xx(k) is the inverse MDCT coefficients which are output from the inverse MDCT unit 108.

The window multiplication unit 109 performs window multiplication using the output xx(k) from the inverse MDCT unit 108. The window multiplication is carried out using the same window as used by the window multiplication unit 102 of the coding apparatus B1, and a process shown by, for example, formula (4) is carried out.

$$z(i) = xx(i) \cdot hi \tag{4}$$

where zi is the output from the window multiplication unit 109.

The frame overlapping unit 110 reproduces the audio signal using the output from the window multiplication unit 109. Since the output from the window multiplication unit 109 is a temporally overlapped signal, the frame overlapping unit 110 provides an output signal from the decoding apparatus B2 using, for example, formula (5).

$$\mathrm{out}(i) = z_m(i) + z_{m-1}(i + \mathrm{SHIFT}) \tag{5}$$

where zm(i) is the i-th output signal z(i) from the window multiplication unit 109 in the m-th time frame, zm−1(i) is the i-th output signal from the window multiplication unit 19 in the (m−1)th time frame, SHIFT is the sample number corresponding to the shift length of the coding apparatus, and out(i) is the output signal from the decoding apparatus 2 in the m-th time frame of the frame overlapping unit 110.

Figure 2:
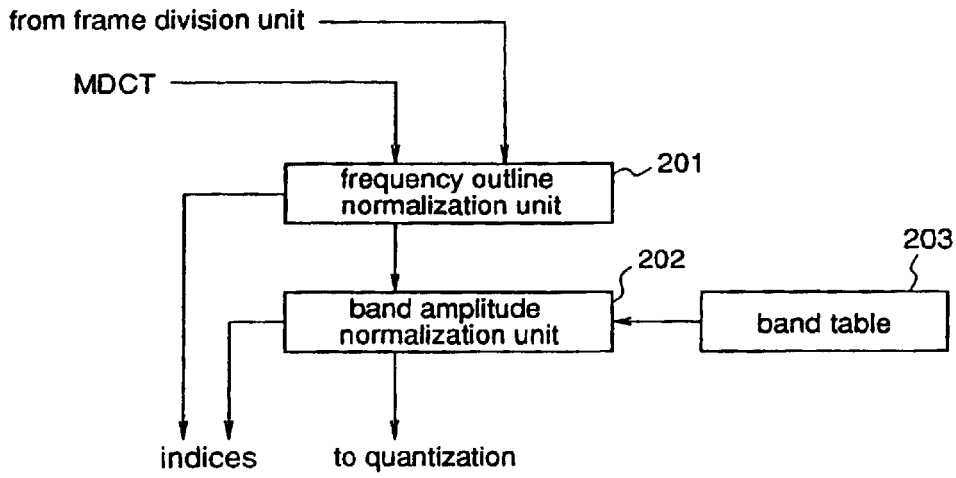
FIG. 2 is a block diagram illustrating an example of a normalization unit as a constituent of the above-described audio signal coding apparatus.

An example of the normalization unit 104 will be described in detail using FIG. 2. In FIG. 2, reference numeral 201 denotes a frequency outline normalization unit that receives the outputs from the frame division unit 101 and the MDCT unit 103; and 202 denotes a band amplitude normalization unit that receives the output from the frequency outline normalization unit 201 and performs normalization with reference to a band table 203.

A description is given of the operation. The frequency outline normalization unit 201 calculates a frequency outline, that is, a rough form of frequency, using the data on the time axis output from the frame division unit 101, and divides the MDCT coefficients output from the MDCT unit 103 by this. Parameters used for expressing the frequency outline are coded as indices. The band amplitude normalization unit 202 receives the output signal from the frequency outline normalization unit 201, and performs normalization for each band shown in the band table 203. For example, assuming that the MDCT coefficients output from the frequency outline normalization unit 201 are dct(i) (i=0~2047) and the band table 203 is, for example, as shown in Table 1, an average value of amplitude in each band is calculated using, for example, formula (6).

TABLE 1

| j | bjlow | bjhigh |
|---|---|---|
| 0 | 0 | 10 |
| 1 | 11 | 22 |
| 2 | 23 | 33 |
| 3 | 34 | 45 |
| 4 | 46 | 56 |
| 5 | 57 | 68 |
| 6 | 69 | 80 |
| 7 | 81 | 92 |
| 8 | 93 | 104 |
| 9 | 105 | 116 |
| 10 | 117 | 128 |
| 11 | 129 | 141 |
| 12 | 142 | 153 |
| 13 | 154 | 166 |
| 14 | 167 | 179 |
| 15 | 180 | 192 |
| 16 | 193 | 205 |
| 17 | 206 | 219 |
| 18 | 220 | 233 |
| 19 | 234 | 247 |
| 20 | 248 | 261 |
| 21 | 262 | 276 |
| 22 | 277 | 291 |
| 23 | 292 | 307 |
| 24 | 308 | 323 |
| 25 | 324 | 339 |
| 26 | 340 | 356 |
| 27 | 357 | 374 |
| 28 | 375 | 392 |
| 29 | 393 | 410 |
| 30 | 411 | 430 |

TABLE 1-continued

| j | bjlow | bjhigh |
|---|---|---|
| 31 | 431 | 450 |
| 32 | 451 | 479 |
| 33 | 471 | 492 |
| 34 | 493 | 515 |
| 35 | 516 | 538 |
| 36 | 539 | 563 |
| 37 | 564 | 588 |
| 38 | 589 | 615 |
| 39 | 616 | 644 |
| 40 | 645 | 673 |
| 41 | 674 | 705 |
| 42 | 706 | 737 |
| 43 | 738 | 772 |
| 44 | 773 | 809 |
| 45 | 810 | 848 |
| 46 | 849 | 889 |
| 47 | 890 | 932 |
| 48 | 933 | 978 |
| 49 | 979 | 1027 |
| 50 | 1028 | 1079 |
| 51 | 1080 | 1135 |
| 52 | 1136 | 1193 |
| 53 | 1194 | 1255 |
| 54 | 1256 | 1320 |
| 55 | 1321 | 1389 |
| 56 | 1390 | 1462 |
| 57 | 1463 | 1538 |
| 58 | 1539 | 1617 |
| 59 | 1618 | 1699 |
| 60 | 1700 | 1783 |
| 61 | 1784 | 1870 |
| 62 | 1871 | 1958 |
| 63 | 1959 | 2048 |

$$\left.\begin{aligned} sum_j &= \sum_{i=bjlow}^{bjhigh} dct(i)^p \\ ave_j &= \left(\frac{sum_j}{bjhigh - bjlow + 1}\right)^{-p} \end{aligned}\right\} bjlow \le i \le bjhigh \tag{6}$$

where bjlow and bjhigh are the lowest-band index i and the highest-band index i, respectively, in which dct(i) in the j-th band shown in the band table 203 belongs. Further, p is the norm in distance calculation, which is desired to be 2, and avej is the average of amplitude in each band number j. The band amplitude normalization unit 202 quantizes the avej to obtain qavej, and normalizes it using, for example, formula (7).

$$n_dct(i) = dct(i)/\mathrm{gave}_j \quad bj\mathrm{low} \le i \le bj\mathrm{high} \tag{7}$$

To quantize the avej, scalar quantization may be employed, or vector quantization may be carried out using the code book. The band amplitude normalization unit 202 codes the indices of parameters used for expressing the qavej.

Although the normalization unit 104 in the coding apparatus 1 is constructed using both of the frequency outline normalization unit 201 and the band amplitude normalization unit 202 as shown in FIG. 2, it may be constructed using either of the frequency outline normalization unit 201 and the band amplitude normalization unit 202. Further, when there is no significant variation between the low-band component and the high-band component of the MDCT coefficients output from the MDCT unit 103, the output from the MDCT unit 103 may be directly input to the quantization unit 105 without using the units 201 and 202.

Figure 3:
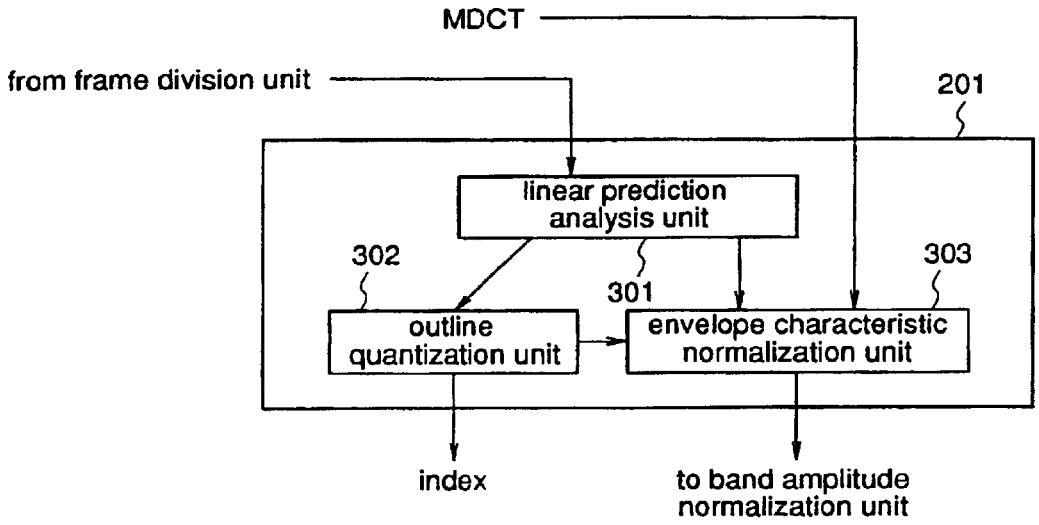
FIG. 3 is a block diagram illustrating an example of a frequency outline normalization unit as a constituent of the above-described audio signal coding apparatus.

The frequency outline normalization unit 201 shown in FIG. 2 will be described in detail using FIG. 3. In FIG. 3, reference numeral 301 denotes a linear predictive analysis unit that receives the output from the frame division unit 101 and performs linear predictive analysis; 302 denotes an outline quantization unit that quantizes the coefficient obtained in the linear predictive analysis unit 301; and 303 denotes an envelope characteristic normalization unit that normalizes the MDCT coefficients by spectral envelope.

A description is given of the operation of the frequency outline normalization unit 201. The linear predictive analysis unit 301 receives the audio signal on the time axis from the frame division unit 101, performs linear predictive coding (LPC), and calculates linear predictive coefficients (LPC coefficients). The linear predictive coefficients can generally be obtained by calculating an autocorrelation function of a window-multiplied signal., such as Humming window, and solving a normal equation or the like. The linear predictive coefficients so calculated are converted to linear spectral pair coefficients (LSP coefficients) or the like and quantized in the outline quantization unit 302. As a quantization method, vector quantization or scalar quantization may be employed. Then, frequency transfer characteristic (spectral envelope) expressed by the parameters quantized by the outline quantization unit 302 is calculated in the envelope characteristic normalization unit 303, and the MDCT coefficients output from the MDCT unit 103 are divided by the characteristic to be normalized. To be specific, when the linear predictive coefficients equivalent to the parameters quantized by the outline quantization unit 302 are qlpc(i), the frequency transfer characteristic calculated by the envelope characteristic normalization unit 303 is obtained by formula (8).

$$\begin{aligned} li &= \begin{cases} qlpc(i) & 0 \le i \le ORDER \\ 0 & ORDER + 1 \le i < N \end{cases} \\ env(i) &= 1 / fft(li) \end{aligned} \tag{8}$$

where ORDER is desired to be 10~40, and fft( ) means high-speed Fourier transform. Using the calculated frequency transfer characteristic env(i), the envelope characteristic normalization unit 303 performs normalization using, for example, formula (9) as follows.

$$\mathrm{fact}(i) = mdct(i)/env(i) \tag{9}$$

where mdct(i) is the output signal from the MDCT unit 103, and fdct(i) is the normalized output signal from the envelope characteristic normalization unit 303. Through the above-mentioned process steps, the process of normalizing the MDCT coefficient stream is completed.

Figure 4:
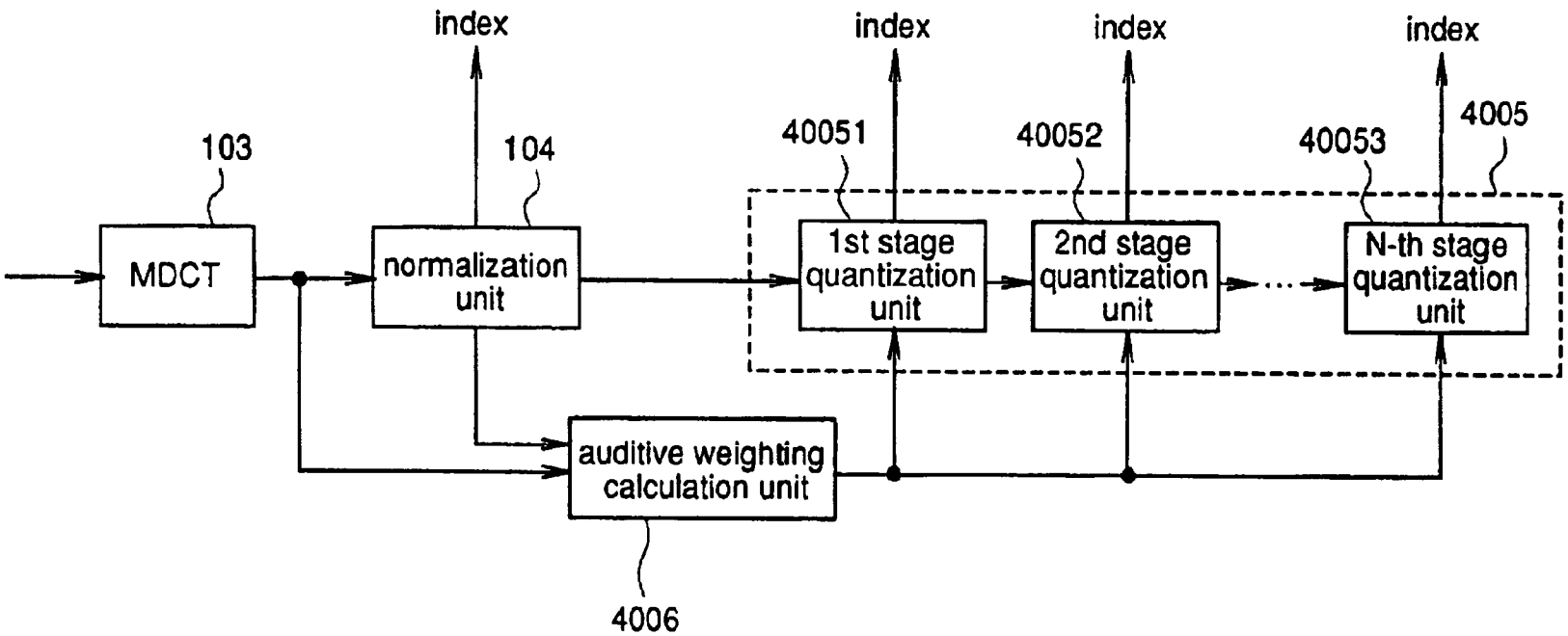
FIG. 4 is a diagram illustrating the detailed structure of a quantization unit in the coding apparatus.

Next, the quantization unit 105 in the coding apparatus 1 will be described in detail using FIG. 4. In FIG. 4, reference numeral 4005 denotes a multistage quantization unit that performs vector quantization to the frequency characteristic signal sequence (MDCT coefficient stream) leveled by the normalization unit 104. The multistage quantization unit 4005 includes a first stage quantizer 40051, a second stage quantizer 40052, . . . , an N-th stage quantizer 40053 which are connected in a column. Further, 4006 denotes an auditive weight calculating unit that receives the MDCT coefficients output from the MDCT unit 103 and the spectral envelope obtained in the envelope characteristic normalization unit 303, and provides a weighting coefficient used for quantization in the multistage quantization unit 4005, on the basis of the auditive sensitivity characteristic.

In the auditive weight calculating unit 4006, the MDCT coefficient stream output from the MDCT unit 103 and the LPC spectral envelope obtained in the envelope characteristic normalization unit 303 are input and, with respect to the spectrum of the frequency characteristic signal sequence output from the MDCT unit 103, on the basis of the auditive sensitivity characteristic which is the auditive nature of human beings, such as minimum audible limit characteristic and auditive masking characteristic, a characteristic signal in regard to the auditive sensitivity characteristic is calculated and, furthermore, a weighting coefficient used for quantization is obtained on the basis of the characteristic signal and the spectral envelope.

The normalized MDCT coefficients output from the normalization unit 104 are quantized in the first stage quantizer 40051 in the multistage quantization unit 4005 using the weighting coefficient obtained by the auditive weight calculating unit 4006, and a quantization error component due to the quantization in the first stage quantizer 40051 is quantized in the second stage quantizer 40052 in the multistage quantization unit 4005 using the weighting coefficient obtained by the auditive weight calculating unit 4006. Thereafter, in the same manner as mentioned above, in each stage of the multistage quantization unit, a quantization error component due to quantization in the previous-stage quantizer is quantized. Coding of the audio signal is completed when a quantization error component due to quantization in the (N−1)th stage quantizer has been quantized in the N-th stage quantizer 40053 using the weighting coefficient obtained by the auditive weight calculating unit 4006.

As described above, according to the audio signal coding apparatus of the first embodiment, vector quantization is carried out in the plural stages of vector quantizers 40051~40053 in the multistage quantization means 4005 using, as a weight for quantization, a weighting coefficient on the frequency, which is calculated in the auditive weight calculating unit 4006 on the basis of the spectrum of the input audio signal, the auditive sensitivity characteristic showing the auditive nature of human beings, and the LPC spectral envelope. Therefore, efficient quantization can be carried out utilizing the auditive nature of human beings.

In the audio signal coding apparatus shown in FIG. 4, the auditive weight calculating unit 4006 uses the LPC spectral envelope for calculation of the weighting coefficient. However, it may calculate the weighting coefficient using only the spectrum of input audio signal and the auditive sensitivity characteristic showing the auditive nature of human beings.

Further, in the audio signal coding apparatus shown in FIG. 4, all of the plural stages of vector quantizers in the multistage quantization means 4005 perform quantization using the weighting coefficient obtained in the auditive weight calculating unit 4006 on the basis of the auditive sensitivity characteristic. However, as long as any of the plural stages of vector quantizers in the multistage quantization means 4005 performs quantization using the weighting coefficient on the basis of the auditive sensitivity characteristic, efficient quantization can be carried out as compared with the case where such a weighting coefficient on the basis of the auditive sensitivity characteristic is not used.

Embodiment 2

Figure 5:
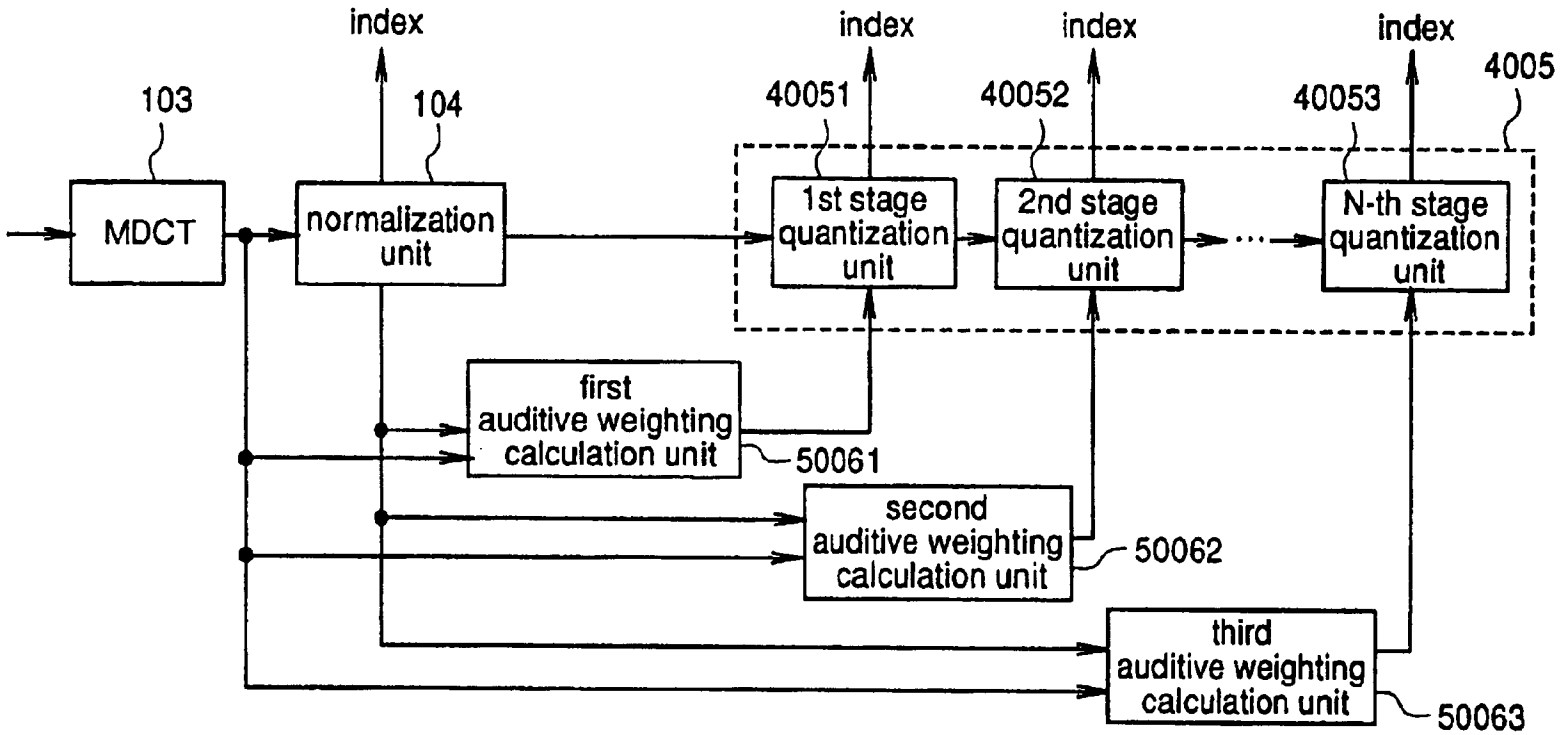
FIG. 5 is a block diagram illustrating the structure of an audio signal coding apparatus according to a second embodiment of the present invention.

FIG. 5 is a block diagram illustrating the structure of an audio signal coding apparatus according to a second embodiment of the invention. In this embodiment, only the structure of the quantization unit 105 in the coding apparatus 1 is different from that of the above-mentioned embodiment and, therefore, only the structure of the quantization unit will be described hereinafter. In FIG. 5, reference numeral 50061 denotes a first auditive weight calculating unit that provides a weighting coefficient to be used by the first stage quantizer 40051 in the multistage quantization means 4005, on the basis of the spectrum of the input audio signal, the auditive sensitivity characteristic showing the auditive nature of human beings, and the LPC spectral envelope; 50062 denotes a second auditive weight calculating unit that provides a weighting coefficient to be used by the second stage quantizer 40052 in the multistage quantization means 4005, on the basis of the spectrum of input audio signal, the auditive sensitivity characteristic showing the auditive nature of human beings, and the LPC spectral envelope; and 50063 denotes a third auditive weight calculating unit that provides a weighting coefficient to be used by the N-th stage quantizer 40053 in the multistage quantization means 4005, on the basis of the spectrum of input audio signal, the auditive sensitivity characteristic showing the auditive nature of human beings, and the LPC spectral envelope.

In the audio signal coding apparatus according to the first embodiment, all of the plural stages of vector quantizers in the multistage quantization means 4005 perform quantization using the same weighting coefficient obtained in the auditive weight calculating unit 4006. However, in the audio signal coding apparatus according to this second embodiment, the plural stages of vector quantizers in the multistage quantization means 4005 perform quantization using individual weighting coefficients obtained in the first to third auditive weight calculating units 50061, 50062, and 50063, respectively. In this audio signal coding apparatus according to the second embodiment, it is possible to perform quantization by weighting according to the frequency weighting characteristic obtained in the auditive weighting units 50061 to 50063 on the basis of the auditive nature so that an error due to quantization in each stage of the multistage quantization means 4005 is minimized. For example, a weighting coefficient is calculated on the basis of the spectral envelope in the first auditive weighting unit 50061, a weighting coefficient is calculated on the basis of the minimum audible limit characteristic in the second auditive weighting unit 50062, and a weighting coefficient is calculated on the basis of the auditive masking characteristic in the third auditive weighting unit 50063.

As described above, according to the audio signal coding apparatus of the second embodiment, since the plural-stages of quantizers 40051 to 40053 in the multistage quantization means 4005 perform quantization using the individual weighting coefficients obtained in the auditive weight calculating units 50061 to 50063, respectively, efficient quantization can be performed by effectively utilizing the auditive nature of human beings.

Embodiment 3

Figure 6:
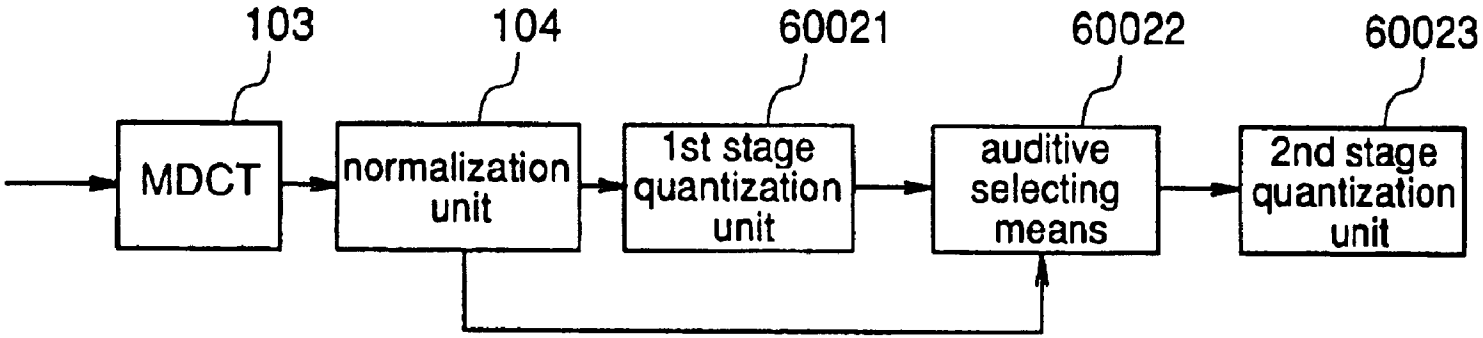
FIG. 6 is a block diagram illustrating the structure of an audio signal coding apparatus according to a third embodiment of the present invention.

FIG. 6 is a block diagram illustrating the structure of an audio signal coding apparatus according to a third embodiment of the invention. In this embodiment, only the structure of the quantization unit 105 in the coding apparatus 1 is different from that of the above-mentioned embodiment and, therefore, only the structure of the quantization unit will be described hereinafter. In FIG. 6, reference numeral 60021 denotes a first-stage quantization unit that vector-quantizes a normalized MDCT signal; 60023 denotes a second-stage quantization unit that quantizes a quantization error signal caused by the quantization in the first-stage quantization unit 60021; and 60022 denotes an auditive selection means that selects, from the quantization error caused by the quantization in the first-stage quantization unit 60021, a frequency band of highest importance to be quantized in the second-stage quantization unit 60023, on the basis of the auditive sensitivity characteristic.

A description is given of the operation. The normalized MDCT coefficients are subjected to vector quantization in the first-stage quantization unit 60021. In the auditive selection means 60022, a frequency band, in which an error signal due to the vector quantization is large, is decided on the basis of the auditive scale, and a block thereof is extracted. In the second-stage quantization unit 60023, the error signal of the selected block is subjected to vector quantization. The results obtained in the respective quantization units are output as indices.

Figure 7:
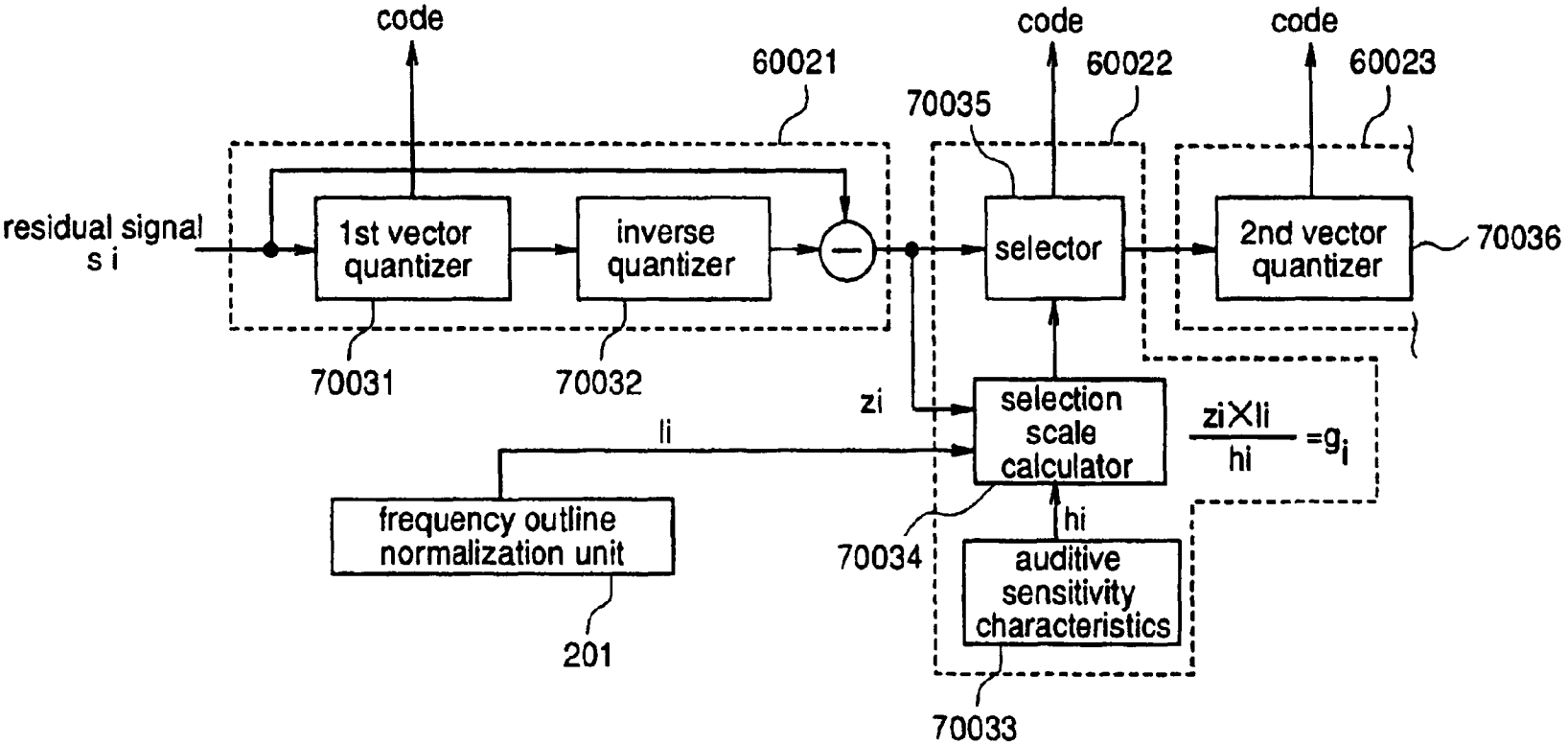
FIG. 7 is a block diagram illustrating the detailed structures of a quantization unit and an auditive selection unit in each stage of the audio signal coding apparatus shown in FIG. 6.

FIG. 7 is a block diagram illustrating, in detail, the first and second stage quantization units and the auditive selection unit, included in the audio signal coding apparatus shown in FIG. 6. In FIG. 7, reference numeral 7031 denotes a first vector quantizer that vector-quantizes the normalized MDCT coefficients; and 70032 denotes an inverse quantizer that inversely quantizes the quantization result of the first quantizer 70031, and a quantization error signal zi due to the quantization by the first quantizer 70031 is obtained by obtaining a difference between the output from the inverse quantizer 70032 and a residual signal si. Reference numeral 70033 denotes auditive sensitivity characteristic hi showing the auditive nature of human beings, and the minimum audible limit characteristic is used here. Reference numeral 70035 denotes a selector that selects a frequency band to be quantized by the second vector quantizer 70036, from the quantization error signal zi due to the quantization by the first quantizer 70031. Reference numeral 70034 denotes a selection scale calculating unit that calculates a selection scale for the selecting operation of the selector 70035, on the basis of the error signal zi, the LPC spectral envelope li, and the auditive sensitivity characteristic hi.

Next, the selecting operation of the auditive selection unit will be described in detail.

Figure 8:
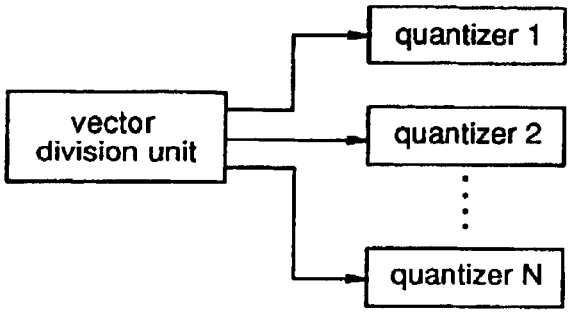
FIG. 8 is a diagram for explaining the quantizing operation of the vector quantizer.
Figure 8:
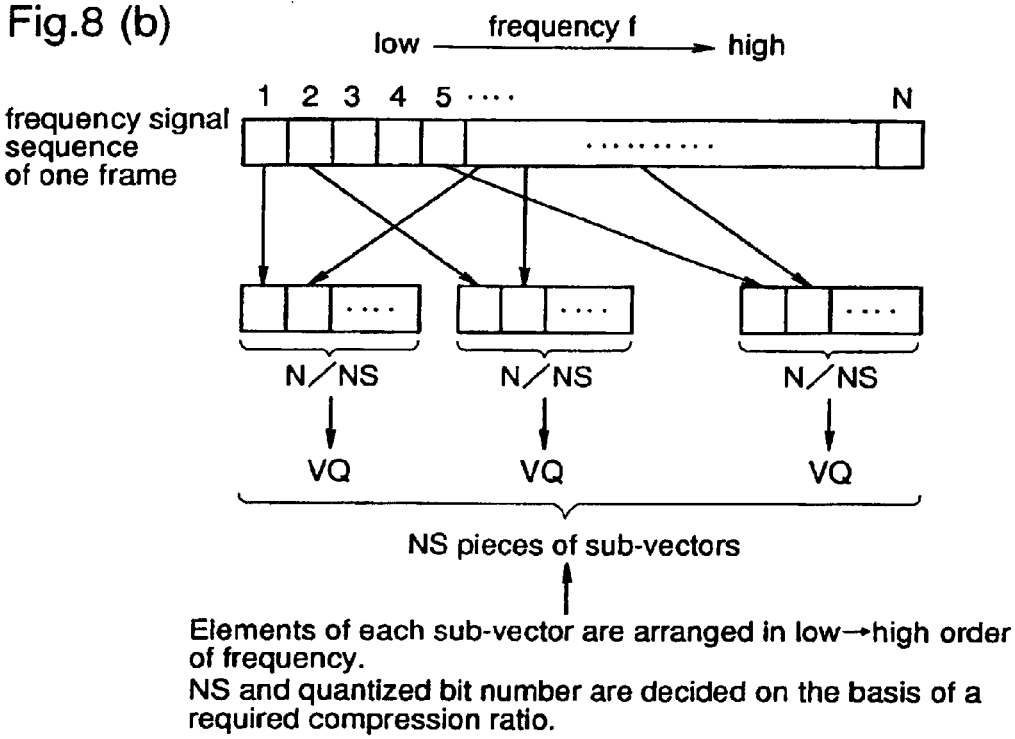

In the first vector quantizer 70031, first of all, a residual signal in one frame comprising N pieces of elements is divided into plural sub-vectors by a vector divider in the first vector quantizer 70031 shown in FIG. 8(*a*), and the respective sub-vectors are subjected to vector quantization by the N pieces of quantizers 1~N in the first vector quantizer 70031. The method of vector division and quantization is as follows. For example, as shown in FIG. 8(*b*), N pieces of elements being arranged in ascending order of frequency are divided into NS pieces of sub-blocks at equal intervals, and NS pieces of sub-vectors comprising N/NS pieces of elements, such as a sub-vector comprising only the first elements in the respective sub-blocks, a sub-vector comprising only the second elements thereof, . . . , are created, and vector quantization is carried out for each sub-vector. The division number and the like are decided on the basis of the requested coding rate.

Figure 9:
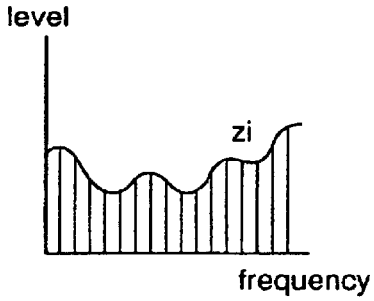
FIG. 9 is a diagram showing error signal zi, spectrum envelope I1, and minimum audible limit characteristic hi.
Figure 9:
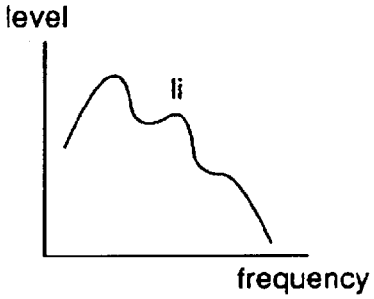
Figure 9:
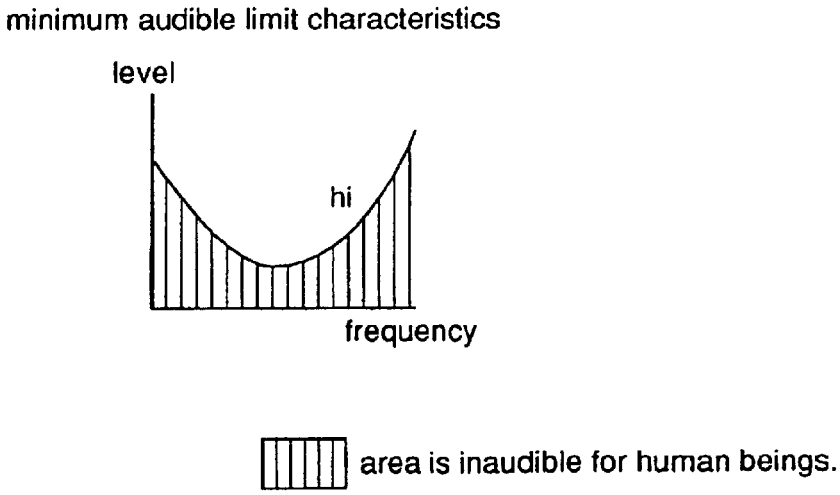

After the vector quantization, the quantized code is inversely quantized by the inverse quantizer 70032 to obtain a difference from the input signal, thereby providing an error signal zi in the first vector quantizer 70031 as shown in FIG. 9(*a*).

Next, in the selector 70035, from the error signal Zi, a frequency block to be quantized more precisely by the second quantizer 70036 is selected on the basis of the result selected by the selection scale calculating unit 70034.

In the selection scale calculating unit 70034, using the error signal Zi, the LPC spectral envelope li as shown in FIG. 9(*b*) obtained in the LPC analysis unit, and the auditive sensitivity characteristic hi, for each element in the frame divided into N elements on the frequency axis, $$g=(zi*hi)/hi$$

is calculated.

As the auditive sensitivity characteristic hi, for example, the minimum audible limit characteristic shown in FIG. 9(*c*) is used. This is a characteristic showing a region that cannot be heard by human beings, obtained experimentally. Therefore, it may be said that l/hi, which is the inverse number of the auditive sensitivity characteristic hi, shows the auditive importance of human beings. In addition, it may be said that the value g, which is obtained by multiplying the error signal zi, the spectral envelope li, and the inverse number of the auditive sensitivity characteristic hi, shows the importance of precise quantization at the frequency.

Figure 10:
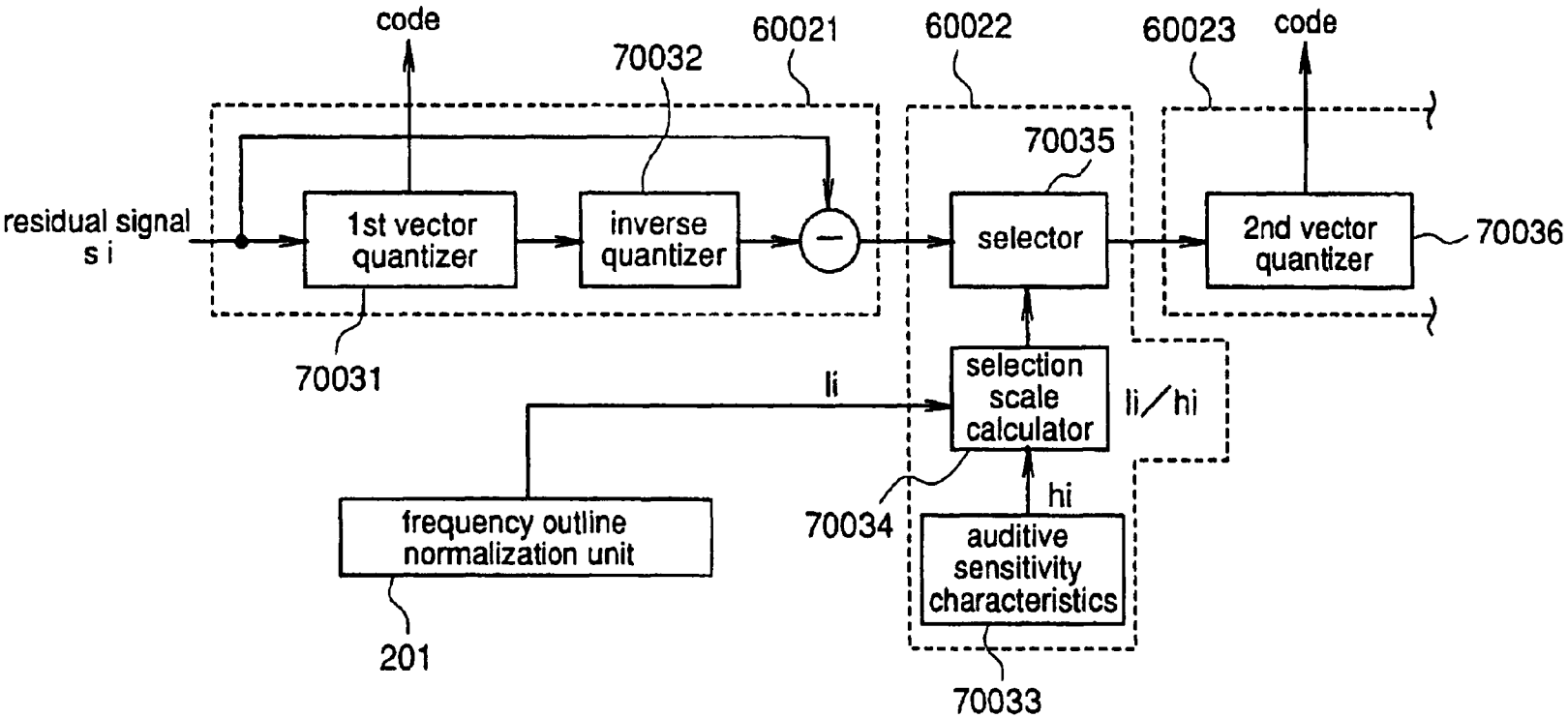
FIG. 10 is a block diagram illustrating the detailed structures of other examples of each quantization unit and an auditive selection unit included in the audio signal coding apparatus shown in FIG. 6.

FIG. 10 is a block diagram illustrating, in detail, other examples of the first and second stage quantization units and the auditive selection unit, included in the audio signal coding apparatus shown in FIG. 6. In FIG. 10, the same reference numerals as those in FIG. 7 designate the same or corresponding parts. In the example shown in FIG. 10, the selection scale (importance) g is obtained using the spectral envelope li and the auditive sensitivity characteristic hi, without using the error signal zi, by calculating, $$g=li/hi$$

Figure 11:
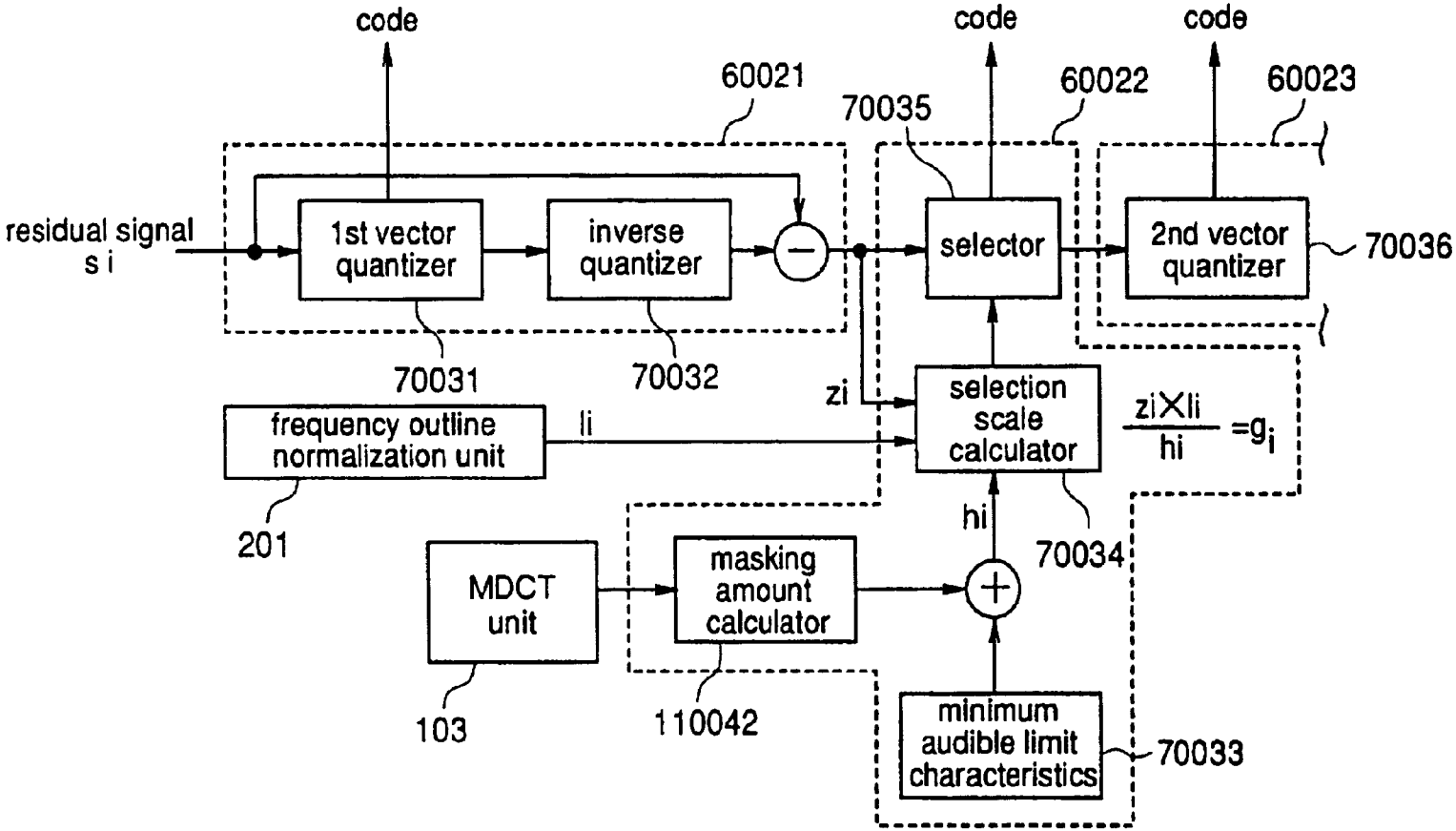
FIG. 11 is a block diagram illustrating the detailed structures of still other examples of each quantization unit and an auditive selection unit included in the audio signal coding apparatus shown in FIG. 6.

FIG. 11 is a block diagram illustrating, in detail, still other examples of the first and second stage quantization units and the auditive selection unit, included in the audio signal coding apparatus shown in FIG. 6. In FIG. 11, the same reference numerals as those shown in FIG. 7 designate the same or corresponding parts, and reference numeral 110042 denotes a masking amount calculating unit that calculates an amount to be masked by the auditive masking characteristic, from the spectrum of the input audio frequency which has been MDCT-transformed in the time-to-frequency transform unit.

In the example shown in FIG. 11, the auditive sensitivity characteristic hi is obtained frame by frame according to the following manner. That is, the masking characteristic is calculated from the frequency spectral distribution of the input signal, and the minimum audible limit characteristic is added to the masking characteristic, thereby to obtain the auditive sensitivity characteristic hi of the frame. The operation of the selection scale calculating unit 70034 is identical to that described with respect to FIG. 10.

Figure 12:
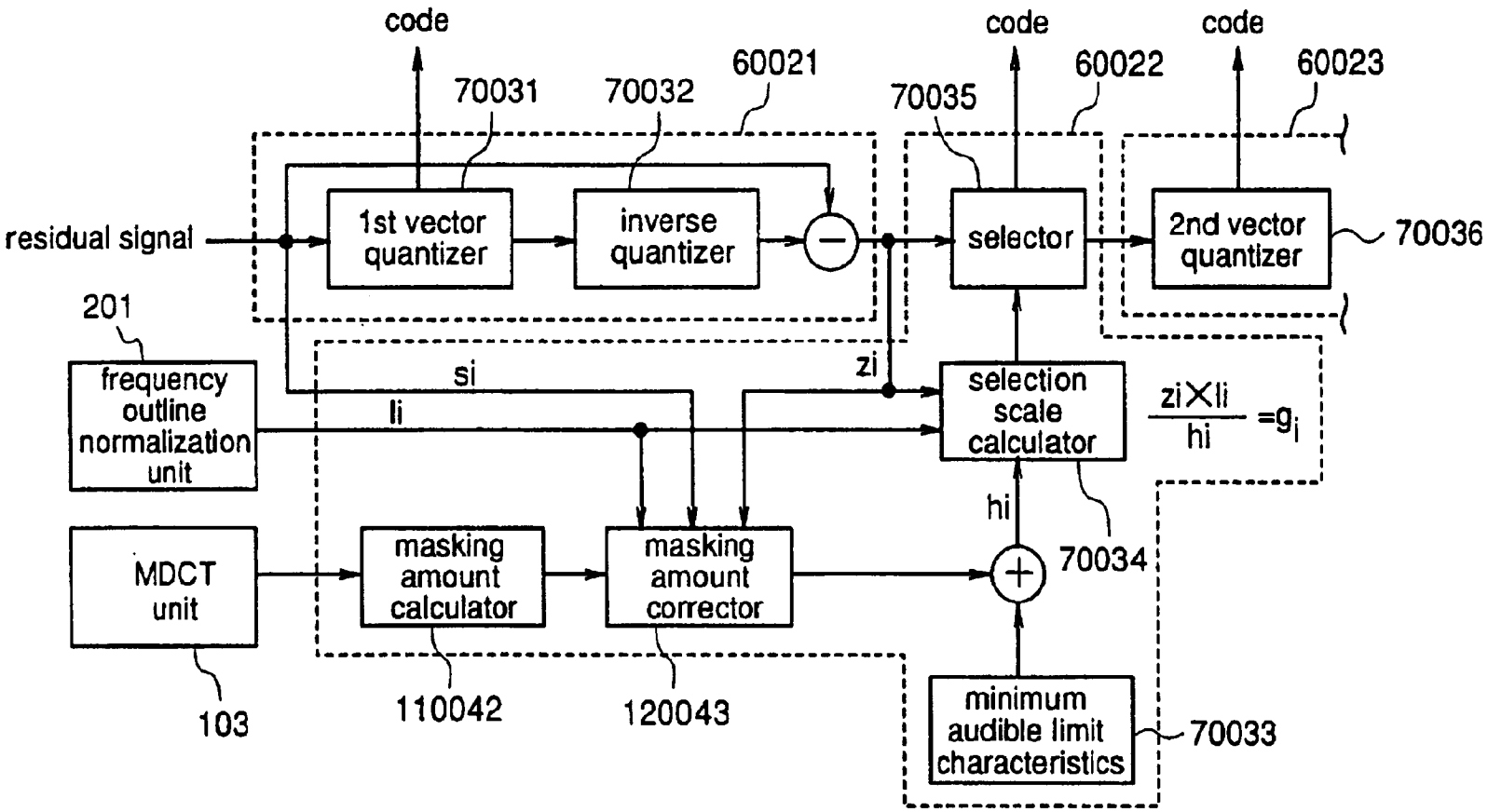
FIG. 12 is a block diagram illustrating the detailed structures of further examples of each quantization unit and an auditive selection unit included in the audio signal coding apparatus shown in FIG. 6.

FIG. 12 is a block diagram illustrating, in detail, still other examples of the first and second stage quantization units and the auditive selection unit, included in the audio signal coding apparatus shown in FIG. 6. In FIG. 12, the same reference numerals as those shown in FIG. 7 designate the same or corresponding parts, and reference numeral 120043 denotes a masking amount correction unit that corrects the masking characteristic obtained in the masking amount calculating unit 110042, using the spectral envelope li, the residual signal si, and the error signal zi.

In the example shown in figure 12, the auditive sensitivity characteristic hi is obtained frame by frame in the following manner. Initially, the masking characteristic is calculated from the frequency spectral distribution of the input signal in the masking amount calculating unit 110042. Next, in the masking amount correction unit 120043, the calculated masking characteristic is corrected according to the spectral, envelope li, the residual signal si, and the error signal zi. The audio sensitivity characteristic hi of the frame is obtained by adding the minimum audible limit characteristic to the corrected masking characteristic. An example of a method of correcting the masking characteristic will be described hereinafter.

Initially, a frequency (fm) at which the characteristic of masking amount Mi, which has already been calculated, attains the maximum value is obtained. Next, how precisely the signal having the frequency fm is reproduced is obtained from the spectral intensity of the frequency fm at the input and the size of the quantization error spectrum. For example, $$\gamma=1-(\text{gain of quantization error of } fm)/(\text{gain of } fm \text{ at input})$$

When the value of γ is close to 1, it is not necessary to transform the masking characteristic already obtained. However, when it is close to 0, the masking characteristic is corrected so as to be decreased. For example, the masking characteristic can be corrected by transforming it by raising it to a higher power with the coefficient γ, as follows.

$$hi=Mi^{\gamma} \tag{31}$$

Next, a description is given of the operation of the selector 70035.

Figure 13:
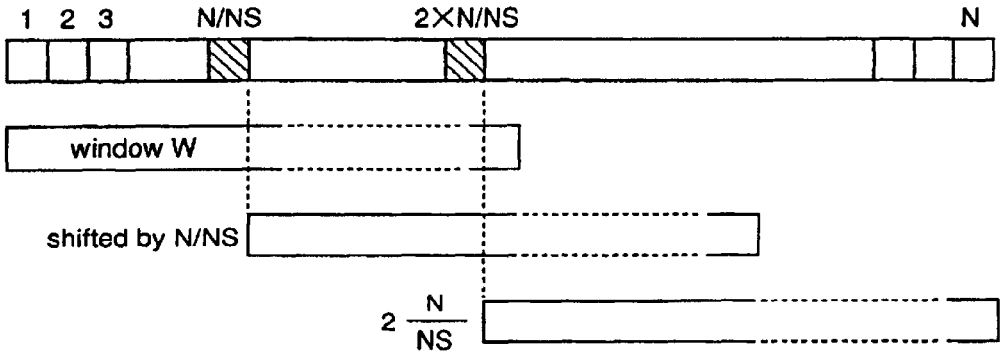
FIG. 13 is a diagram illustrating an example of selection of a frequency block having the highest importance (length W).

In the selector 70035, each of continuous elements in a frame is multiplied by a window (length W), and a frequency block in which a value G obtained by accumulating the values of importance g within the window attains the maximum is selected. FIG. 13 is a diagram showing an example where a frequency block (length W) of highest importance is selected. For simplification, the length of the window should be set at integer multiples of N/NS (FIG. 13 shows one which is not an integer multiple.) While shifting the window by N/NS pieces, the accumulated value G of the importance g within the window frame is calculated, and a frequency block having a length W that gives the maximum value of G is selected.

In the second vector quantizer 70032, the selected block in the window frame is subjected to vector quantization. Although the operation of the second vector quantizer 70032 is identical to that of the first vector quantizer 70031, since only the frequency block selected by the selector 70035 from the error signal zi is quantized as described above, the number of elements in the frame to be vector-quantized is small.

Finally, in the case of using the code of the spectral envelope coefficient, the codes corresponding to the quantization results of the respective vector quantizers, and the selection scale g obtained in any of the structures shown in FIGS. 7, 11 and 12, information showing from which element does the block selected by the selector 70035 start, is output as an index.

On the other hand, in the case of using the selection scale g obtained in the structure shown in FIG. 10, since only the spectral envelope li and the auditive sensitivity characteristic hi are used, the information, i.e., from which element does the selected block start, can be obtained from the code of the spectral envelope coefficient and the previously known auditive sensitivity characteristic hi when inverse quantization is carried out. Therefore, it is not necessary to output the information relating to the block selection as an index, resulting in an advantage with respect of compressibility.

As described above, according to the audio signal coding apparatus of the third embodiment, on the basis of the spectrum of the input audio signal and the auditive sensitivity characteristic showing the auditive nature of human beings, a frequency block of highest importance for quantization is selected from the frequency blocks of quantization error component in the first vector quantizer, and the quantization error component of the first quantizer is quantized with respect to the selected block in the second vector quantizer, whereby efficient quantization can be performed utilizing the auditive nature of human beings. Further, in the structures shown in FIGS. 7, 11 and 12, when the frequency block of highest importance for quantization is selected, the importance is calculated on the basis of the quantization error in the first vector quantizer. Therefore, it is avoided that a portion favorably quantized in the first vector quantizer is quantized again and an error is generated inversely, whereby quantization maintaining high quality is performed.

Further, when the importance g is obtained in the structure shown in FIG. 10, as compared with the case of obtaining the importance g in the structure shown in any of FIGS. 7, 11 and 12, the number of indices to be output is decreased, resulting in increased compression ratio.

In this third embodiment, the quantization unit has the two-stage structure comprising the first-stage quantization unit 60021 and the second-stage quantization unit 60023, and the auditive selection means 60022 is disposed between the first-stage quantization unit 60021 and the second-stage quantization unit 60023. However, the quantization unit may have a multiple-stage structure of three or more stages and the auditive selection means may be disposed between the respective quantization units. Also in this structure, as in the third embodiment mentioned above, efficient quantization can be performed utilizing the auditive nature of human beings.

Embodiment 4

Figure 14:
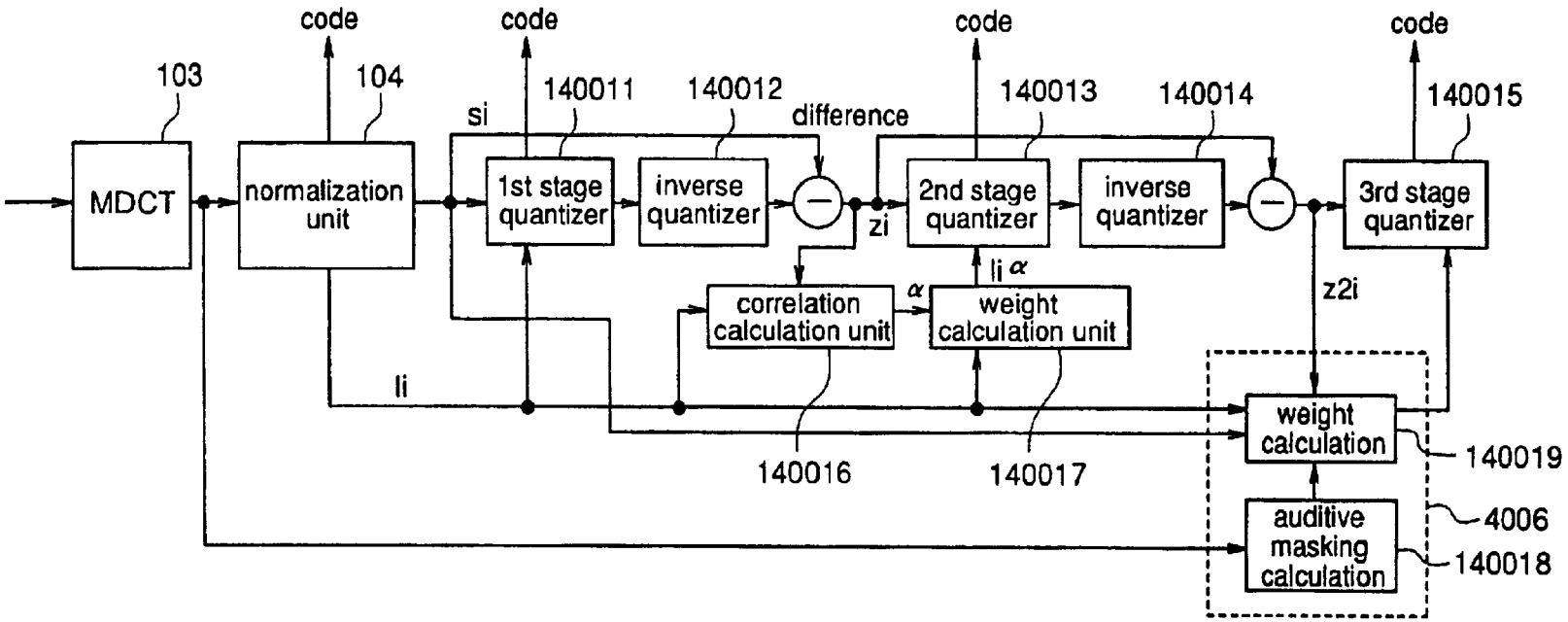
FIG. 14 is a block diagram illustrating the structure of an audio signal coding apparatus according to a fourth embodiment of the present invention.

FIG. 14 is a block diagram illustrating a structure of an audio signal coding apparatus according to a fourth embodiment of the present invention. In this embodiment, only the structure of the quantization unit 105 in the coding apparatus 1 is different from that of the above-mentioned embodiment and, therefore, only the structure of the quantization unit will be described hereinafter. In the figure, reference numeral 140011 denotes a first-stage quantizer that vector-quantizes the MDCT signal si output from the normalization unit 104, using the spectral envelope value li as a weight coefficient. Reference numeral 140012 denotes an inverse quantizer that inversely quantizes the quantization result of the first-stage quantizer 140011, and a quantization error signal zi of the quantization by the first-stage quantizer 140011 is obtained by taking a difference between the output of this inverse quantizer 140012 and a residual signal output from the normalization unit 104. Reference numeral 140013 denotes a second-stage quantizer that vector-quantizes the quantization error signal zi of the quantization by the first-stage quantizer 140011 using, as a weight coefficient, the calculation result obtained in a weight calculating unit 140017 described later. Reference numeral 140014 denotes an inverse quantizer that inversely quantizes the quantization result of the second-stage quantizer 140013, and a quantization error signal z2i of the quantization by the second-stage quantizer 140013 is obtained by taking a difference between the output of this inverse quantizer 140014 and the quantization error signal of the quantization by the first-stage quantizer 140011. Reference numeral 140015 denotes a third-stage quantizer that vector-quantizes the quantization error signal z2i of the quantization by the second-stage quantizer 140013 using, as a weight coefficient, the calculation result obtained in the auditive weight calculating unit 4006. Reference numeral 140016 denotes a correlation calculating unit that calculates a correlation between the quantization error signal zi of the quantization by the first-stage quantizer 140011 and the spectral envelope value li. Reference numeral 140017 denotes a weight calculating unit that calculates the weighting coefficient used in the quantization by the second-stage quantizer 140013.

A description is given of the operation. In the audio signal coding apparatus according to this fourth embodiment, three stages of quantizers are employed, and vector quantization is carried out using different weights in the respective quantizers.

Initially, in the first-stage quantizer 140013, the input residual signal si is subjected to vector quantization using, as a weight coefficient, the LPC spectral envelope value li obtained in the outline quantization unit 302. Thereby, a portion in which the spectral energy is large (concentrated) is subjected to weighting, resulting in an effect that an auditively important portion is quantized with higher efficiency. As the first-stage vector quantizer 140013, for example, a quantizer identical to the first vector quantizer 70031 according to the third embodiment may be used.

The quantization result is inversely quantized in the inverse quantizer 140012 and, from a difference between this and the input residual signal si, an error signal zi due to the quantization is obtained.

This error signal zi is further vector-quantized by the second-stage quantizer 140013. Here, on the basis of the correlation between the LPC spectral envelope li and the error signal zi, a weight coefficient is calculated by the correlation calculating unit 140016 and the weight calculating unit 140017.

To be specific, in the correlation calculating unit 140016, $$\alpha=(\Sigma li*zi)/(\Sigma li*li)$$

is calculated. This $\alpha$ takes a value in $0<\alpha<1$ and shows the correlation between them. When $\alpha$ is close to 0, it shows that the first-stage quantization has been carried out precisely on the basis of the weighting of the spectral envelope. When a is close to 1, it shows that quantization has not been precisely carried out yet. So, using this $\alpha$, as a coefficient for adjusting the weighting degree of the spectral envelope li, $$li^{\alpha} \tag{32}$$

is obtained, and this is used as a weighting coefficient for vector quantization. The quantization precision is improved by performing weighting again using the spectral envelope according to the precision of the first-stage quantization and then performing quantization as mentioned above.

The quantization result by the second-stage quantizer 140013 is inversely quantized in the inverse quantizer 140014 in similar manner, and an error signal z2i is extracted, and this error signal z2i is vector-quantized by the third-stage quantizer 140015. The auditive weight coefficient at this time is calculated by the weight calculator 140019 in the auditive weighting calculating unit 4006. For example, using the error signal z2i, the LPC spectral envelope li, and the residual signal si, $$N=\Sigma z2i*li$$

$$S=\Sigma si*li$$

$$\beta=1-(N/S)$$

are obtained.

On the other hand, in the auditive masking calculator 140018 in the auditive weighting calculating unit 4006, the auditive masking characteristic mi is calculated according to, for example, an auditive model used in an MPEG audio standard method. This is overlapped with the above-described minimum audible limit characteristic hi to obtain the final masking characteristic Mi.

Then, the final masking characteristic Mi is raised to a higher power using the coefficient $\beta$ calculated in the weight calculating unit 140019, and the inverse number of this value is multiplied by 1 to obtain $$1/Mi^{\beta} \tag{33}$$

and this is used as a weight coefficient for the third-stage vector quantization.

As described above, in the audio signal coding apparatus according to this fourth embodiment, the plural quantizers 140011, 140013, and 140015 perform quantization using different weighting coefficients, including weighting in view of the auditive sensitivity characteristic, whereby efficient quantization can be performed by effectively utilizing the auditive nature of human beings.

Embodiment 5

Figure 15:
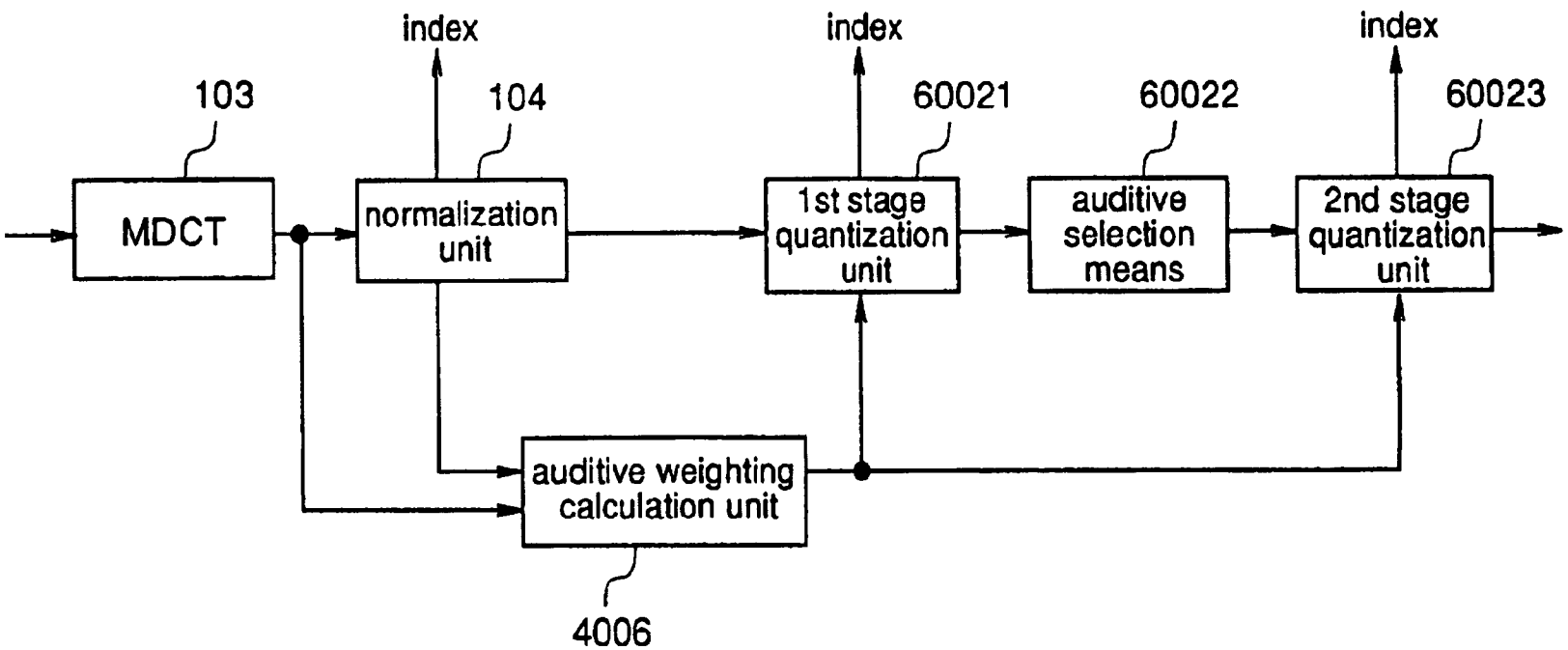
FIG. 15 is a block diagram illustrating the structure of an audio signal coding apparatus according to a fifth embodiment of the present invention.

FIG. 15 is a block diagram illustrating the structure of an audio signal coding apparatus according to a fifth embodiment of the present invention.

The audio signal coding apparatus according to this fifth embodiment is a combination of the third embodiment shown in FIG. 6 and the first embodiment shown in FIG. 4 and, in the audio signal coding apparatus according to the third embodiment shown in FIG. 6, a weighting coefficient, which is obtained by using the auditive sensitivity characteristic in the auditive weighting calculating unit 4006, is used when quantization is carried out in each quantization unit. Since the audio signal coding apparatus according to this fifth embodiment is so constructed, both of the effects provided by the first embodiment and the third embodiment are obtained.

Further, likewise, the third embodiment shown in FIG. 6 may be combined with the structure according to the second embodiment or the fourth embodiment, and an audio signal coding apparatus obtained by each combination can provide both of the effects provided by the second embodiment and the third embodiment or both of the effects provided by the fourth embodiment and the third embodiment.

While in the aforementioned first to fifth embodiments the multistage quantization unit has two or three stages of quantization units, it is needless to say that the number of stages of the quantization unit may be four or more.

Furthermore, the order of the weight coefficients used for vector quantization in the respective stages of the multistage quantization unit is not restricted to that described for the aforementioned embodiments. For example, the weighting coefficient in view of the auditive sensitivity characteristic may be used in the first stage, and the LPC spectral envelope may be used in and after the second stage.

Embodiment 6

Figure 16:
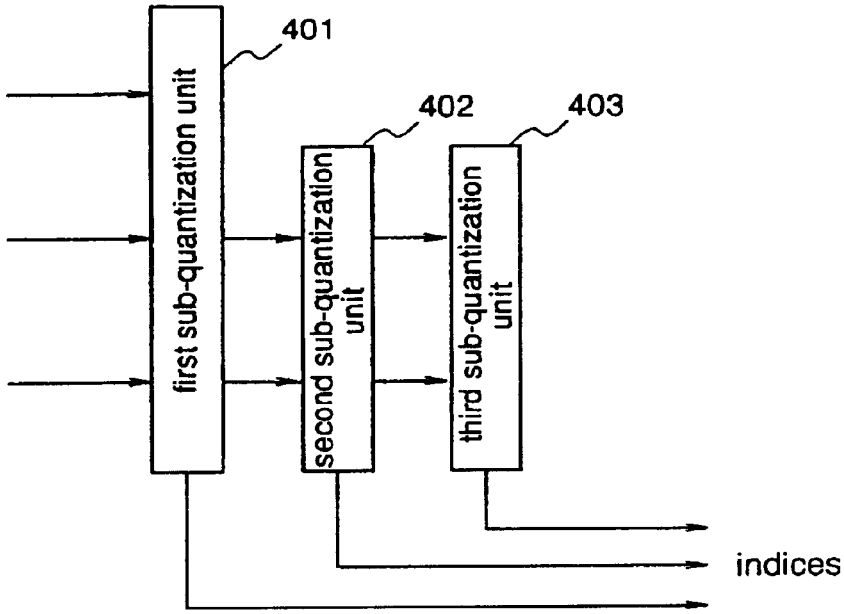
FIG. 16 is a block diagram illustrating the structure of an audio signal coding apparatus according to a sixth embodiment of the present invention.

FIG. 16 is a block diagram illustrating an audio signal coding apparatus according to a sixth embodiment of the present invention. In this embodiment, since only the structure of the quantization unit 105 in the coding apparatus 1 is different from that of the above-mentioned embodiment, only the structure of the quantization unit will be described hereinafter.

In FIG. 16, reference numeral 401 denotes a first sub-quantization unit 401, 402 denotes a second sub-quantization unit that receives an output from the first sub-quantization unit 401, and 403 denotes a third sub-quantization unit that receives the output from the second sub-quantization unit 402.

Next, a description is given of the operation of the quantization unit 105. A signal input to the first sub-quantization unit 401 is the output from the normalization unit 104 of the coding apparatus, i.e., normalized MDCT coefficients. However, in the structure having no normalization unit 104, it is the output from the MDCT unit 103. In the first sub-quantization unit 401, the input MDCT coefficients are subjected to scalar quantization or vector quantization, and indices expressing the parameters used for the quantization are encoded. Further, quantization errors with respect to the input MDCT coefficients due to the quantization are calculated, and they are output to the second sub-quantization unit 402. In the first sub-quantization unit 401, all of the MDCT coefficients may be quantized, or only a portion of them may be quantized. Of course, when only a portion thereof is quantized, quantization errors in the bands which are not quantized by the first sub-quantization unit 401 will become input MDCT coefficients of the not-quantized bands.

Next, the second sub-quantization unit 402 receives the quantization errors of the MDCT coefficients obtained in the first sub-quantization unit 401 and quantizes them. For this quantization, like the first sub-quantization unit 401, scalar quantization or vector quantization may be used. The second sub-quantization unit 402 codes the parameters used for the quantization as indices. Further, it calculates quantization errors due to the quantization, and outputs them to the third sub-quantization unit 403. This third sub-quantization unit 403 is identical in structure to the second sub-quantization unit.

The numbers of MDCT coefficients, i.e., band widths, to be quantized by the first sub-quantization unit 401, the second sub-quantization unit 402, and the third sub-quantization unit 403 are not necessarily equal to each other, and the bands to be quantized are not necessarily the same. Considering the auditive characteristic of human beings, it is desired that both of the second sub-quantization unit 402 and the third sub-quantization unit 403 are set so as to quantize the band of the MDCT coefficients showing the low-frequency component.

As described above, according to the sixth embodiment of the invention, when quantization is performed, the quantization unit is provided in stages, and the band width to be quantized by the quantization unit is varied between the adjacent stages, whereby coefficients in an arbitrary band among the input MDCT coefficients, for example, coefficients corresponding to the low-frequency component which is auditively important for human beings, are quantized. Therefore, even when an audio signal is coded at a low bit rate, i.e., a high compression ratio, it is possible to perform high-definition audio reproduction at the receiving end.

Embodiment 7

Figure 17:
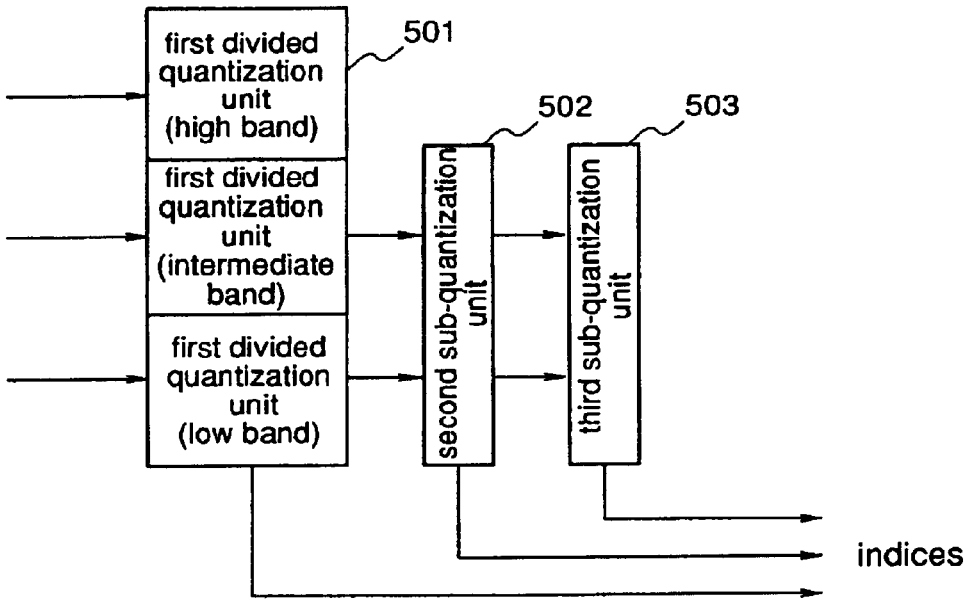
FIG. 17 is a block diagram illustrating the structure of an audio signal coding apparatus according to a seventh embodiment of the present invention.

Next, an audio signal coding apparatus according to a seventh embodiment of the invention will be described using FIG. 17. In this embodiment, since only the structure of the quantization unit 105 in the coding apparatus 1 is different from that of the above-mentioned embodiment, only the structure of the quantization unit will be explained. In FIG. 17, reference numeral 501 denotes a first sub-quantization unit (vector quantizer), 502 denotes a second sub-quantization unit, and 503 denotes a third sub-quantization unit. This seventh embodiment is different in structure from the sixth embodiment in that the first quantization unit 501 divides the input MDCT coefficients into three bands and quantizes the respective bands independently. Generally, when quantization is carried out using a method of vector quantization, vectors are constituted by extracting some elements from input MDCT coefficients, whereby vector quantization is performed. In the first sub-quantization unit 501 according to this seventh embodiment, when creating vectors by extracting some elements from the input MDCT coefficients, quantization of the low band is performed using only the elements in the low band, quantization of the intermediate band is performed using only the elements in the intermediate band, and quantization of the high band is performed using only the elements in the high band, whereby the respective bands are subjected to vector quantization. The first sub-quantization unit 501 is seemed to be composed of three-divided vector quantizers.

Although in this seventh embodiment, a method of dividing the band to be quantized into three bands, i.e., low band, intermediate band, and high band, is described as an example, the number of divided bands may be other than three. Further, with respect to the second sub-quantization unit 502 and the third sub-quantization unit 503, as well as the first quantization unit 501, the band to be quantized may be divided into several bands.

As described above, according to the seventh embodiment of the invention, when quantization is carried out, the input MDCT coefficients are divided into three bands and quantized independently, so that the process of quantizing the auditively important band with priority can be performed in the first-time quantization. Further, in the subsequent quantization units 502 and 503, the MDCT coefficients in this band are subjected to further quantization by stages, whereby the quantization error is reduced furthermore, and higher-definition audio reproduction is realized at the receiving end.

Embodiment 8

Figure 18:
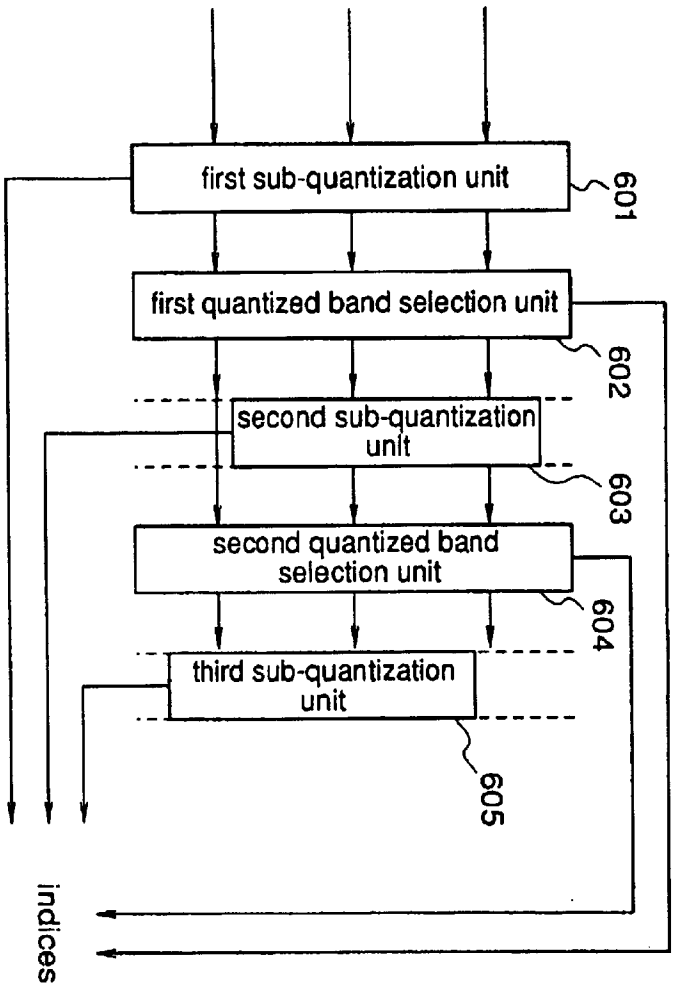
FIG. 18 is a block diagram illustrating the structure of an audio signal coding apparatus according to an eighth embodiment of the present invention.

An audio signal coding apparatus according to an eighth embodiment of the invention will be described using FIG. 18. In this eighth embodiment, since only the structure of the quantization unit 105 in the coding apparatus 1 is different from that of the above-mentioned first embodiment, only the structure of the quantization unit will be explained. In FIG. 18, reference numeral 601 denotes a first sub-quantization unit, 602 denotes a first quantization band selection unit, 603 denotes a second sub-quantization unit, 604 denotes a second quantization band selection unit, and 605 denotes a third sub-quantization unit. This eighth embodiment is different in structure from the sixth and seventh embodiments in that the first quantization band selection unit 602 and the second quantization band selection unit 604 are added.

Hereinafter, the operation will be described. The first quantization band selection unit 602 calculates a band, of which MDCT coefficients are to be quantized by the second sub-quantization unit 602, using the quantization error output from the first sub-quantization unit 601.

For example, j which maximizes esum(j) given in formula (10) is calculated, and a band ranging from $$esum(j) = \sum_{i=j\cdot OFFSET}^{j\cdot OFFSET+BANDWIDTH} fdct_{err}(i)^2 \tag{10}$$

where OFFSET is the constant, and BANDWIDTH is the total sample corresponding to a band width to be quantized by the second sub-quantization unit 603. The first quantization band selection unit 602 codes, for example, the j which gives the maximum value in formula (10), as an index. The second sub-quantization unit 603 quantizes the band selected by the first quantization band selection unit 602. The second quantization band selection unit 604 is implemented by the same structure as the first selection unit except that its input is the quantization error output from the second sub-quantization unit 603, and the band selected by the second quantization band selection unit 604 is input to the third sub-quantization unit 605.

Although in the first quantization band selection unit 602 and the second quantization band selection unit 604, a band to be quantized by the next quantization unit is selected using formula (10), it may be calculated using a value obtained by multiplying a value used for normalization by the normalization unit 104 and a value in view of the auditive sensitivity characteristic of human beings relative to frequencies, as shown in formula (11).

$$esum(j) = \sum_{i=j\cdot OFFSET}^{j\cdot OFFSET+BANDWIDTH} \{fdct_{err}(i)\cdot env(i)\cdot zxc(i)\}^2 \tag{11}$$

where env(i) is obtained by dividing the output from the MDCT unit 103 with the output from the normalization unit 104, and zxc(i) is the table in view of the auditive sensitivity characteristic of human beings relative to frequencies, and an example thereof is shown in Graph 2. In formula (11), zxc(i) may be always 1 so that it is not considered.

Further, it is not necessary to provide plural stages of quantization band selection units, i.e., only the first quantization band selection unit 602 or the second quantization band selection unit 604 may be used.

As described above, according to the eighth embodiment, when quantization is performed in plural stages, a quantization band selection unit is disposed between adjacent stages of quantization units to make the band to be quantized variable. Thereby, the band to be quantized can be varied according to the input signal, and the degree of freedom in the quantization is increased.

Figure 19:
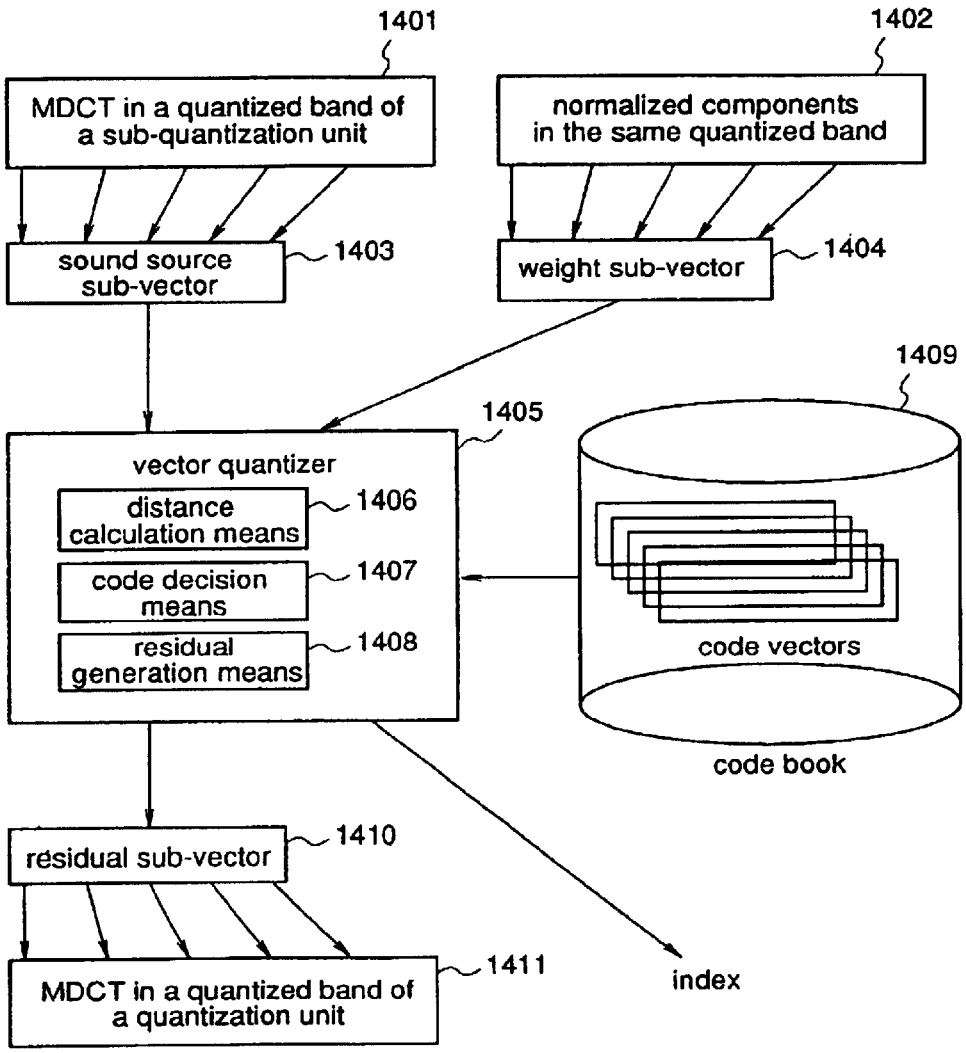
FIG. 19 is a diagram for explaining the detailed operation of quantization in each quantization unit included in the coding apparatus according to any of the first to eighth embodiments.

Hereinafter, a description is given of the detailed operation by a quantization method of the quantization unit included in the coding apparatus 1 according to any of the first to eighth embodiments, using FIG. 1 and FIG. 19. From the normalized MDCT coefficients 1401 input to each sub-quantization unit, some of them are extracted according to a rule to constitute sound source sub-vectors 1403. Likewise, assuming that the coefficient streams, which are obtained by dividing the MDCT coefficients to be input to the normalization unit 104 with the MDCT coefficients 1401 normalized by the normalization unit 104, are normalized components 1402, some of these components are extracted according to the same rule as that for extracting the sound source sub-vectors from the MDCT coefficients 1401, thereby to constitute weight sub-vectors 1404. The rule for extracting the sound source sub-vectors 1403 and the weight sub-vectors 1404 from the MDCT coefficients 1401 and the normalized components 1402, respectively, is shown in, for example, formula (14).

$$subvector_i(j) = \begin{cases} vector\left(\frac{VTOTAL}{CR}\cdot i + j\right) & \frac{VTOTAL}{CR}\cdot i + j < TOTAL \\ 0 & \frac{VTOTAL}{CR}\cdot i + j \geq TOTAL \end{cases} \tag{14}$$

where the j-th element of the i-th sound source sub-vector is $subvector_i(j)$, the MDCT coefficients are vector( ), the total element number of the MDCT coefficients 1401 is TOTAL, the element number of the sound source sub-vectors 1403 is CR, and VTOTAL is set to a value equal to or larger than TOTAL and VTOTAL/CR should be an integer. For example, when TOTAL is 2048, CR=19 and VTOTAL=2052, or CR=23 and VTOTAL=2070, or CR=21 and VTOTAL=2079. The weight sub-vectors 1404 can be extracted by the procedure of formula (14). The vector quantizer 1405 selects, from the code vectors in the code book 1409, a code vector having a minimum distance between it and the sound source sub-vector 1403, after being weighted by the weight sub-vector 1404. Then, the quantizer 1405 outputs the index of the code vector having the minimum distance, and a residual sub-vector 1404 which corresponds to the quantization error between the code vector having the minimum distance and the input sound source sub-vector 1403. An example of actual calculation procedure will be described on the premise that the vector quantizer 1405 is composed of three constituents: a distance calculating means 1406, a code decision means 1407, and a residual generating means 1408. The distance calculating means 1406 calculates the distance between the i-th sound source sub-vector 1403 and the k-th code vector in the code book 1409 using, for example, formula (15).

$$dik = \sum_{j=0}^{CR-1} w_j^R (subvector_i(j) - C_k(j))^S \tag{15}$$

where wj is the j-th element of the weight sub-vector, ck(j) is the j-th element of the k-th code vector, R and S are norms for distance calculation, and the values of R and S are desired to be 1, 1.5, 2. These norms R and S may have different values. Further, dik is the distance of the k-th code vector from the i-th sound source sub-vector. The code decision means 1407 selects a code vector having a minimum distance among the distances calculated by formula (15) or the like, and codes the index thereof. For example, when diu is the minimum value, the index to be coded for the i-th sub-vector is u. The residual generating means 1408 generates residual sub-vectors 1410 using the code vectors selected by the code decision means 1407, according to formula (16).

$$res_i(j) = subvector_i(j) - C_u(j) \tag{16}$$

wherein the j-th element of the i-th residual sub-vector 1410 is resi(j), and the j-th element of the code vector selected by the code decision means 1407 is cu(j). The residual sub-vectors 1410 are retained as MDCT coefficients to be quantized by the subsequent sub-quantization units, by executing the inverse process of formula (14) or the like. However, when a band being quantized does not influence on the subsequent sub-quantization units, i.e., when the subsequent sub-quantization units are not required to perform quantization, the residual generating means 1408, the residual sub-vectors 1410, and the generation of the MDCT 1411 are not necessary. Although the number of code vectors possessed by the code book 1409 is not specified, when the memory capacity, calculating time and the like are considered, the number is desired to be about 64.

As another embodiment of the vector quantizer 1405, the following structure is available. That is, the distance calculating means 1406 calculates the distance using formula (17).

$$dik = \begin{cases} \sum_{j=0}^{CR-1} w_j^R (subvector_i(j) - C_k(j))^S & k < K \\ \sum_{j=0}^{CR-1} w_j^R (subvector_i(j) - C_{K-k}(j))^S & k \geq K \end{cases} \quad (17)$$

wherein K is the total number of code vectors used for the code retrieval of the code book 1409.

The code decision means 1407 selects k that gives a minimum value of the distance dik calculated in formula (17), and codes the index thereof. Here, k is a value in a range from 0 to 2K−1. The residual generating means 1408 generates the residual sub-vectors 1410 using formula (18).

$$resi(j) = \begin{cases} subvector_i(j) - C_u(j) & 0 \leq k < K \\ subvector_i(j) + C_u(j) & K \leq k < 2K \end{cases} \quad (18)$$

Although the number of code vectors possessed by the code book 1409 is not restricted, when the memory capacity, calculation time and the like are considered, it is desired to be about 64.

Further, although the weight sub-vectors 1404 are generated from the normalized components 1402, it is possible to generate weight sub-vectors by multiplying the weight sub-vectors 1404 by a weight in view of the auditive characteristic of human beings.

Embodiment 9

Next, an audio signal decoding apparatus according to a ninth embodiment of the present invention will be described using FIGS. 20 to 24. The indices output from the coding apparatus 1 are divided broadly into the indices output from the normalization unit 104 and the indices output from the quantization unit 105. The indices output from the normalization unit 104 are decoded by the inverse normalization unit 107, and the indices output from the quantization unit 105 are decoded by the inverse quantization unit 106. The inverse quantization unit 106 can perform decoding using only a portion of the indices output from the quantization unit 105.

Figure 20:
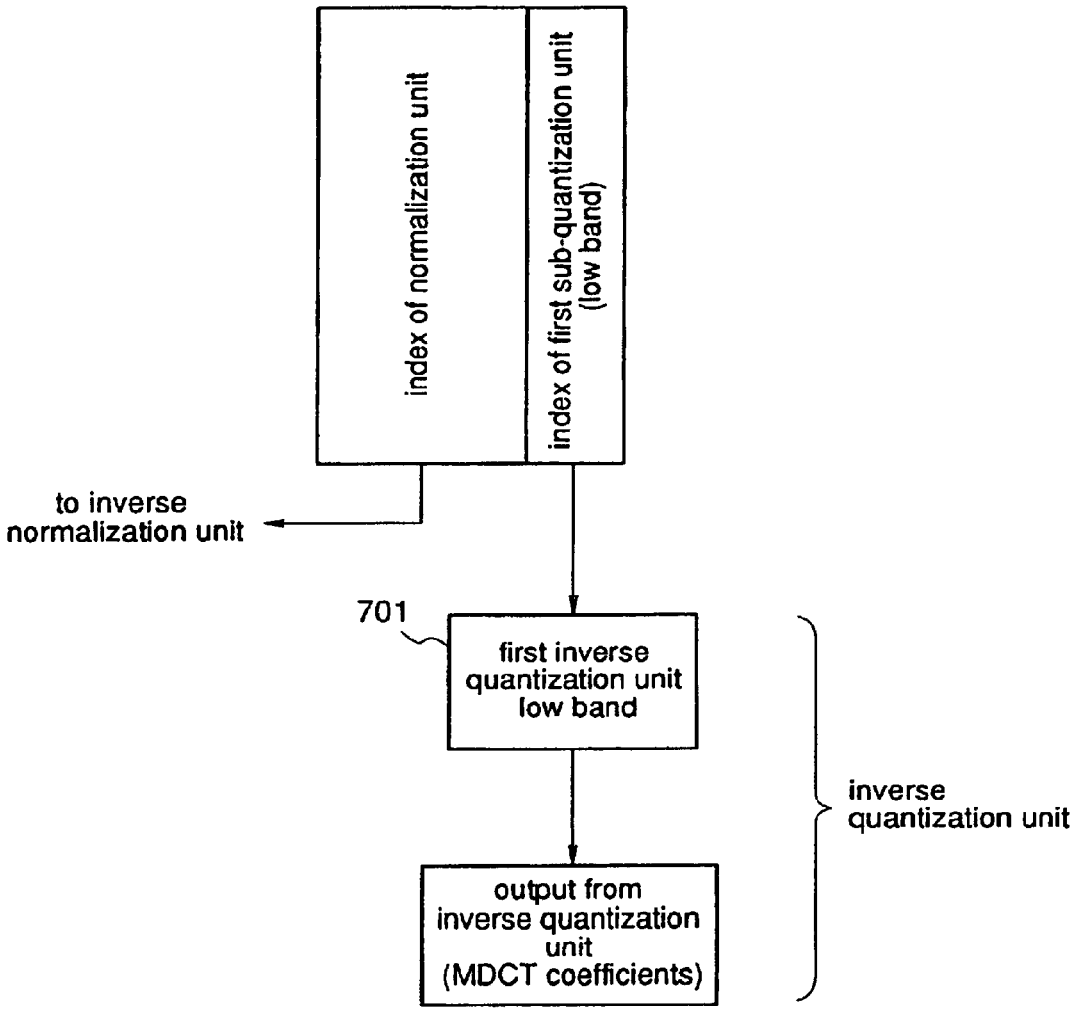
FIG. 20 is a diagram for explaining an audio signal decoding apparatus according to a ninth embodiment of the present invention.

That is, assuming that the quantization unit 105 has the structure shown in FIG. 17, a description is given of the case where inverse quantization is carried out using the inverse quantization unit having the structure of FIG. 20. In FIG. 20, reference numeral 701 designates a first low-band-component inverse quantization unit. The first low-band-component inverse quantization unit 701 performs decoding using only the indices of the low-band components of the first sub-quantizer 501.

Thereby, regardless of the quantity of data transmitted from the coding apparatus 1, an arbitrary quantity of data of the coded audio signal can be decoded, whereby the quantity of data coded can be different from the quantity of data decoded. Therefore, the quantity of data to be decoded can be varied according to the communication environment on the receiving end, and high-definition sound quality can be obtained stably even when an ordinary public telephone network is used.

Figure 21:
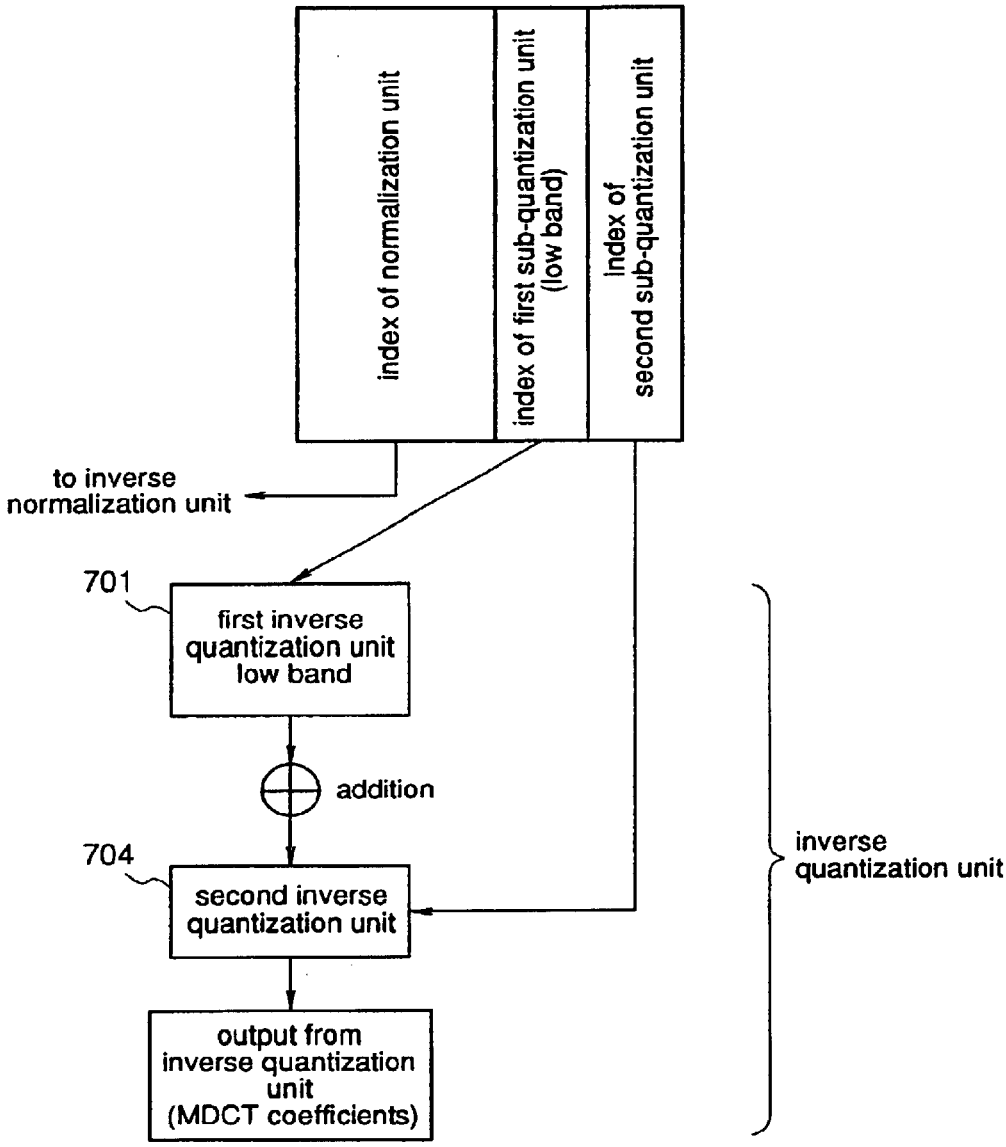
FIG. 21 is a diagram for explaining the audio signal decoding apparatus according to the ninth embodiment of the present invention.

FIG. 21 is a diagram showing the structure of the inverse quantization unit included in the audio signal decoding apparatus, which is employed when inverse quantization is carried out in two stages. In FIG. 21, reference numeral 704 denotes a second inverse quantization unit. This second inverse quantization unit 704 performs decoding using the indices from the second sub-quantization unit 502. Accordingly, the output from the first low-band-component inverse quantization unit 701 and the output from the second inverse quantization unit 704 are added and their sum is output from the inverse quantization unit 106. This addition is performed to the same band as the band quantized by each sub-quantization unit in the quantization.

As described above, the indices from the first sub-quantization unit (low-band) are decoded by the first low-band-component inverse quantization unit 701 and, when the indices from the second sub-quantization unit are inversely quantized, the output from the first low-band-component inverse quantization unit 701 is added thereto, whereby the inverse quantization is carried out in two stages. Therefore, the audio signal quantized in multiple stages can be decoded accurately, resulting in a higher sound quality.

Figure 22:
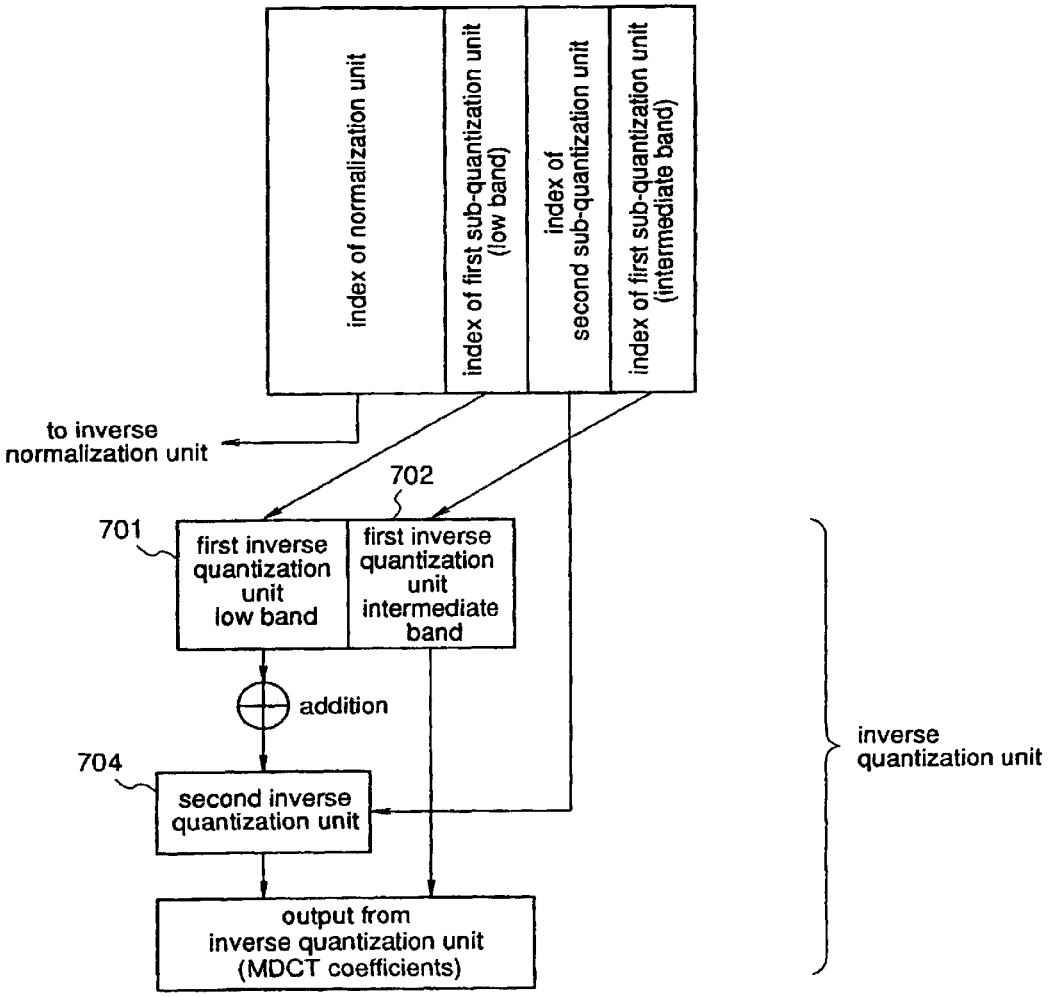
FIG. 22 is a diagram for explaining the audio signal decoding apparatus according to the ninth embodiment of the present invention.

Further, FIG. 22 is a diagram illustrating the structure of the inverse quantization unit included in the audio signal decoding apparatus, in which the object band to be processed is extended when the two-stage inverse quantization is carried out. In FIG. 22, reference numeral 702 denotes a first intermediate-band-component inverse quantization unit. This first intermediate-band-component inverse quantization unit 702 performs decoding using the indices of the intermediate-band components from the first sub-quantization unit 501. Accordingly, the output from the first low-band-component inverse quantization unit 701, the output from the second inverse quantization unit 704, and the output from the first intermediate-band-component inverse quantization unit 702 are added and their sum is output from the inverse quantization unit 106. This addition is performed to the same band as the band quantized by each sub-quantization unit in the quantization. Thereby, the band of the reproduced sound is extended, and an audio signal of higher quality is reproduced.

Figure 23:
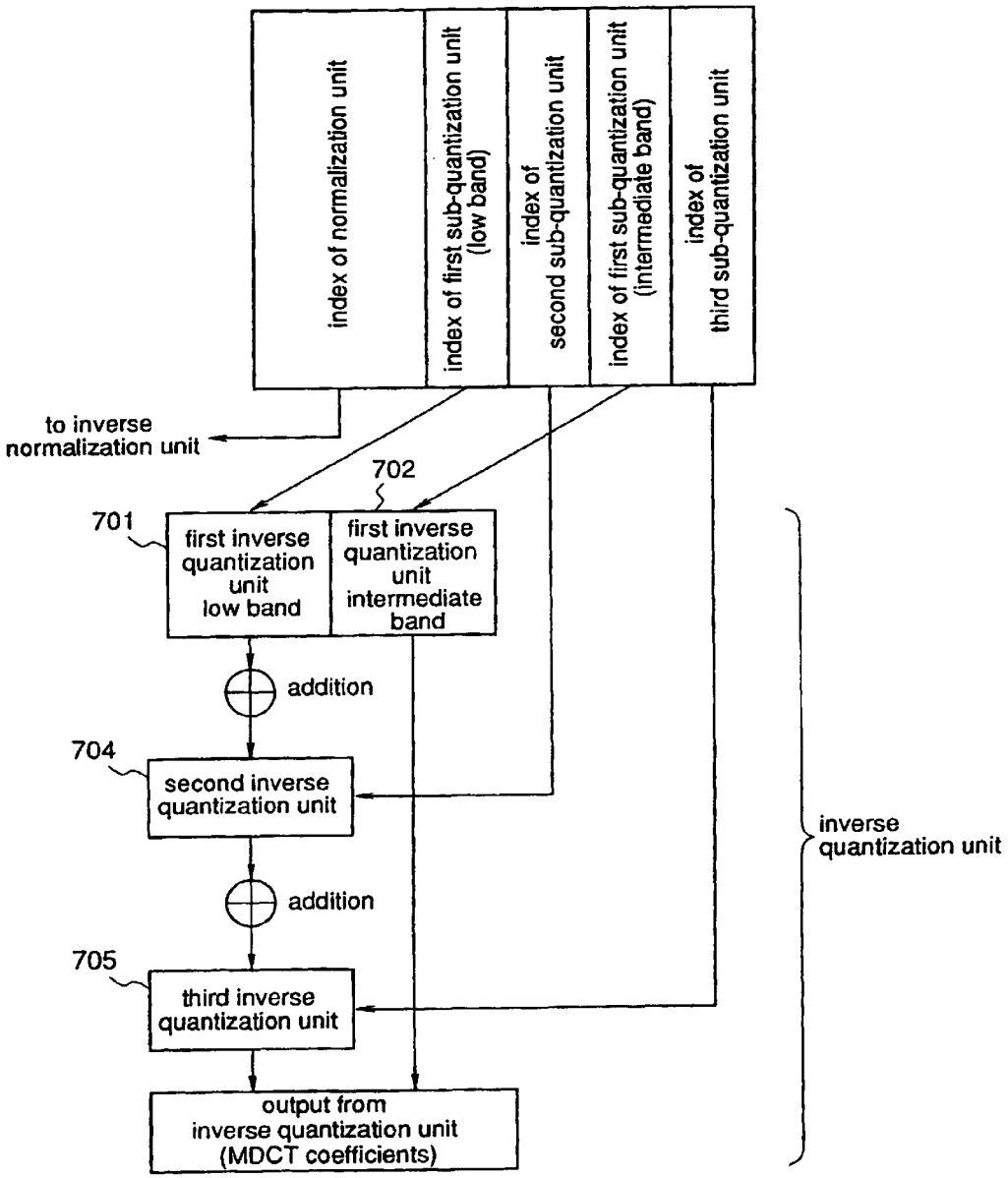
FIG. 23 is a diagram for explaining the audio signal decoding apparatus according to the ninth embodiment of the present invention.

Further, FIG. 23 is a diagram showing the structure of the inverse quantization unit included in the audio signal decoding apparatus, in which inverse quantization is carried out in three stages by the inverse quantization unit having the structure of FIG. 22. In FIG. 23, reference numeral 705 denotes a third inverse quantization unit. The third inverse quantization unit 705 performs decoding using the indices from the third sub-quantization unit 503. Accordingly, the output from the first low-band-component inverse quantization unit 701, the output from the second inverse quantization unit 704, the output from the first intermediate-band-component inverse quantization unit 702, and the output from the third inverse quantization unit 705 are added and their sum is output from the inverse quantization unit 106. This addition is performed to the same band as the band quantized by each sub-quantization unit in the quantization.

Figure 24:
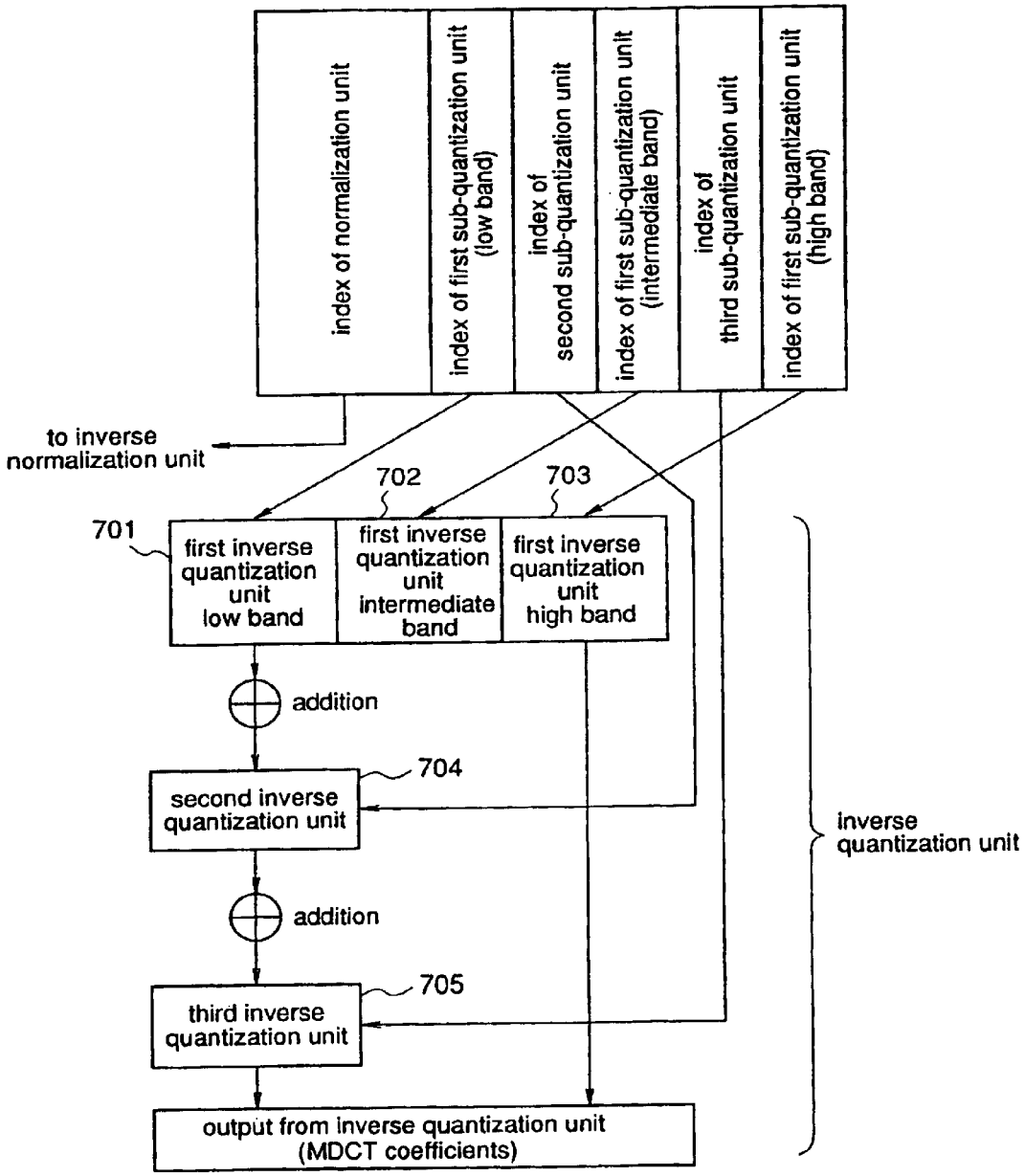
FIG. 24 is a diagram for explaining the audio signal decoding apparatus according to the ninth embodiment of the present invention.

Further, FIG. 24 is a diagram illustrating the structure of the inverse quantization unit included in the audio signal decoding apparatus, in which the object band to be processed is extended when the three-stage inverse quantization is carried out in the inverse quantization unit having the structure of FIG. 23. In FIG. 24, reference numeral 703 denotes a first high-band-component inverse quantization unit. This first high-band-component inverse quantization unit 703 performs decoding using the indices of the high-band components from the first sub-quantization unit 501. Accordingly, the output from the first low-band-component inverse quantization unit 701, the output from the second inverse quantization unit 704, the output from the first intermediate-band-component inverse quantization unit 702, the output from the third inverse quantization unit.705, and the output from the first high-band-component inverse quantization unit 703 are added and their sum is output from the inverse quantization unit 106. This addition is performed to the same band as the band quantized by each sub-quantization unit in the quantization.

While this ninth embodiment is described for the case where the decoding unit 106 inversely decodes the data quantized by the quantization unit 105 having the structure of FIG. 7, similar inverse quantization can be carried out even when the quantization unit 105 has the structure shown in FIG. 16 or 18.

Figure 25:
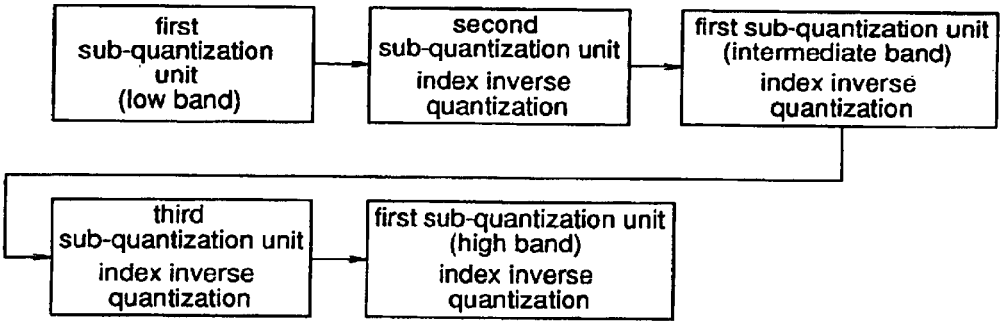
FIG. 25 is a diagram for explaining the audio signal decoding apparatus according to the ninth embodiment of the present invention.

Furthermore, when coding is carried out using the quantization unit having the structure shown in FIG. 17 and decoding is carried out using the inverse quantization unit having the structure shown in FIG. 24, as shown in FIG. 25, after the low-band indices from the first sub-quantization unit are inversely quantized, the indices from the second sub-quantization unit 502 in the next stage are inversely quantized, and the intermediate-band indices from the first sub-quantization unit are inversely quantized. In this way, the inverse quantization to extend the band and the inverse quantization to reduce the quantization error are alternatingly repeated. However, when a signal coded by the quantization unit having the structure shown in FIG. 16 is decoded using the inverse quantization unit having the structure shown in FIG. 24, since there is no divided bands, the quantized coefficients are successively decoded by the inverse quantization unit in the next stage.

Figure 26:
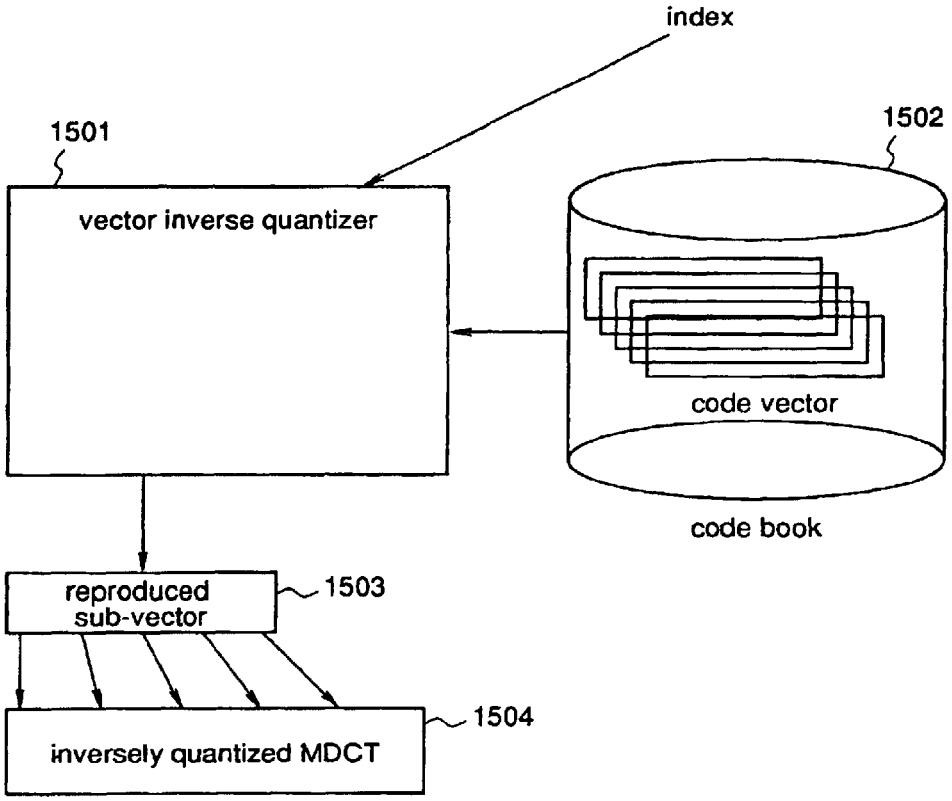
FIG. 26 is a diagram for explaining the detailed operation of an inverse quantization unit as a constituent of the audio signal decoding apparatus.

A description is given of the detailed operation of the inverse quantization unit 107 as a constituent of the audio signal decoding apparatus 2, using FIG. 1 and FIG. 26.

For example, the inverse quantization unit 107 is composed of the first low-band inverse quantization unit 701 when it has the inverse quantization unit shown in FIG. 20, and it is composed of two inverse quantization units, i.e., the first low-band inverse quantization unit 701 and the second inverse quantization unit 704, when it has the inverse quantization unit shown in FIG. 21.

The vector inverse quantizer 1501 reproduces the MDCT coefficients using the indices from the vector quantization unit 105. When the sub-quantization unit has the structure shown in FIG. 20, inverse quantization is carried out as follows. An index number is decoded, and a code vector having the number is selected from the code book 1502. It is assumed that the content of the code book 1502 is identical to that of the code book of the coding apparatus. The selected code vector becomes, as a reproduced vector 1503, an MDCT coefficient 1504 inversely quantized by the inverse process of formula (14).

When the sub-quantization unit has the structure shown in FIG. 21, inverse quantization is carried out as follows. An index number k is decoded, and a code vector having the number u calculated in formula (19) is selected from the code book 1502.

$$u = \begin{cases} k & 0 \le k < K \\ k - K & K \le k < 2K \end{cases} \tag{19}$$

A reproduced sub-vector is generated using formula (20).

$$resi(j) = \begin{cases} C_u l(j) & u = k \\ -C_u(j) & u \ne k \end{cases} \tag{20}$$

wherein the j-th element of the i-th reproduced sub-vector is resi(j).

Figure 27:
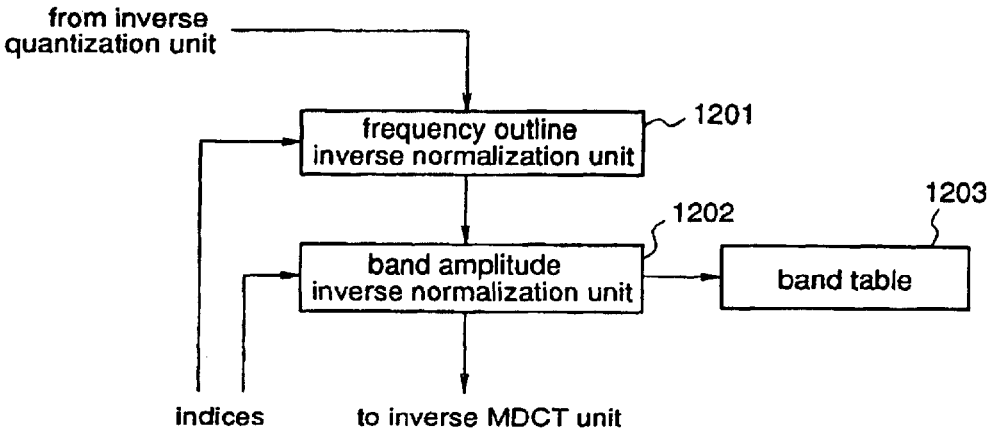
FIG. 27 is a diagram for explaining the detailed operation of an inverse normalization unit as a constituent of the audio signal decoding apparatus.

Next, a description is given of the detailed structure of the inverse normalization unit 107 as a constituent of the audio signal decoding apparatus B2, using FIG. 1 and FIG. 27. In FIG. 27, reference numeral 1201 denotes a frequency outline inverse quantization unit, 1202 denotes a band amplitude inverse normalization unit, and 1203 denotes a band table. The frequency outline inverse normalization unit 1201 receives the indices from the frequency outline normalization unit 1201, reproduces the frequency outline, and multiplies the output from the inverse quantization unit 106 by the frequency outline. The band amplitude inverse normalization unit 1202 receives the indices from the band amplitude normalization unit 202, and restores the amplitude of each band shown in the band table 1203, by multiplication. Assuming that the value of each band restored using the indices from the band amplitude normalization unit B202 is qavej, the operation of the band amplitude inverse normalization unit 1202 is given by formula (12).

$$dct(i)=n_dct(i)\cdot \mathrm{gave}_j \; bj\mathrm{low} \le i \le bj\mathrm{high} \tag{12}$$

wherein the output from the frequency outline inverse normalization unit 1201 is n_dct(i), and the output from the band amplitude inverse normalization unit 1202 is dct(i). In addition, the band table 1203 and the band table 203 are identical.

Figure 28:
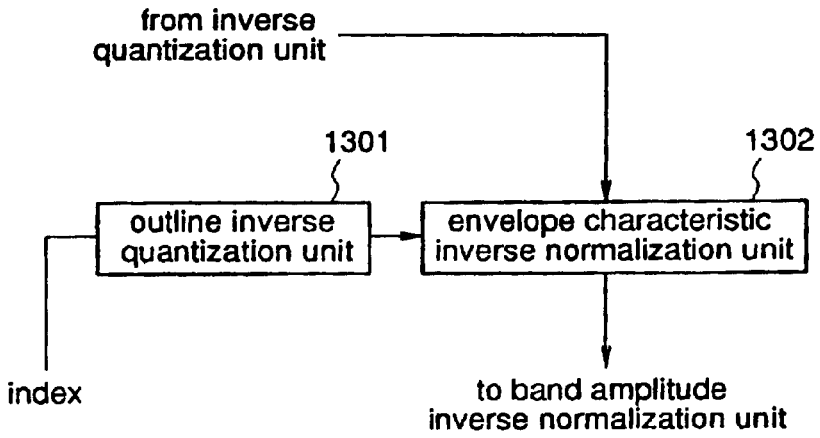
FIG. 28 is a diagram for explaining the detailed operation of a frequency outline inverse normalization unit as a constituent of the audio signal decoding apparatus.

Next, a description is given of the detailed structure of the frequency outline inverse normalization unit 1201 as a constituent of the audio signal decoding apparatus 2, using FIG. 28. In FIG. 28, reference numeral 1301 designates an outline inverse quantization unit, and 1302 denotes an envelope characteristic inverse quantization unit. The outline inverse quantization unit 1301 restores parameters showing the frequency outline, for example, linear prediction coefficients, using the indices from the outline quantization unit 301 in the coding apparatus. When the restored coefficients are linear prediction coefficients, the quantized envelope characteristics are restored by calculating them similarly in formula (8). When the restored coefficients are not linear prediction coefficients, for example, when they are LSP coefficients, the envelope characteristics are restored by transforming them to frequency characteristics. The envelope characteristic inverse quantization unit 1302 multiplies the restored envelope characteristics by the output from the inverse quantization unit 106 as shown in formula (13), and outputs the result.

$$mdct(i)=fdct(i)\cdot env(i) \tag{13}$$

Embodiment 10

Figure 29:
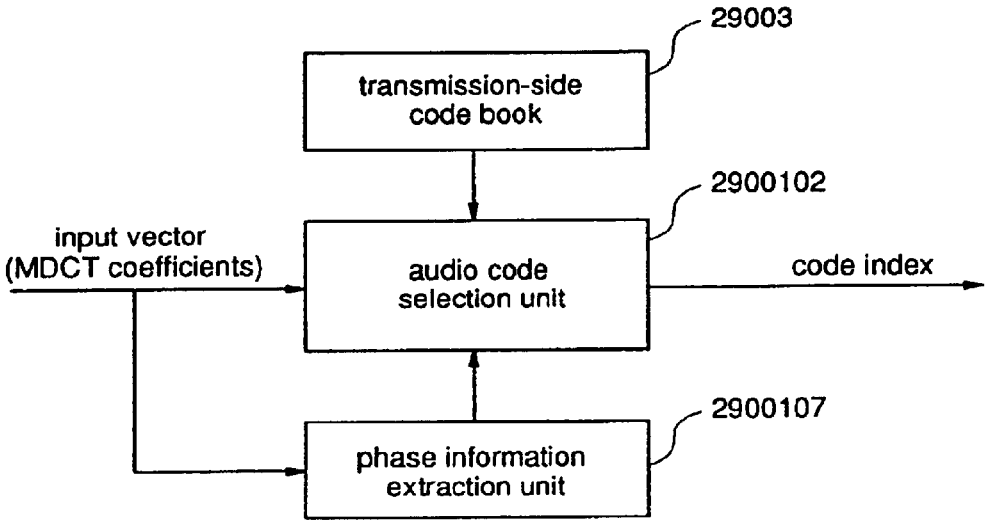
FIG. 29 is a diagram illustrating the structure of an audio signal coding apparatus according to a tenth embodiment of the present invention.

Hereinafter, an audio signal coding apparatus according to a tenth embodiment of the present invention will be described with reference to the drawings. FIG. 29 is a diagram illustrating the detailed structure of an audio signal coding apparatus according to the tenth embodiment. In the figure, reference numeral 29003 denotes a transmission-side code book having a plurality of audio codes which are representative values of feature amounts of audio signal, 2900102 denotes an audio code selection unit, and 2900107 denotes a phase information extraction unit.

Hereinafter, a description is given of the operation.

Although MDCT coefficients are regarded as an input signal in this case, DFT (discrete Fourier transform) coefficients or the like may be used as long as it is a time-to-frequency transformed signal.

Figure 30:
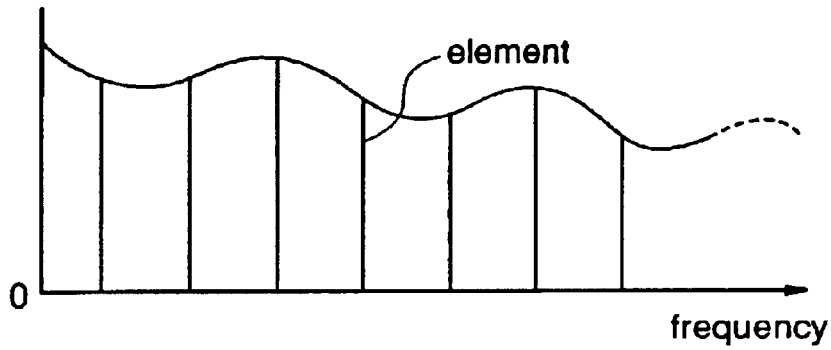
FIG. 30 is a diagram for explaining the structure of an audio feature vector in the audio signal coding apparatus according to the tenth embodiment.
Figure 30:
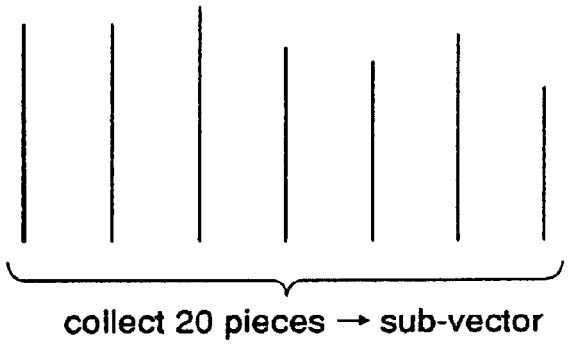

As shown in FIG. 30, when data on the frequency axis is regarded as one sound source vector, some elements are extracted from the sound source vector to form a sub-vector. When this sub-vector is regarded as the input vector shown in FIG. 29, the audio code selection unit 2900102 calculates distances between the input vector and the respective codes in the transmission-side code book 29003, selects a code having a minimum distance, and outputs the code index of the selected code in the transmission-side code book 29003.

Figure 31:
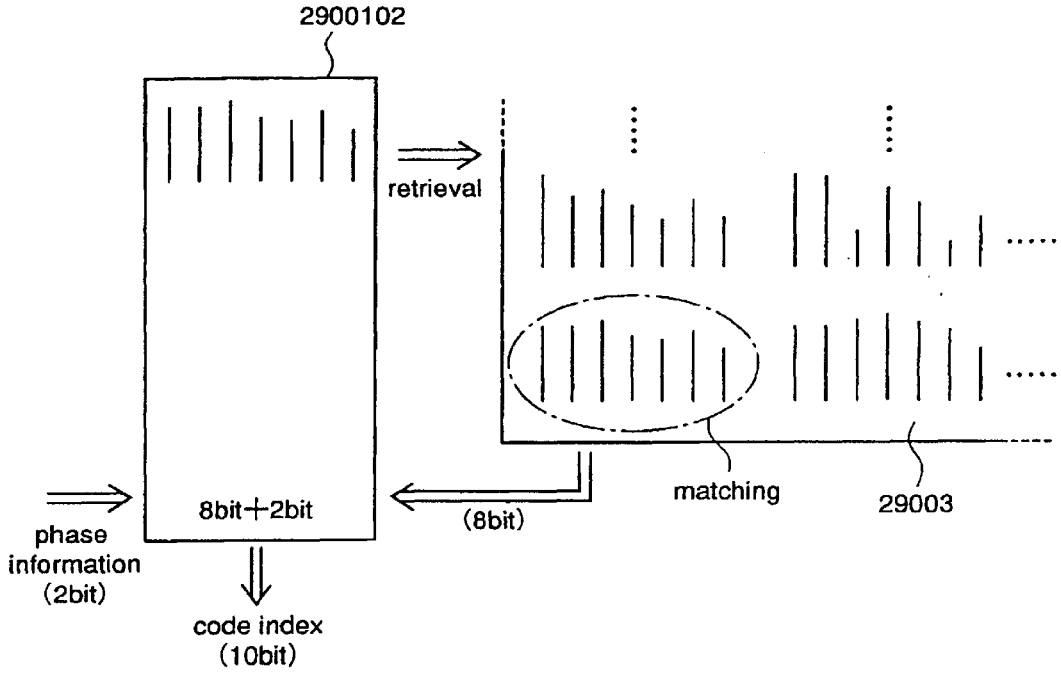
FIG. 31 is a diagram for explaining the processing of the audio signal coding apparatus according to the tenth embodiment.

A description is given of the detailed operation of the coding apparatus using FIG. 29 and FIG. 31. It is assumed that coding is carried out with 10 bits because it is intended for 20 KHz. Further, in the phase information extraction unit 2900107, phases are extracted from two elements on the low-frequency side, i.e., 2 bits. The input to the audio code selection unit 2900102 is a sub-vector obtained as follows. When coefficients obtained by MDCT are regarded as one vector, this vector is divided into plural sub-vectors so that each sub-vector is composed of some elements, for example, about 20 elements. In this case, the sub-vector is expressed by X0~X19, and a sub-vector element, of which the number appended to X is smaller, corresponds to an MDCT coefficient having a lower frequency component. The low frequency component is auditively important information for human beings and, therefore, to perform coding of these elements with priority results in that the degradation in sound quality is hardly sensed by human beings when being reproduced.

The audio code selection unit 2900102 calculates distances between the feature vector and the respective codes in the transmission-side code book 29003. For example, when the code index is i, the distance Di of a code having the code index i is calculated in formula (21).

$$D_i = \sum_{i=0}^{N} \sum_{j=0}^{M} \{\mathrm{abs}(Cij) - \mathrm{abs}(Xj)\}^P + \sum_{i=0}^{N} \sum_{j=M+1}^{19} \{Cij - Xj\}^P \tag{21}$$

where N is the number of all codes in the transmission-side code book 29003, Cij is the value of the j-th element in code index I. In this tenth embodiment, M is a number smaller than 19, for example, 1. P is the norm for distance calculation and, for example, it is 2. Further, abs( ) means absolute calculation.

The phase information extraction unit 2900107 outputs the coded index i giving a minimum distance Di, and M pieces of phase information Ph(j) j=0 to M. The phase information Ph(j) is expressed by formula (22).

$$Ph(j) = \begin{cases} 1 \text{ at } Cji * Xj \geq 0 \\ -1 \text{ at } Cji * Xj < 0 \end{cases} \tag{22}$$

When the input vector is a sub-vector of a vector obtained by subjecting an audio signal to MDCT, generally, the auditive importance of the coefficient is higher as the appended character j of Xj is smaller. So, in this structure, with respect to the phases (negative or positive) corresponding to the elements of the low-frequency components of each sub-vector, these data are not considered when code retrieval is carried out, but added separately after the retrieval. To be specific, as shown in FIG. 31(*a*), the input sub-vector is pattern-compared with the codes possessed by the transmission-side code book 29003, without regard for the signs (negative or positive) of the 2-bit elements on the low-frequency side of each sub-vector. For example, there are stored 256 codes together with the low-frequency side 2-bit elements, both being positive, and the audio code selection unit 290102 retrieves the input sub-vector and the 256 codes possessed by the transmission-side code book 29003. Then, any of the combinations shown in FIG. 31(*b*), which is extracted by the phase information extraction unit 2900107, is added to the selected code, as signs of the 2 bits on the low-frequency side of the sub-vector, and a code index of 10 bits in total is output.

Thereby, the code index output from the audio coding apparatus remains as in the conventional apparatus, i.e., 10 bits (1024 pieces), but the code stored in the transmission-side code book 3 can be 8 bits (256 pieces). Assuming that the total of the data quantities of the code index and the phase information is equal to the data quantity of the code index for distance calculation shown in formula (23), when the synthesis sound decoded in formula (23) is compared with the synthesis sound according to the embodiment structure, approximately equal subjective evaluation results are obtained.

$$D_i = \sum_{i=0}^{N} \sum_{j=0}^{19} \{Cij - Xj\}^P \tag{23}$$

Table 3 shows the relationship between the calculation amount and the memory amount in the case where the embodiment structure and formula (22) are used. It can be seen from Table 3 that the structure of this embodiment reduces the code book to ¼, and reduces the calculation amount to 256 ways of retrieval processes (whereas 1024 ways of retrieval processes are needed in the conventional structure) and a process of adding two codes to the retrieval result, whereby the calculation amount and the memory are significantly reduced.

TABLE 3

| method | formula 3 | formula 1 |
|---|---|---|
| transmission data quantity | 9 bits | 9 bits |
| code book (number of codes) | 512 (9 bits) | 64 (6 bits) |
| data for code transmission | 0 | 3 codes (3 bits) |
| calculation amount | 512-codes retrieval | 64-codes retrieval + 3-codes addition |

As described above, according to the tenth embodiment of the invention, when selecting an audio code having a minimum distance among the auditive distances between sub-vectors produced by dividing an input vector and audio codes in the transmission-side code book 29003, a portion corresponding to an element of a sub-vector of a high auditive importance is treated in the audio code selection unit 2900102 while neglecting the positive and negative codes indicating its phase information, and subjected to comparative retrieval with respect to the audio codes in the transmission-side code book 29003. Then, phase information corresponding to an element portion of the sub-vector extracted in the phase information extraction unit 2900107 is added to the result obtained, and the result is output as a code index. Therefore, the calculation amount in the audio code selection unit 2900102 and the number of codes required in the code book 29003 are reduced without degrading the sensible sound quality.

Embodiment 11

Figure 32:
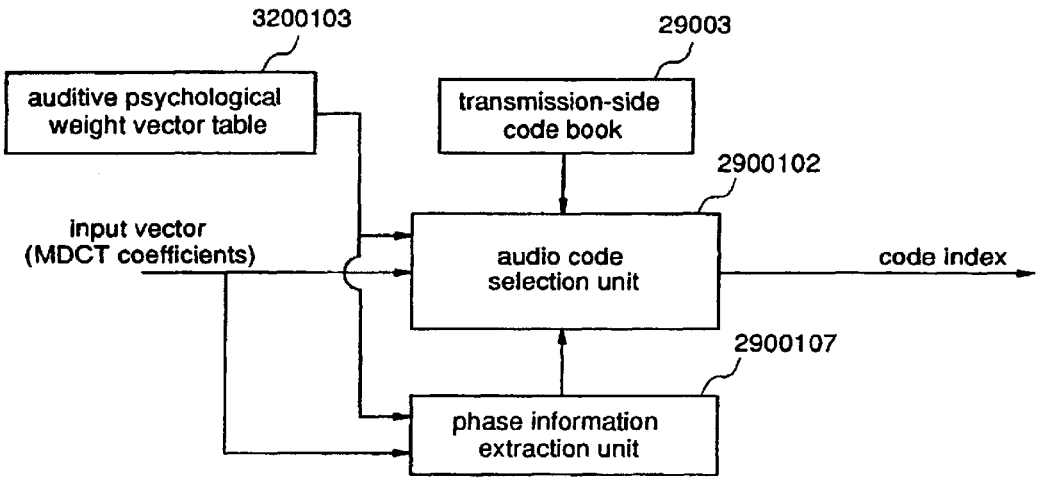
FIG. 32 is a diagram illustrating the detailed structure of an audio signal coding apparatus according to an eleventh embodiment of the present invention, and an example of an auditive psychological weight vector table.
Figure 32:
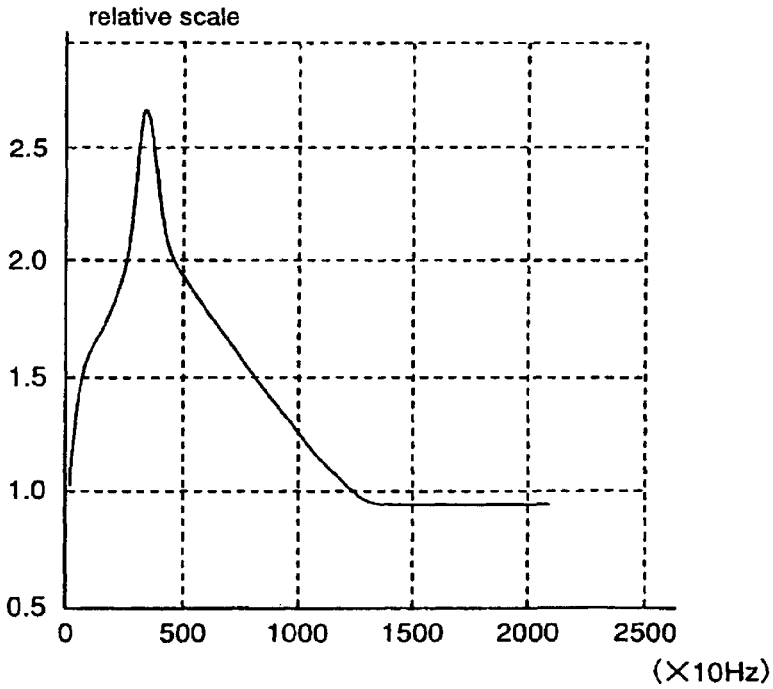

Hereinafter, an audio signal coding apparatus according to an eleventh embodiment of the present invention will be described with reference to the drawings. FIG. 32(*a*) is a diagram showing the structure of an audio signal coding apparatus according to this eleventh embodiment. In FIG. 32, reference numeral 3200103 denotes an auditive psychological weight vector table that stores a table of relative auditive psychological amounts at the respective frequencies, with regard to the auditive psychological characteristic of human beings.

Hereinafter, a description is given of the operation. This eleventh embodiment is different from the tenth embodiment in that the auditive psychological weight vector table 3200103 is newly added. The auditive psychological weight vectors are obtained by collecting elements in the same frequency band corresponding to the respective elements of the input vector of this embodiment from, for example, an auditive sensitivity table defined as auditive sensitivity characteristic to frequencies, on the basis of the auditive psychological model of human beings, and then transforming these elements to vectors. As shown in FIG. 32(*b*), this table has a peak about a frequency of 2.5 KHz, and this means that the elements at the lowest position of frequency are not always important for the auditive sense of human beings.

To be specific, in this eleventh embodiment, using MDCT coefficients as input vectors to the audio code selection unit 2900102, and the auditive psychological weight vector table 3200103 as weights for code selection, auditive distances between the input vectors and the respective codes in the transmission-side code book 29003 are calculated, and a code index of a code having a minimum distance is output. When the code index is i, the distance scale Di for code selection in the audio code selection unit 2900102 becomes, for example, $$D_i = \sum_{i=0}^{N} \sum_{j=0}^{M} Wj\{\mathrm{abs}(Cij) - \mathrm{abs}(Xj)\}^P + \sum_{i=0}^{N} \sum_{j=M+1}^{19} Wj\{Cij - Xj\}^P \tag{24}$$

where N is the number of all codes in the transmission-side code book 29003, and Cij is the value of the j-th element in the code index i. In this embodiment, M is a number smaller than 19, for example, 1. P is the norm in the distance calculation, for example, 2. Wj is the j-th element of the auditive psychological weight vector table 3200103. Further, abs( ) means absolute operation.

The phase information extraction unit 2900107 decides that phase information of an element corresponding to an audio feature vector of which frequency is extracted the auditive psychological weight vector table 3200103, and outputs a code index I having a minimum Di in the range and M pieces of phase information Ph(j) j=0 to M.

As described above, according to the eleventh embodiment, when selecting an audio code having a minimum distance among the auditive distances between sub-vectors produced by dividing an input vector and audio codes in the transmission-side code book 29003, a portion corresponding to an element of a sub-vector of a high auditive importance is treated in the audio code selection unit 2900102 while neglecting the positive and negative codes indicating their phase information, and subjected to comparative retrieval with respect to the audio codes in the transmission-side code book 29003. Then, phase information corresponding to an element portion of the sub-vector extracted in the phase information extraction unit 2900107 is added to the result obtained, and the result is output as a code index. Therefore, the calculation amount in the audio code selection unit 2900102 and the number of codes required in the code book 29003 are reduced without degrading the sensible sound quality.

Further, the audio feature vector, which is treated in the audio code selection unit 2900102 while neglecting the positive and negative codes indicating its phase information, is selected after being weighted using the auditive psychological weight vector table 3200103 that stores a table of relative auditive psychological amounts at the respective frequencies in view of the auditive psychological characteristic of human beings. Thereby, as compared with the tenth embodiment in which a prescribed number of vectors are simply selected from a low band, quantization with more sensible sound quality is realized.

Embodiment 12

Figure 33:
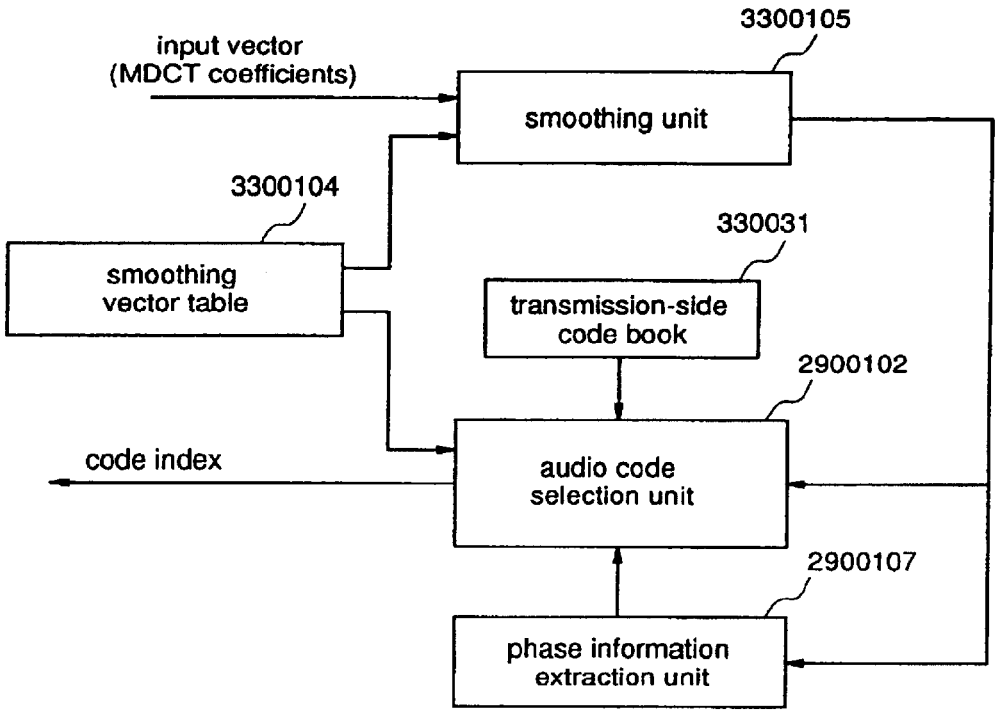
FIG. 33 is a diagram illustrating the detailed structure of an audio signal coding apparatus according to a twelfth embodiment of the present invention, and for explaining the processing of a smoothing unit.
Figure 33:
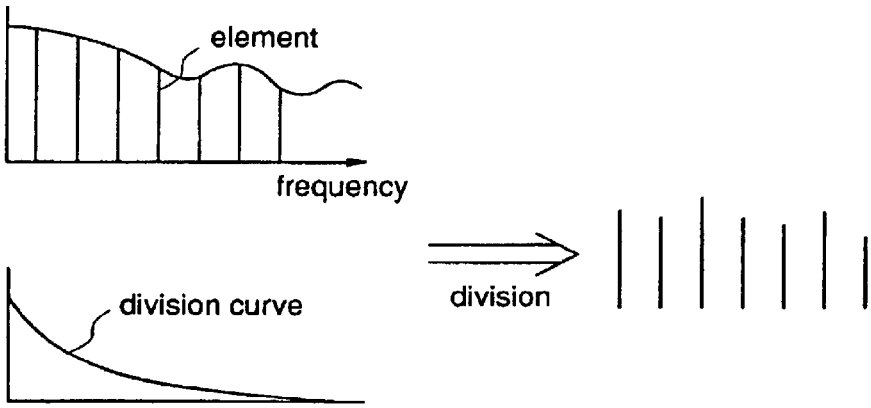

Hereinafter, an audio signal coding apparatus according, to a twelfth embodiment of the present invention will be described with reference to the drawings. FIG. 33(*a*) is a diagram illustrating the structure of an audio signal quantization apparatus according to this twelfth embodiment. In the figure, reference numeral 3300104 denotes a smoothing vector table in which data, such as a division curve, are stored actually. Reference numeral 3300105 denotes a smoothing unit that smoothes an input vector by division of corresponding vector elements, using the smoothing vector stored in the smoothing vector table 3300104.

Hereinafter, a description is given of the operation. To the smoothing unit 3300105, MDCT coefficients or the like are input as an input vector, as in the audio signal coding apparatus according to the tenth or eleventh embodiment. The smoothing unit 3300105 subjects the input vector to smoothing operation using a division curve which is a smoothing vector stored in the smoothing vector table 3300104. This smoothing operation is expressed by formula (25) when the input vector is X, the smoothing vector 3300104 is F, the output from the smoothing unit 3300105 is Y, and the I-th element of each vector is Xi,Fi,Yi.

$$Yi = Xi/Fi \tag{25}$$

When the input vector is MDCT coefficients, the smoothing vector table 3300104 is a value that reduces the dispersion of the MDCT coefficients. FIG. 33(*b*) schematically shows the above-described smoothing process, and the range of data quantity per frequency can be reduced by performing division of two elements from the low-band side, among the elements transformed to a sub-vector.

The output from the smoothing unit 3300105 is input to the audio code selection unit 2900102. In the phase information extraction unit 2900107, from the smoothed input vector, phase information of two elements from the lower-frequency side is extracted. On the other hand, in the audio code selection unit 2900102, the smoothed input vector and the 256 codes stored in the transmission-side code book 330031 are retrieved. Since a correct retrieval result is not obtained if a code index (8 bits) corresponding to the obtained retrieval result is output as it is, information relating to the smoothing process is obtained from the smoothing vector table 3300104, and the scaling is adjusted. Thereafter, a code index (8 bits) corresponding to the retrieval result is selected, and phase information of 2 bits is added to the obtained result, thereby to output a coded index I of 10 bits.

The distance Di between the input vector and the code stored in the transmission-side code book 330031 is expressed by, for example, formula (26) with each i-th element in the smoothing vector table 3300104 being Fi.

$$D_i = \sum_{i=0}^{N} \sum_{j=0}^{M} Fj\{\mathrm{abs}(Cij) - \mathrm{abs}(Xj)\}^P + \sum_{i=0}^{N} \sum_{j=M+1}^{19} Fj\{Cij - Xj\}^P \quad (26)$$

where N is the number of all codes in the transmission-side code book 330131, and Cij is the value of the j-th element in the code index i. In this embodiment, M is a number smaller than 19, for example, 1. P is the norm in the distance calculation, for example, 2. Wj is the j-th element of the auditive psychological weight vector table 3200103. Further, abs( ) means absolute operation. The phase information extraction unit 2900107 outputs a code index i having a minimum Di, and M pieces of phase information Ph(j) j=0 to M. The phase information Ph(j) is defined similarly in formula (22).

As described above, according to the twelfth embodiment, when selecting an audio code having a minimum distance among the auditive distances between sub-vectors produced by dividing an input vector and audio codes in the transmission-side code book 330031, a portion corresponding to an element of a sub-vector of a high auditive importance is treated in the audio code selection unit 2900102 while neglecting the positive and negative codes indicating their phase information, and subjected to comparative retrieval with respect to the audio codes in the transmission-side code book 330031. Then, phase information corresponding to an element portion of the sub-vector extracted in the phase information extraction unit 2900107 is added to the result obtained, and the result is output as a code index. Therefore, the calculation amount in the audio code selection unit 2900102 and the number of codes required in the code book 330031 are reduced without degrading the sensible sound quality.

Further, since the input vector is smoothed using the smoothing table 3300104 and the smoothing unit 3300105, the quantity of data per frequency, which data are stored in the transmission-side code book 330031 to be referred to when the audio code selection unit 2900102 performs is retrieval, is reduced as a whole.

Embodiment 13

Figure 34:
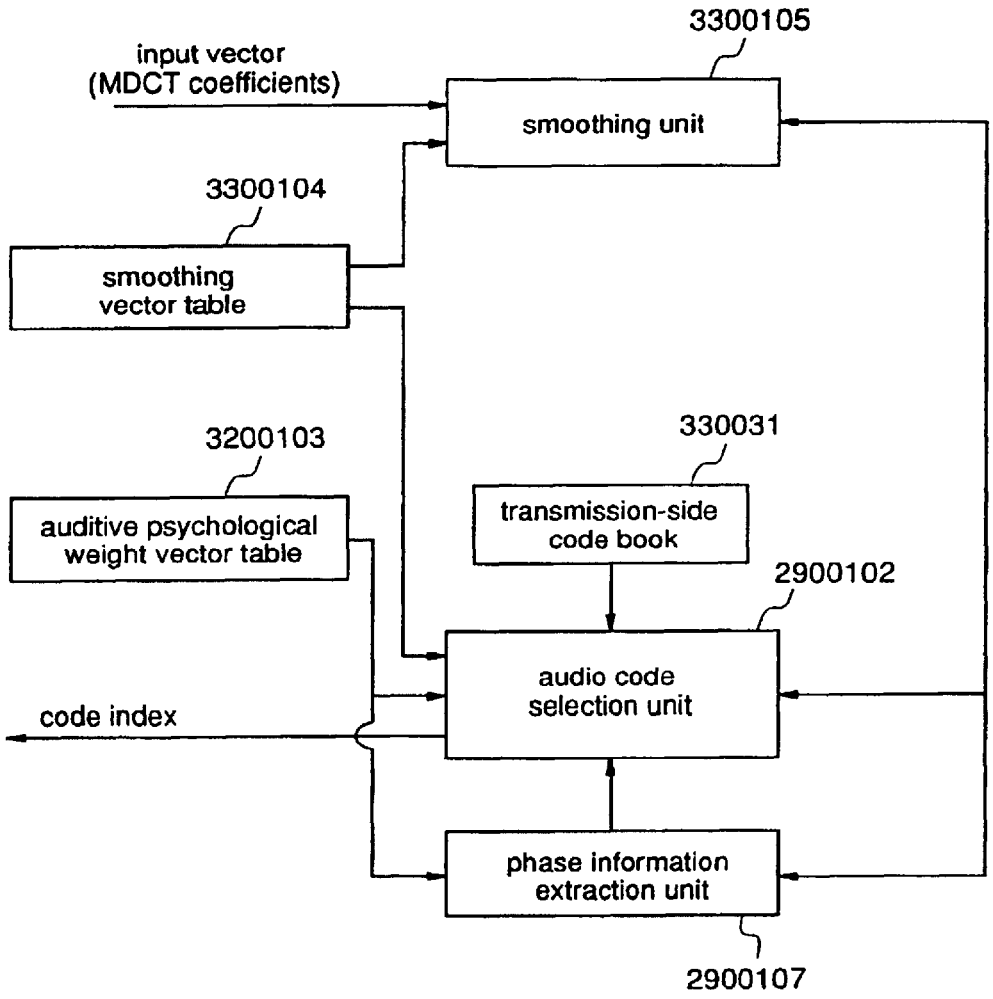
FIG. 34 is a diagram illustrating the detailed structure of an audio signal coding apparatus according to a thirteenth embodiment of the present invention.

Hereinafter, an audio signal coding apparatus according to a thirteenth embodiment of the present invention will be described with reference to the drawings. FIG. 34 is a diagram illustrating the structure of an audio signal coding apparatus according to this thirteenth embodiment. In the figure, this thirteenth embodiment is different from the embodiment 12 shown in FIG. 33 in that, when the audio code selection unit 2900102 performs code selection, in addition to the smoothing vector table 3300104, the auditive psychological weight vector table 3200103 used for the eleventh embodiment is used as well.

Hereinafter, a description is given of the operation. As in the tenth embodiment, MDCT coefficients or the like are input, as an input vector, to the smoothing unit 3300105, and the output from the smoothing unit 3300105 is input to the audio code-selection unit 2900102. In the audio code selection unit 2900102, the distances between the respective codes in the transmission-side code book 330031 and the output from the smoothing unit 3300105 are calculated, on the basis of the information about the smoothing process output from the smoothing vector table 3300104, while adding the weighting by the auditive psychological weight vector in the auditive psychological weight vector table 3200103 and considering the scaling in the smoothing process. Using an expression similar to those of the tenth and eleventh embodiments, the distance Di is expressed as, for example, formula (27).

$$D_i = \sum_{i=0}^{N} \sum_{j=0}^{M} WjFj\{\mathrm{abs}(Cij) - \mathrm{abs}(Xj)\}^P + \sum_{i=0}^{N} \sum_{j=M+1}^{19} WjFj\{Cij - Xj\}^P \quad (27)$$

where N is the number of all codes in the transmission-side code book 330131, and Cij is the value of the lath element in the code index i. In this embodiment, M is a number smaller than 19, for example, 1. P is the norm in the distance calculation, for example, 2. Wj is the j-th element of the auditive psychological weight vector table 3200103. Further, abs( ) means absolute operation. The phase information extraction unit 2900107 outputs a code index I having a minimum Di, and M pieces of phase information Ph(j) j=0 to M. The phase information Ph(j) is defined similarly in formula (22).

As described above, according to the thirteenth embodiment, when selecting an audio code having a minimum distance among the auditive distances between sub-vectors produced by dividing an input vector and audio codes in the transmission-side code book 330031, a portion corresponding to an element of a sub-vector of a high auditive importance is treated in the audio code selection unit 2900102 while neglecting the positive and negative codes indicating their phase information, and subjected to comparative retrieval with respect to the audio codes in the transmission-side code book 330031. Then, phase information corresponding to an element portion of the sub-vector extracted in the phase information extraction unit 2900107 is added to the result obtained, and the result is output as a code index. Therefore, the calculation amount in the audio code selection unit 2900102 and the number of codes required in the code book 330031 are reduced without degrading the sensible sound quality.

Further, the audio feature vector, which is treated in the audio code selection unit 2900102 while neglecting the positive and negative codes indicating its phase information, is selected after being weighted using the auditive psychological weight vector table 3200103 that stores a table of relative auditive psychological amounts at the respective frequencies in view of the auditive psychological characteristic of human beings. Thereby, as compared with the tenth embodiment in which a prescribed number of vectors are simply selected from a low band, quantization with more sensible sound quality is realized.

Further, since the input vector is smoothed using the smoothing table 3300104 and the smoothing unit 3300105, the quantity of data per frequency, which data are stored in the transmission-side code book 330031 to be referred to when the audio code selection unit 2900102 performs retrieval, is reduced as a whole.

Embodiment 14

Figure 35:
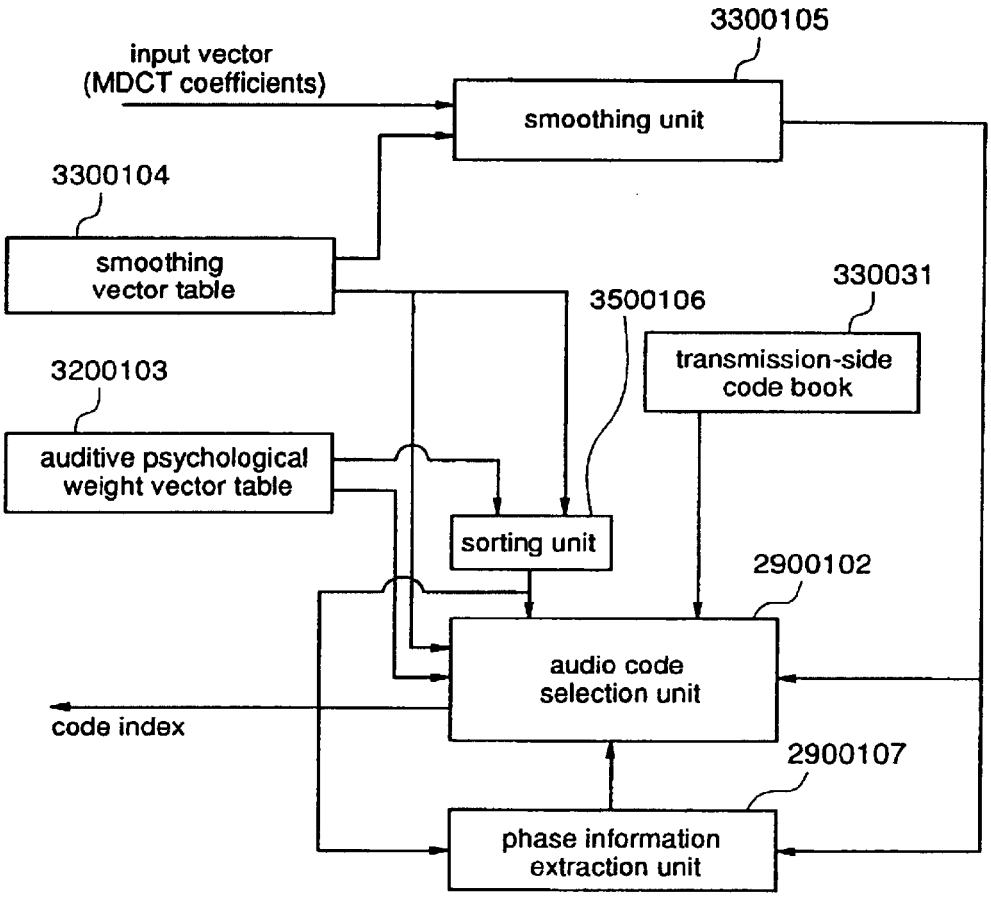
FIG. 35 is a diagram illustrating the detailed structure of an audio signal coding apparatus according to a fourteenth embodiment of the present invention.

Hereinafter, an audio signal coding apparatus according to a fourteenth aspect of the present invention will be described with reference to the drawings. FIG. 35 is a diagram illustrating the structure of an audio signal coding apparatus according to this fourteenth embodiment. In the figure, reference numeral 3500106 denotes a sorting unit which receives the output from the auditive psychological weight vector table 3200103 and the output from the smoothing vector, selects a plurality of largest elements among the calculated vectors, and outputs these elements.

Hereinafter, a description is given of the operation. This fourteenth embodiment is different from the thirteenth embodiment in that the sorting unit 3500106 is added, and in the method of selecting and outputting a code index by the audio code selection unit 2900102.

To be specific, the sorting unit 3500106 receives the outputs from the auditive psychological weight vector table 3200103 and the smoothing vector table 3300104 and, when the j-th element of a vector WF is defined as WFj, it is expressed by formula (28).

$$WFj=abs(Wj*Fj) \tag{28}$$

The sorting unit 3500106 calculates R pieces of largest elements from the respective elements WFj of the vector WF, and outputs the numbers of the R pieces of element. The audio code selection unit 2900102 calculates the distance Di, as in the aforementioned embodiments. The distance Di is expressed by, for example, formula (29).

$$D_i = \sum_{i=0}^{N} \sum_{j=0}^{19} FUNCW \tag{29}$$

$$FUNCW = \begin{cases} Wj*Fj*\{\text{abs}(Cij) - \text{abs}(Xj)\}^P & \text{at } Rj = 1 \\ Wj*Fj*\{Cij - Xj\}^P & \text{at } Rj = 0 \end{cases}$$

where, when Rj is the element number output from the sorting unit 3500106, Rj is equal to 1 and, when Rj is not the output element number, Rj is equal to 0. N is the number of all codes in the transmission-side code book 330031, and Cij is the value of the j-th element in the code index i. In this embodiment, M is a number smaller than 19, for example, 1. P is the norm in the distance calculation, for example, 2. Wj is the j-th element of the auditive psychological weight vector table 3200103. Further, abs( ) means absolute operation. The phase information extraction unit 2900107 outputs a code index I having a minimum Di, and M pieces of phase information Ph(j)j=0 to M. The phase information Ph(j) is defined in formula (30).

$$Ph(j) = \begin{cases} 1 \text{ at } Cji*Xj \geq 0 \\ -1 \text{ at } Cji*Xj < 0 \end{cases} \tag{30}$$

However, Ph(j) is calculated for only those corresponding to the element numbers output from the sorting unit 3500106. In this embodiment, (R+1) pieces are calculated. In the case of employing the structure of this fourteenth embodiment, it is necessary to provide the sorting unit 3500106 when decoding this index.

As described above, according to the fourteenth embodiment, in the thirteenth embodiment described above, the output from the smoothing vector table 3300104 and the output from the auditive psychological weight vector table 3200103 are received and, from these output results, a plurality of largest elements among the vectors, i.e., elements having large weight absolute values, are selected to be output to the audio code selection unit 2900102. Therefore, a code index can be calculated while considering both of the elements being significant for the auditive characteristic of human beings and the physically important elements, whereby coding of a higher-quality audio signal is realized.

While in this fourteenth embodiment R pieces of elements are selected from elements having large weight absolute values with regard to both of the smoothing vector 3300104 and the auditive psychological weight vector 3200103, this number may be equal to M used for the tenth to thirteenth embodiments.

Embodiment 15

Figure 36:
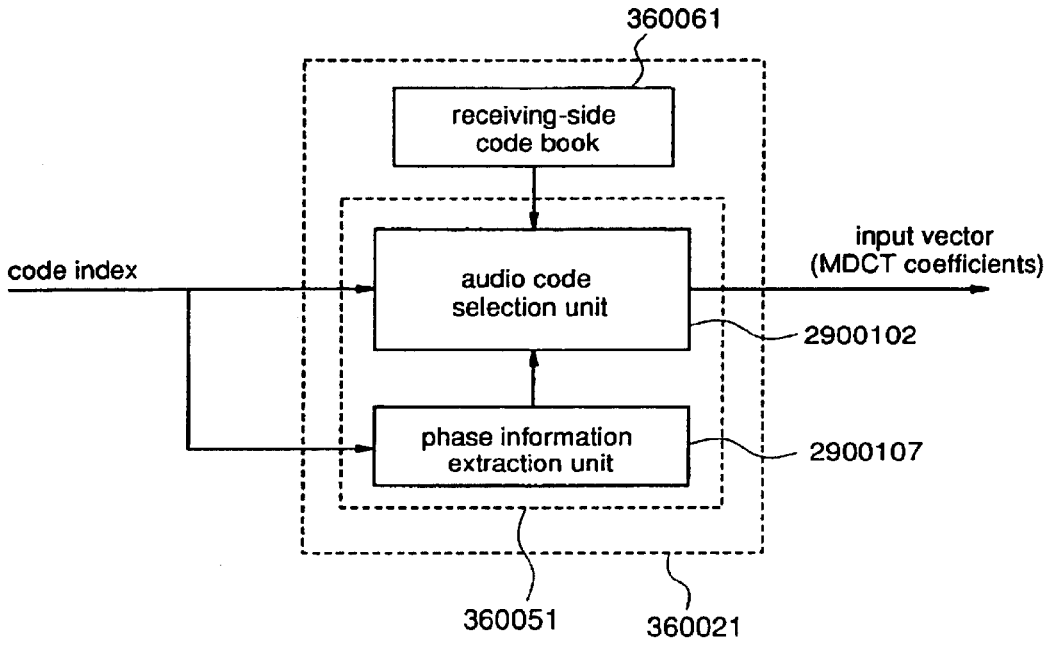
FIG. 36 is a diagram illustrating the structure of an audio signal decoding apparatus according to a fifteenth embodiment of the present invention.
Figure 37:
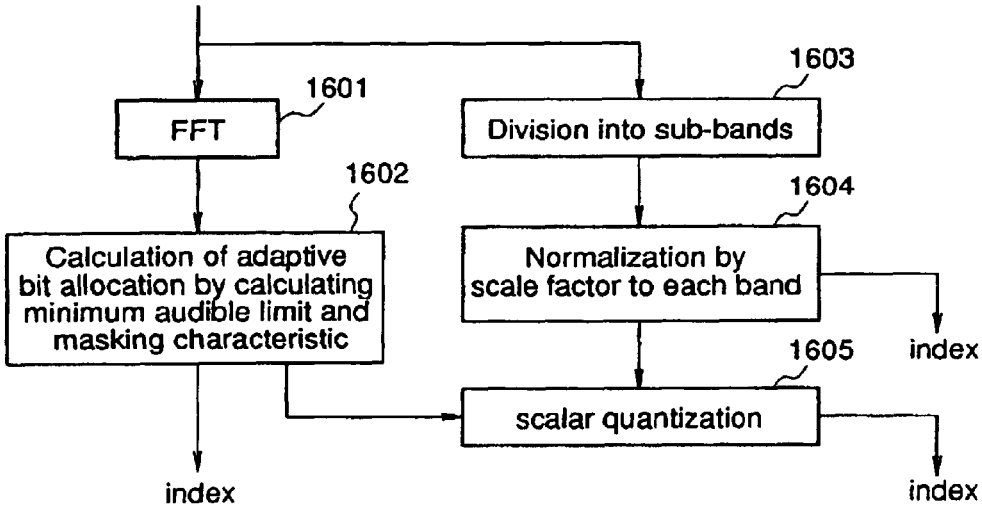
FIG. 37 is a diagram illustrating the structure of an audio signal coding apparatus according to the prior art.

Hereinafter, an audio signal decoding apparatus according to a fifteenth embodiment of the present invention will be described with reference to the drawings. FIG. 36 is a diagram illustrating the structure of an audio signal decoding apparatus according to the fifteenth embodiment. In FIG. 36, reference numeral 360021 denotes a decoding apparatus which comprises a receiving-side code book 360061, and a code decoding unit 360051. The code decoding unit 360051 comprises an audio code selection unit 2900102 and a phase information extraction unit 2900107.

Hereinafter, a description is given of the operation. In this fifteenth embodiment, when decoding a code index received, the coding method according to any of the tenth to fourteenth embodiments is applied. To be specific, in the audio code selection unit 2900102, for example, elements corresponding to 2 bits from the low-band side, which are auditively important for human beings, are excluded from the 10-bit code index received, and the remaining elements corresponding to 8 bits are subjected to comparative retrieval with the codes stored in the receiving-side code book 360061. With respect to the excluded 2-bit elements, the phase information thereof is extracted using the phase information extraction unit 2900107, and added to the retrieval result, whereby an audio feature vector is reproduced, i.e., inversely quantized.

Thereby, the receiving-side code book stores only 256 pieces of codes corresponding to the 8-bit elements, whereby the data quantity stored in the receiving-side code book 360061 can be reduced. In addition, the operation in the audio code selection unit 2900102 is 256 times of code retrieval, and addition of 2 codes to each retrieval result, whereby the operation amount is significantly reduced.

While in this fifteenth embodiment the structure according to the tenth embodiment is applied to the receiving-side structure, any of the structures according to the second to fifth embodiments can be applied. Further, when it is used, not independently on the receiving side, but combined with any of the tenth to fourteenth embodiments, it is possible to construct an audio data transmitting/receiving system that can smoothly perform compression and expansion of an audio signal.

Applicability in Industry

As described above, according to an audio signal coding method of the present invention, this method is for coding a data quantity by vector quantization using a multiple-stage quantization method comprising a first-stage vector quantization process for vector-quantizing a frequency characteristic signal sequence which is obtained by frequency transformation of an input audio signal, and second-and-onward-stages of vector quantization processes for vector-quantizing a quantization error component in the previous-stage vector quantization process: wherein, among the multiple stages of quantization processes according to the multiple-stage quantization method, at least one vector quantization process performs vector quantization using, as weighting coefficients for quantization, weighting coefficients on frequency, calculated on the basis of the spectrum of the input audio signal and the auditive sensitivity characteristic showing the auditive nature of human beings. Therefore, efficient quantization can be carried out by utilizing the auditive nature of human beings.

Furthermore, according to another audio signal coding method of the present invention, this method is for coding a data quantity by vector quantization using a multiple-stage quantization method comprising a first vector quantization process for vector-quantizing a frequency characteristic signal sequence which is obtained by frequency transformation of an input audio signal, and a second vector quantization process for vector-quantizing a quantization error component in the first vector quantization process. In this method, on the basis of the spectrum of the input audio signal and the auditive sensitivity characteristic showing the auditive nature of human beings, a frequency block having a high importance for quantization is selected from frequency blocks of the quantization error component in the first vector quantization process and, in the second vector quantization process, the quantization error component of the first quantization process is quantized with respect to the selected frequency block. Therefore, efficient quantization can be carried out by utilizing the auditive nature of human beings.

Furthermore, according to another audio signal coding method of the present invention, this method is for coding a data quantity by vector quantization using a multiple-stage quantization method comprising a first-stage vector quantization process for vector-quantizing a frequency characteristic signal sequence which is obtained by frequency transformation of an input audio signal, and second-and-onward-stages of vector quantization processes for vector-quantizing a quantization error component in the previous-stage vector quantization process. In this method, among the multiple stages of quantization processes according to the multiple-stage quantization method, at least one vector quantization process performs vector quantization using, as weighting coefficients for quantization, weighting coefficients on frequency, calculated on the basis of the spectrum of the input audio signal and the auditive sensitivity characteristic showing the auditive nature of human beings, and, on the basis of the spectrum of the input audio signal and the auditive sensitivity characteristic showing the auditive nature of human beings, a frequency block having a high importance for quantization is selected from frequency blocks of the quantization error component in the first-stage vector quantization process and, in the second-stage vector quantization process, the quantization error component of the first-stage quantization process is quantized with respect to the selected frequency block. Therefore, efficient quantization can be carried out by utilizing the auditive nature of human beings.

Furthermore, according to another audio signal coding apparatus of the present invention, this apparatus comprises: a time-to-frequency transformation unit for transforming an input audio signal to a frequency-domain signal; a spectrum envelope calculation unit for calculating a spectrum envelope of the input audio signal; a normalization unit for normalizing the frequency-domain signal obtained in the time-to-frequency transformation unit, with the spectrum envelope obtained in the spectrum envelope calculation unit, thereby to obtain a residual signal; an auditive weighting calculation unit for calculating weighting coefficients on frequency, on the basis of the spectrum of the input audio signal and the auditive sensitivity characteristic showing the auditive nature of human beings; and a multiple-stage quantization unit having multiple stages of vector quantization units connected in columns, to which the normalized residual signal is input, at least one of the vector quantization units performing quantization using weighting coefficients obtained in the weighting unit. Therefore, efficient quantization can be carried out by utilizing the auditive nature of human beings.

Furthermore, according to another audio signal coding apparatus of the present invention, in the invention described above, plural quantization units among the multiple stages of the multiple-stage quantization unit perform quantization using the weighting coefficients obtained in the weighting unit, and the auditive weighting calculation unit calculates individual weighting coefficients to be used by the multiple stages of quantization units, respectively. Therefore, efficient quantization can be carried out by effectively utilizing the auditive nature of human beings.

Furthermore, according to another aspect of the present invention, the multiple-stage quantization unit comprises: a first-stage quantization unit for quantizing the residual signal normalized by the normalization unit, using the spectrum envelope obtained in the spectrum envelope calculation unit as weighting coefficients in the respective frequency domains; a second-stage quantization unit for quantizing a quantization error signal from the first-stage quantization unit, using weighting coefficients calculated on the basis of the correlation between the spectrum envelope and the quantization error signal of the first-stage quantization unit, as weighting coefficients in the respective frequency domains; and a third-stage quantization unit for quantizing a quantization error signal from the second-stage, quantization unit using, as, weighting coefficients in the respective frequency domains, weighting coefficients which are obtained by adjusting the weighting coefficients calculated by the auditive weighting calculating unit according to the input signal transformed to the frequency-domain signal by the time-to-frequency transformation unit and the auditive characteristic, on the basis of the spectrum envelope, the quantization error signal of the second-stage quantization unit, and the residual signal normalized by the normalization unit. Therefore, efficient quantization can be carried out by effectively utilizing the auditive nature of human beings.

Furthermore, according to another audio signal coding apparatus of the present invention, this apparatus comprises: a time-to-frequency transformation unit for transforming an input audio signal to a frequency-domain signal; a spectrum envelope calculation unit for calculating a spectrum envelope of the input audio signal; a normalization unit for normalizing the frequency-domain signal obtained in the time-to-frequency transformation unit, with the spectrum envelope obtained in the spectrum envelope calculation unit, thereby to obtain a residual signal; a first vector quantizer for quantizing the residual signal normalized by the normalization unit, an auditive selection means for selecting a frequency block having a high importance for quantization among frequency blocks of the quantization error component of the first vector quantizer; on the basis of the spectrum of the input audio signal and the auditive sensitivity characteristic showing the auditive nature of human beings; and a second quantizer for quantizing the quantization error component of the first vector quantizer with respect to the frequency block selected by the auditive selection means. Therefore, efficient quantization can be carried out by effectively utilizing the auditive nature of human beings.

Furthermore, according to another aspect of the present invention, the auditive selection means selects a frequency block using, as a scale of importance to be quantized, a value obtained by multiplying the quantization error component of the first vector quantizer, the spectrum envelope signal obtained in the spectrum envelope calculation unit, and an inverse characteristic of the minimum audible limit characteristic. Therefore, efficient quantization can be carried out by effectively utilizing the auditive nature of human beings. In addition, a portion which has been satisfactorily quantized in the first vector quantizer is prevented from being quantized again to generate an error inversely, whereby quantization maintaining a high quality is carried out.

Furthermore, according to another aspect of the present invention, the auditive selection means selects a frequency block using, as a scale of importance to be quantized, a value obtained by multiplying the spectrum envelope signal obtained in the spectrum envelope calculation unit and an inverse characteristic of the minimum audible limit characteristic. Therefore, efficient quantization can be carried out by effectively utilizing the auditive nature of human beings. In addition, since the codes required for quantization can be decreased, the compression ratio is increased.

Furthermore, according to another aspect of the present invention, the auditive selection means selects a frequency block using, as a scale of importance to be quantized, a value obtained by multiplying the quantization error component of the first vector quantizer, the spectrum envelope signal obtained in the spectrum envelope calculation unit, and an inverse characteristic of a characteristic obtained by adding the minimum audible limit characteristic and a masking characteristic calculated from the input signal. Therefore, efficient quantization can be carried out by effectively utilizing the auditive nature of human beings. In addition, a portion which has been satisfactorily quantized in the first vector quantizer is prevented from being quantized again to generate an error inversely, whereby quantization maintaining a high quality is carried out.

Furthermore, according to another aspect of the present invention, the auditive selection means selects a frequency block using, as a scale of importance to be quantized, a value obtained by multiplying the quantization error component of the first vector quantizer, the spectrum envelope signal obtained in the spectrum envelope calculation unit, and an inverse characteristic of a characteristic obtained by adding the minimum audible limit characteristic and a masking characteristic that is calculated from the input signal and corrected according to the residual signal normalized by the normalization unit, the spectrum envelope signal obtained in the spectrum envelope calculation unit, and the quantization error signal of the first-stage quantization unit. Therefore, efficient quantization can be carried out by effectively utilizing the auditive nature of human beings. In addition, a portion which has been satisfactorily quantized in the first vector quantizer is prevented from being quantized again to generate an error inversely, whereby quantization maintaining a high quality is carried out.

Furthermore, according to audio signal coding and decoding apparatuses of the present invention, provided for quantization is a structure capable of performing quantization even at a high data compression ratio by using, for example, a vector quantization method, and employed for allocation of data quantity during quantization is a structure in which data contributing to expansion of a reproduced band and data contributing to improvement of quality are alternately allocated. First of all, in the coding apparatus, as the first stage, an input audio signal is transformed to a signal in the frequency domain, and a portion of the frequency signal is coded; in the second stage, a portion of the frequency signal uncoded and a coding error signal in the first stage are coded and added to the codes obtained in the first stage; in the third stage, the other portion of the frequency signal uncoded, and coding error signals in the first and second stages are coded and added to the codes obtained in the first and second stages; followed by similar coding in forward stages. On the other hand, in the decoding apparatus, both of decoding using only the codes coded in the first stage and decoding using the codes decoded in the first and second stages are carried out by using the codes decoded in at least the first stage. The decoding order is to decode, alternately, codes contributing to band expansion and codes contributing to quality improvement. Therefore, satisfactory sound quality is obtained even though coding and decoding are carried out without a fixed data quantity. Further, a high-quality sound is obtained at a high compression ratio.

Furthermore, according to another audio signal coding apparatus of the present invention, the apparatus comprises: a phase information extraction unit for receiving, as an input signal, a frequency characteristic signal sequence obtained by frequency transformation of an input audio signal, and extracting phase information of a portion of the frequency characteristic signal sequence corresponding to a prescribed frequency band; a code book for containing a plurality of audio codes being representative values of the frequency characteristic signal sequence, wherein an element portion of each audio code corresponding to the extracted phase information is shown by an absolute value; and an audio code selection unit for calculating the auditive distances between the frequency characteristic signal sequence and the respective audio codes in the code book, selecting an audio code having a minimum distance, adding phase information to the audio code having the minimum distance using the output from the phase information extraction unit as auxiliary information, and outputting a code index corresponding to the audio code having tile minimum distance as an output signal. Therefore, the calculation amount in the audio code selection unit can be reduced without degrading the sensible sound quality. Further, the number of codes to be stored in the code book can be reduced.

Furthermore, according to another aspect of the present invention, there is further provided an auditive psychological weight vector table which is a table of auditive psychological quantities relative to the respective frequencies in view of the auditive psychological characteristic of human beings, and the phase information extraction unit extracts phase information of an element which matches with a vector stored in the auditive psychological weight vector table, from the input frequency characteristic signal sequence. Therefore, quantization with improved sensible sound quality is realized.

Furthermore, according to another aspect of the present invention, there is further provided a smoothing unit for smoothing the frequency characteristic signal sequence using a smoothing vector by division between vector elements and, before selecting the audio code having the minimum distance and adding the phase information to the selected audio code, the audio code selecting unit converts the selected audio code to an audio code which has not been subjected to smoothing using smoothing information output from the smoothing unit, and outputs a code index corresponding to the audio code as an output signal. Therefore, the quantity of data per frequency, which data are stored in the code book and referred to when the audio code selection unit performs retrieval, can be reduced as a whole.

Furthermore, according to another aspect of the present invention, there are further provided an auditive psychological weight vector table which is a table of auditive psychological quantities relative to the respective frequencies, in view of the auditive psychological characteristic of human beings; a smoothing unit for smoothing the frequency characteristic signal sequence using a smoothing vector by division between vector elements; and a sorting unit for selecting a plurality of values obtained by multiplying the values of the auditive psychological weight vector table and the values of the smoothing vector table, in order of auditive; importance, and outputting these values toward the audio code selection unit. Therefore, it is possible to calculate a code index while considering both of an element which is important for the auditive characteristic of human beings, and an element which is physically important, resulting in audio signal compression of higher quality.

Furthermore, according to another audio signal inverse-quantization apparatus of the present invention, this apparatus comprises: a phase information extraction unit for receiving, as an input signal, one of code indices obtained by quantizing frequency characteristic signal sequences which are feature quantities of an audio signal, and extracting phase information of elements of the input code index corresponding to a prescribed frequency band, a code book for containing a plurality of frequency characteristic signal sequences corresponding to the code indices, wherein an element portion corresponding to the extracted phase information is shown by an absolute value; and an audio code selection unit for calculating the auditive distances between the input code index and the respective frequency characteristic signal sequences in the code book, selecting a frequency characteristic signal sequence having a minimum distance, adding phase information to the frequency characteristic signal sequence having the minimum distance using the output from the phase information extraction unit as auxiliary information, and outputting the frequency characteristic signal sequence corresponding to the input code index as an output signal. Therefore, the quantity of data stored in the code book used on the receiving end can be reduced and, further, the calculation amount on the receiving end can be reduced significantly.

What is claimed is:

1. An audio signal coding method for coding data, said method being for use with a frequency characteristic signal sequence resulting from frequency transformation of an input audio signal, said method comprising:

a first vector-quantization process for vector-quantizing the frequency characteristic signal sequence, wherein said first vector-quantization process produces a quantization error component;

selecting, from frequency bands of the quantization error component produced by said first vector-quantization process, a frequency band having a highest importance in quantization based on a spectrum of the input audio signal and one or more human auditive sensitivity characteristics; and a second vector-quantization process for vector-quantizing the quantization error component produced by said first vector-quantization process with respect to only the selected frequency band.

2. An audio signal coding apparatus comprising:

a time-to-frequency transformation unit operable to transform an input audio signal to a frequency-domain signal;

a spectrum envelope calculation unit operable to calculate a spectrum envelope of the input audio signal;

a normalization unit operable to normalize the frequency-domain signal, obtained by said time-to-frequency transformation unit, with the spectrum envelope, obtained by said spectrum envelope calculation unit, to obtain a residual signal;

a first vector quantizer operable to vector-quantize the residual signal normalized by said normalization unit, wherein said first vector-quantizer produces a quantization error component;

an auditive selection means for selecting, from frequency bands of the quantization error component produced by said first vector quantizer, a frequency band having a highest importance in quantization based on a spectrum of the input audio signal and one or more human auditive sensitivity characteristics; and a second vector quantizer operable to vector-quantize the quantization error component produced by said first vector-quantizer with respect to only the frequency band selected by said auditive selection means.

3. An audio signal coding apparatus according to claim 2, wherein said auditive selection means selects the frequency band according to a quantization-importance scale including values obtained by multiplying the quantization error component produced by said first vector quantizer, the spectrum envelope signal obtained by said spectrum envelope calculation unit, and the inverse of the human minimum audible limit characteristic.

4. An audio signal coding apparatus according to claim 2, wherein said auditive selection means selects the frequency band according to a quantization-importance scale including values obtained by multiplying the spectrum envelope signal obtained by said spectrum envelope calculation unit and the inverse of the human minimum audible limit characteristic.

5. An audio signal coding apparatus according to claim 2, wherein said auditive selection means selects the frequency band according to a quantization-importance scale including values obtained by multiplying the quantization error component produced by said first vector quantizer, the spectrum envelope signal obtained by said spectrum envelope calculation unit, and the inverse of the sum of the human minimum audible limit characteristic and a masking characteristic calculated from the input signal.

6. An audio signal coding apparatus according to claim 2, wherein said auditive selection means selects the frequency band according to a quantization-importance scale including values obtained by multiplying the quantization error component produced by said first vector quantizer, the spectrum envelope signal obtained by said spectrum envelope calculation unit, and the inverse of the sum of the human minimum audible limit characteristic and a masking characteristic calculated from the input signal and corrected according to the residual signal normalized by said normalization unit, the spectrum envelope signal obtained by said spectrum envelope calculation unit, and the quantization error signal produced by said first quantizer.

7. An audio signal coding apparatus according to claim 2, wherein said first vector quantizer is operable to select, from frequency bands of the frequency-domain signal, a frequency band having a large energy-addition-sum of quantization error, and to quantize the selected frequency band.

8. An audio signal coding apparatus according to claim 2, wherein said first vector quantizer is operable to select, from frequency bands of the frequency-domain signal, a frequency band having a large energy-addition-sum of quantization error weighted so that a frequency band having a high importance according to the human auditive sensitivity characteristic has a high value, and to quantize the selected frequency band.

9. An audio signal coding apparatus according to claim 2, wherein said first vector quantizer is operable to vector-quantize, at least once, all of the frequency bands of the frequency-domain signal.

10. An audio signal coding apparatus according to claim 2, wherein said first vector quantizer is operable to calculate a vector quantization error based on a code book, and said second vector quantizer is operable to vector-quantize the vector quantization error calculated by said first vector quantizer.

11. An audio signal coding apparatus according to claim 10, wherein said first vector quantizer is operable to calculate the vector quantization error based on a code book and based on code vectors, all or some of which are inverted.

12. An audio signal coding apparatus according to claim 10, wherein said first vector quantizer, in calculating the vector quantization error, is operable to calculate distances for retrieval of an optimum code according to a weighting based on the residual signal.

13. An audio signal coding apparatus according to claim 12, wherein said first vector quantizer, in calculating the vector quantization error, is operable to calculate distances for retrieval of an optimum code according to a weighting based on the residual signal and according to the human auditive sensitivity characteristic, and said first vector quantizer is operable to extract a code having a minimum distance.

14. An audio signal coding apparatus according to claim 2, wherein said normalization unit includes a frequency outline normalization unit operable to roughly normalize the outline of the frequency-domain signal.

15. An audio signal coding apparatus according to claim 2, wherein said normalization unit includes a band amplitude normalization unit operable to divide the frequency-domain signal into a plurality of components of continuous unit bands and to normalize the frequency-domain signal by dividing each unit band with a single value.

16. An audio signal coding apparatus according to claim 2, wherein said first vector quantizer is operable to vector-quantize, at least once, all of the frequency bands of the frequency-domain signal, and said first vector quantizer includes a plurality of divided vector quantizers operable to separately quantize the frequency bands of the frequency-domain signal, respectively.

17. An audio signal coding apparatus according to claim 16, wherein:

said first vector quantizer includes, as said plurality of divided vector quantizers:

a low-band divided vector quantizer operable to quantize a low-band component of the frequency-domain signal and to calculate a quantization error of the low-band component, an intermediate-band divided vector quantizer operable to quantize an intermediate-band of the frequency-domain signal and to calculate a quantization error of the intermediate-band component, and a high-band divided vector quantizer operable to quantize a high-band component of the frequency-domain signal and to calculate a quantization error of the high-band component;

said second vector quantizer is connected after said first vector quantizer and is operable to quantize a first predetermined band width of outputs from the divided vector quantizers of said first vector quantizer;

said apparatus further comprises a third vector quantizer, connected after said second vector quantizer, operable to quantize a second predetermined band width of an output from said second vector quantizer.

18. An audio signal coding apparatus according to claim 17, further comprising:

a first quantization band selection unit between said first vector quantizer and said second vector quantizer; and a second quantization band selection unit between said second vector quantizer and said third vector quantizer;

wherein said first quantization selection unit is operable to select, and input into said second vector quantizer, the outputs from said first vector quantizer that are in the first predetermined band width, and said second vector quantizer is operable to quantize the outputs of said first vector quantizer in the first predetermined band width with respect to the quantization errors calculated by said divided vector quantizers of said first vector quantizer and to calculate, and to output into said second quantization band selection unit, a quantization error with respect to the input of said second vector quantizer; and wherein said second quantization band selection unit is operable to select, and output into said third vector quantizer, a portion of the output from said second vector quantizer that is in the second predetermined band width, and said third vector quantizer is operable to quantize the output from said second quantization band selection unit.

19. An audio signal decoding apparatus for receiving, as an input, codes output from said audio signal coding apparatus according to claim 17, and for decoding the codes to output a signal corresponding to the input audio signal, said decoding apparatus comprising:

an inverse quantization unit operable to perform inverse quantization based only on codes output from said low-band divided vector quantizer of said first vector quantizer.

20. An audio signal decoding apparatus for receiving as an input, codes output from said audio signal coding apparatus according to claim 17, and for decoding the codes to output a signal corresponding to the input audio signal, said decoding apparatus comprising:

an inverse quantization unit operable to perform inverse quantization based on codes output from said low-band divided vector quantizer of said first vector quantizer and based on codes output from said second vector quantizer.

21. An audio signal decoding apparatus for receiving, as an input, codes output from said audio signal coding apparatus according to claim 17, and for decoding the codes to output a signal corresponding to the input audio signal, said decoding apparatus comprising:

an inverse quantization unit operable to perform inverse quantization based on codes output from said low-band divided vector quantizer and said intermediate-band divided vector quantizer of said first vector quantizer and based on codes output from said second vector quantizer.

22. An audio signal decoding apparatus for receiving, as an input, codes output from said audio signal coding apparatus according to claim 17, and for decoding the codes to output a signal corresponding to the input audio signal, said decoding apparatus comprising:

an inverse quantization unit operable to perform inverse quantization based on codes output from said low-band divided vector quantizer and said intermediate-band divided vector quantizer of said first vector quantizer and based on codes output from said second vector quantizer and codes output from said third vector quantizer.

23. An audio signal decoding apparatus for receiving, as an input, codes output from said audio signal coding apparatus according to claim 17, and for decoding the codes to output a signal corresponding to the input audio signal, said decoding apparatus comprising:

an inverse quantization unit operable to perform inverse quantization based on codes output from said low-band divided vector quantizer, said intermediate-band divided vector quantizer, and said high-band vector quantizer of said first vector quantizer and based on codes output from said second vector quantizer and codes output from said third vector quantizer.

24. An audio signal decoding apparatus for receiving, as an input, codes output from said audio signal coding apparatus according to claim 16, and for decoding the codes to output a signal corresponding to the input audio signal, said decoding apparatus comprising:

an inverse quantization unit operable to perform inverse quantization based on codes output from some or all of said vector quantizers of said audio signal coding apparatus.

25. An audio signal decoding apparatus according to claim 24, wherein said inverse quantization unit is operable to:

perform inverse quantization of quantized codes in a prescribed band by executing, alternately, inverse quantization of quantized codes in a next stage, and inverse quantization of codes in a band different from the prescribed band;

continuously execute inverse quantization of quantized codes in the different band when there are no quantized codes in the next stage; and continuously execute inverse quantization of quantized codes in the next stage when there are no quantized codes in the different band.

26. An audio signal coding apparatus according to claim 2, wherein:

said first vector quantizer is operable to vector-quantize, at least once, all of the frequency bands of the frequency-domain signal;

said second vector quantizer includes:

a low-band divided vector quantizer operable to quantize a low-band component of the frequency-domain signal and to calculate a quantization error of the low-band component, an intermediate-band divided vector quantizer operable to quantize an intermediate-band of the frequency-domain signal and to calculate a quantization error of the intermediate-band component, and a high-band divided vector quantizer operable to quantize a high-band component of the frequency-domain signal and to calculate a quantization error of the high-band component;

said apparatus further comprises a third vector quantizer, connected after said second vector quantizer, operable to quantize a predetermined band width of outputs from said second vector quantizer.

27. An audio signal decoding apparatus for receiving, as an input, codes output from said audio signal coding apparatus according to claim 2, for decoding the codes to output a signal corresponding to the input audio signal, said decoding apparatus comprising:

an inverse quantization unit operable to perform inverse quantization based on at least a portion of the codes output from said audio signal coding apparatus to output the frequency-domain signal; and an inverse frequency transformation unit operable to transform the frequency-domain signal output by said inverse quantization unit into a signal corresponding to the input audio signal.

28. An audio signal decoding apparatus for receiving, as an input, codes output from said audio signal coding apparatus according to claim 2, and for decoding the codes to output a signal corresponding to the input audio signal, said decoding apparatus comprising:

an inverse quantization unit operable to reproduce the frequency-domain signal;

an inverse normalization unit operable to reproduce the residual signal based on the codes output by said audio signal coding apparatus, the frequency-domain signal output by said inverse quantization unit, and to multiply the residual signal and the frequency-domain signal; and an inverse frequency transformation unit operable to receive an output of said inverse normalization unit and to transform the frequency-domain signal into a signal corresponding to the input audio signal.

* * * * *

UNITED STATES PATENT AND TRADEMARK OFFICE

CERTIFICATE OF CORRECTION

PATENT NO. : 6,826,526 B1
DATED : November 30, 2004
INVENTOR(S) : Takeshi Norimatsu et al.

It is certified that error appears in the above-identified patent and that said Letters Patent is hereby corrected as shown below:

Column 52,
Line 11, please replace ", for decoding" with -- , and for decoding --.

Signed and Sealed this

Twenty-sixth Day of July, 2005

JON W. DUDAS
*Director of the United States Patent and Trademark Office*